United States Patent [19]

Smith

[11] Patent Number: 4,535,571

[45] Date of Patent: Aug. 20, 1985

[54] GRINDING CONTROL METHODS AND APPARATUS

[75] Inventor: Roderick L. Smith, Rockford, Ill.

[73] Assignee: Energy-Adaptive Grinding, Inc., Rockford, Ill.

[21] Appl. No.: 580,242

[22] Filed: Feb. 15, 1984

Related U.S. Application Data

[62] Division of Ser. No. 249,192, Mar. 30, 1981, abandoned.

[51] Int. Cl.[3] ..... B24B 53/00

[52] U.S. Cl. ..... 51/165.87; 51/165.88; 51/5 D; 51/325

[58] Field of Search ..... 125/11 R, 11 CD; 51/165.87, 165.88, 5 D, 281 R, 325, 165.71

[56] References Cited

U.S. PATENT DOCUMENTS

| | | | |
|---|---|---|---|
| 1,649,713 | 11/1927 | Lofquist | 125/11 CD |
| 2,038,150 | 4/1936 | Weber | 125/11 CD |
| 2,528,621 | 11/1950 | Sweetser | 125/11 CD |
| 2,585,990 | 2/1952 | Baldenhofer . | |
| 2,636,321 | 4/1953 | Wilson . | |
| 2,664,681 | 1/1954 | Clark | 125/11 CD |
| 2,780,214 | 2/1957 | Page | 125/11 CD |
| 3,167,891 | 2/1965 | Coes et al. . | |
| 3,178,861 | 4/1965 | Milias | 51/165.71 |
| 3,524,283 | 8/1970 | Jones . | |
| 3,543,502 | 10/1970 | Lovely . | |
| 3,553,893 | 1/1971 | Stade . | |
| 3,653,855 | 4/1972 | Smith . | |
| 3,798,846 | 3/1974 | Smith . | |
| 3,828,477 | 8/1974 | Sanford et al. . | |
| 3,842,543 | 10/1974 | Hohler et al. . | |
| 3,885,353 | 5/1975 | Ota et al. . | |
| 3,965,621 | 6/1976 | Grieb et al. . | |
| 3,971,358 | 7/1976 | Sawluk | 125/11 CD |
| 4,038,782 | 8/1977 | Cozzini . | |
| 4,059,927 | 11/1977 | Robillard . | |
| 4,068,412 | 1/1978 | Camp et al. . | |
| 4,084,349 | 4/1978 | Farrell . | |
| 4,085,554 | 4/1978 | Sugita | 51/165.87 |
| 4,112,624 | 9/1978 | Uhtenwoldt et al. . | |
| 4,118,900 | 10/1978 | Moritomo | 51/165.87 |
| 4,151,684 | 5/1979 | Wada et al. . | |

OTHER PUBLICATIONS

R. Smith, "Productivity and Energy Adaptive Control of Precision Grinding", May 3, 1977, paper given at *Annual Meeting of Abrasive Engineering Society.*

R. Smith, "The Energy-Adaptive Control of Precision Grinding", paper given at Jun. 13-14, 1978 *Forty-Second Annual Machine Tool Forum.*

R. Smith, "Energy-Adaptive CNC of Precision Grinding", 16 pages plus cover paper given at Mar. 22, 1979 WESTEC Meeting.

(List continued on next page.)

*Primary Examiner*—Harold D. Whitehead

*Attorney, Agent, or Firm*—Leydig, Voit, Osann, Mayer & Holt, Ltd.

[57] ABSTRACT

Grinding control methods and apparatus pertaining generally to maintaining the shape and sharpness of a grinding wheel, despite the tendency of the wheel face to deteriorate from the desired shape and sharpness, as grinding of a given workpiece or a succession of workpieces proceeds. Generally, as a common denominator of the novel features disclosed, a "conditioning element" is brought into rubbing contact with the face of the grinding element under specially controlled and unique conditions to (i) restore the desired shape (conventionally called truing), or (ii) to establish the desired degree of sharpness (conventionally called "dressing"), or to accomplish both (i) and (ii) simultaneously. The methods and apparatus disclosed include creating the aforesaid controlled rubbing contact either while the grinding wheel is free of grinding contact with a workpiece or simultaneously while grinding is occurring, and then either continuously or intermittently. The methods and apparatus in many of their various embodiments involve use of a "truing element" or a "conditioning element" which may be a generally homogeneous metal, and in many cases the same metal as that of the workpieces being ground. This advantageously results in lower costs as well as greater productivity and workpiece quality (both size tolerance and surface finish).

34 Claims, 36 Drawing Figures

OTHER PUBLICATIONS

R. Smith, "Energy-Adaptive CNC of Precision Grinding", 5 pages, published in Jun.-Jul. 1979 issue of *NC/CAM Journal of the Numerical Control Society.*

Joseph Klipper, "Rotary Dressers; Some Problems and Solutions", reprinted from *Proceedings: Industrial Diamond Conference,* 1969.

"Clipper Rotodress", *Catalogue RD*-76 published 1976/78 by Clipper Diamond Tool Co., Inc., 9 pages and cover, flyleaf and chart.

"Pre-Grinding Preparation of Diamond Abrasive Grinding Wheels-Cup Wheels," Pocket Folder PF-3 comprised of six page panels, date unknown, published by De Beers Industrial Diamond Division.

"Peripheral Wheels", Pocket Folder PF-2 comprised of six page panels, date unknown, published by De Beers Industrial Diamond Division.

Author Unknown, "Creep Feed Grinding-The Answer to a Production Engineer's Dream?", Dec. 1979, *The Production Engineer,* pp. 20-24.

Stuart C. Salmon, "Creep-Feed Surface Grinding", Thesis at University Bristol, Sep. 1979, cover and pp. iii-iv, 1-5 and 75-77 and Appendix I. These are the only pages which applicant has.

Book "New Developments in Grinding", edited by M. C. Shaw, published 1972 by Carnegie Press, pp. 220, 225, 666-669, 685-687, 702-707, 771, 772, 785, 906-913, 929 and 932-936.

Guy Bellows, paperback book entitled "Low Stress Grinding", published 1978 by Machinability Data Center, Publication No. MDC 78-103; pp. 11, 28-29, 34-35, 44, 48-49, 73 and 76.

Robert Lord, "Plunge Form Abrasive Machining", pp. 76-78 in Jun. 1981 issue of Manufacturing Engineering.

Mark Albert, "Taking The Creep Out of Creep-Feed Grinding", pp. 80-87 in Nov. 1982 issue of *Modern Machine Shop.*

J. Jablonowski, "Controls to Enhance Grinding", pp. 147-158 in Mar. 1981 issue of *American Machinist.*

Fig. 2.
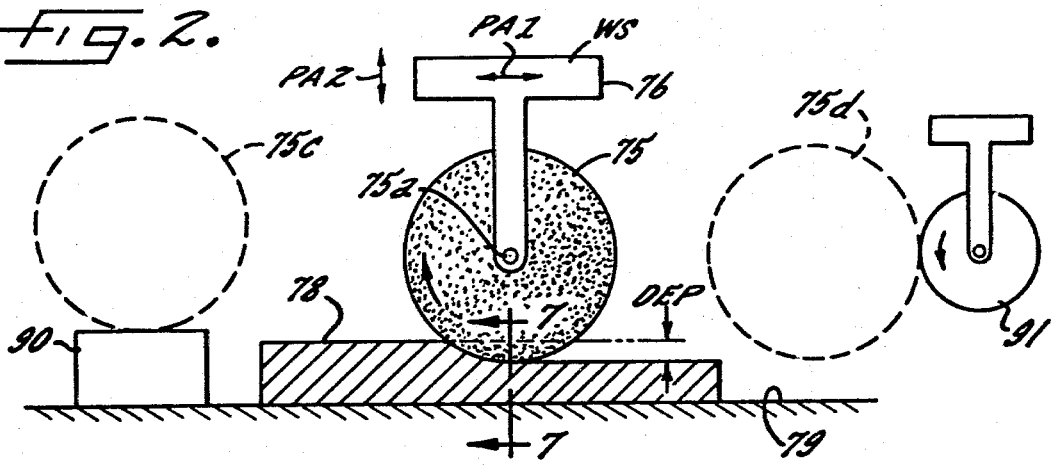
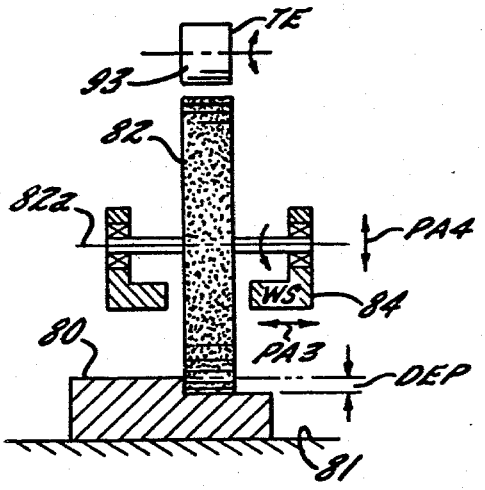
Fig. 3.
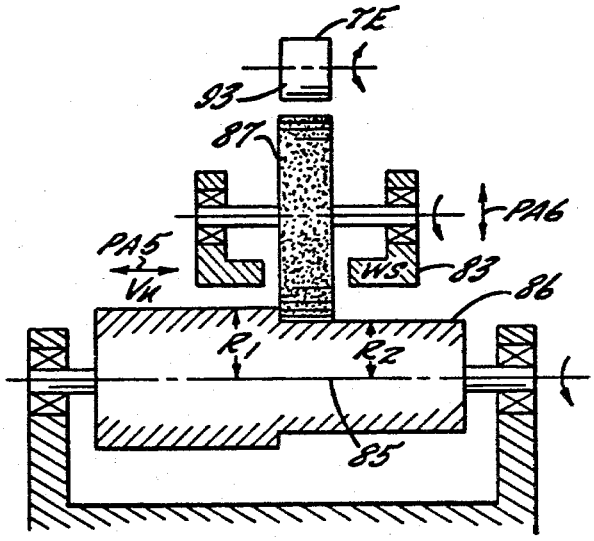
Fig. 4.
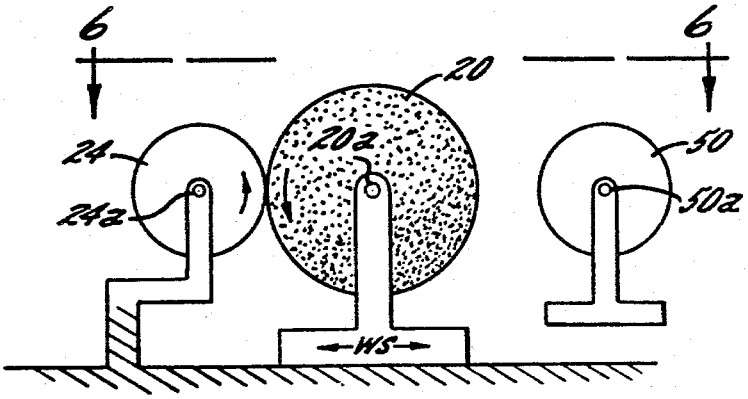
Fig. 5.

71H
223
Wpd
220
SERVO AMP.
Wp
TA
39
PM
224
Wwd
221
SERVO AMP.
Ww
TA
36
WM
225
Ftsd
222
SERVO AMP.
Fts
TA
59
TFM
230
GR=Fpsd
231
ERR 10
232
SERVO AMP.
Fws
TA
28
WFM
Fps
Pws
Pps
Pts
Ww
Wte
TORte
Fws
SIGNALS FROM FIG. 1.
235
Rw
238
Rw/Rte
236
Rte
239
MULT.
240
250
STEd
241
MULT.
STE
249
251
245
Rw
MULT.
246
L
L·Rw·R'w
252
SERVO AMP.
R'w
244
247
Vtm
Wte
TM SERVO AMP.
220
221
PM
WM
TA
WFM
TM
MULT.
GATE
INV
SIGNALS FROM FIG. 1.
TO FIG. 22B.
SETUP
RUN 223
$\omega_{pd}$
SERVO AMP.
220
$\omega_p$
TA
39
PM
713
224
$\omega_{wd}$
SERVO AMP.
221
$\omega_w$
TA
36
WM
225
$F_{tsd}$
SERVO AMP.
222
$F_{ts}$
TA
59
TFM
230
GR=$F_{psd}$
231
SERVO AMP.
232
$F_{ws}$
TA
28
WFM
$F_{ps}$=R'p
$P_{ws}$
$P_{ps}$=Rp
$\omega_w$
$\omega_p$
TORp
SIGNALS FROM FIG. 1.
400
Rw
401
Rw/Rp
402
MULT.
404
405
MULT.
411
SGEd
SGE
410
412
SGERR
414
SERVO AMP.
406
MULT.
408
L
L·Rp·R'p
409
$V_{tm}$
$\omega_{tb}$
TM 71K
223
ωpd
SERVO AMP.
220
ωp
TA
39
PM
224
ωwd
SERVO AMP.
221
ωw
TA
36
WM
225
Ftsd
SERVO AMP.
222
Fts
TA
59
TFM
450
GR=R'pd
Fwsd
ERRtz
SERVO AMP.
455
Fws
TA
28
WFM
452
454
451
Fts
R'te
R'w
460
Pts
Rte
Rw
461
SIGNALS FROM FIG. 1.
ωw
MULT.
462
464
ωte
465
TORte
MULT.
∝PWRt
STE
470
STEd
250
251
R'w
Rw
MULT.
468
469
L
L·Rw·R'w∝W'
SERVO AMP.
252
Vtm
ωte
TM 71L
223
ωpd
SERVO AMP.
220
ωp
TA
39
PM
224
ωwd
SERVO AMP.
221
ωw
TA
36
WM
225
Ftsd
SERVO AMP.
222
Fts
TA
59
TFM
450
GR=R'pd
452
Fwsd
454
SERVO AMP.
455
Fws
TA
28
WFM
451
Fts
R'te
R'w
480
Pts
Rte
Rw
482
Rw/Rp
481
Pws
Rp
484
MULT.
485
411
SGEd
ωw
ωp
TORp
MULT.
∝PWRg
486
SGE
412
491
SGERR
489
Rp
MULT.
L
L·Rp·R'p∝M'
SERVO AMP.
414
Fws
R'w
R'p
488
Vtm
ωte
TM
SIGNALS FROM FIG. 1.

71M
223
ωpd
220
SERVO AMP.
ωp
TA
39
PM
224
ωwd
221
ωw
36
WM
225
Ftsd
222
Fts
59
TFM
501
GR=R'pd
500
Fwsd
ERR12
502
504
Fws
28
WFM
(R'w)
Fts
Pws
Rp
518
508
509
Rte
Rw
510
506
Srd
Pts
ωw
MULT.
Rw ωw
514
515
516
Rte ωte
Sr
ERR13
SERVO AMP.
ωte
511
512
2π
A
Vtm
TM
SIGNALS FROM FIG. 1.

GRINDING CONTROL METHODS AND APPARATUS

This is a division, of application Ser. No. 249,192, filed Mar. 30, 1981 now abandoned.

FIELD OF INVENTION AND OBJECTS

The present invention relates in general to methods and apparatus for grinding workpieces with rotationally driven grinding wheels of known types which structurally comprise abrasive grits bonded in a supporting matrix. In use, the grits become flattened and dulled under certain conditions, and they fracture or break out of the supporting matrix so that the wheel wears down under other conditions—not only causing reduction in the wheel radius but also deterioration of the wheel face from the desired "form" or shape. More particularly, the present invention relates to methods and apparatus for conditioning a grinding wheel, i.e., restoring or maintaining a desired degree of wheel face sharpness and/or shape, as grinding of workpieces progresses.

It is the general aim of the invention to vastly enhance the speed, efficiency and accuracy with which workpieces are ground to a desired size, shape and surface finish—relative to the speed, efficiency and accuracy obtainable through known and conventional practices of the grinding art.

More particularly, it is an object of the invention to control the condition, i.e., sharpness and/or the shape of a grinding wheel face, despite the normal tendency for the wheel to become dull and lose its desired shape—by methods and apparatus which not only depart radically from known and conventional practices in the art but which yield greater economy and higher productivity for the grinding procedure.

In this latter aspect, it is an object of the invention to so control the interaction between a "conditioning element" (for example, a truing roll) and the face of a grinding wheel to bring or maintain the latter to the desired sharpness and desired shape—and with a less expensive conditioning element being required, with relatively long life for the conditioning element, with little expenditure of time, and thus with little or no robbing of time devoted to the grinding of workpieces.

A related object of the invention is to achieve the grinding of workpieces through the use of a single grinding wheel which, during all different stages of action on a workpiece, is controlled to have the desired sharpness and form (wheel face shape).

Specifically, it is an object to true (maintain shape) a grinding wheel face rapidly while leaving the wheel face grits sharp.

Specifically, it is an object to true (maintain shape) a grinding wheel face rapidly through the use of a conditioning element which is low in cost (especially compared to the common diamond truing roll), lasts reasonably long, and is easily replaceable.

Specifically, it is an object to true (maintain shape) a grinding wheel face rapidly through the use of a conditioning element which is the same in material and shape as the workpieces being ground by the wheel, and which indeed may be one of those workpieces.

Specifically, it is an object of the invention to extend the useful life of a diamond truing element by a factor presently unknown by which appears to be at least ten or twenty times the useful life presently obtained in the grinding art for a diamond chip truing element or roll.

A further object of the invention is to condition a grinding wheel face for sharpness and/or form in a reproducible fashion so that the grinding action is predetermined and known as the wheel continues in or is returned to its grinding contact with the workpiece.

Another object is to provide methods and apparatus by which a grinding wheel face is readily made sharp during or for rough grinding, thus to promote efficiency of grinding action; and by which the wheel face is readily made smooth during or for final, finish grinding—thus to achieve a low microinch (smooth) surface finish on the workpiece.

Still another object of the invention is to obtain the foregoing advantages by wheel conditioning action which transpires, either intermittently or continuously, while the wheel is grinding on a workpiece—thereby saving time and increasing productivity of a given grinding machine.

An important object of the invention is to achieve control of the "specific grinding energy" (SGE), between a workpiece and a grinding wheel, by controlling the conditions of rubbing contact between the wheel and a conditioning element.

A related object is to successfully grind thin or flexible workpieces without surface burn or other metalurgical injury and despite the fact that the grinding wheel being employed otherwise could only be infed to the workpiece with such small force and rate that the wheel would tend to rapidly dull.

IT is also an object of the invention to achieve the results of an in-process workpiece-sensing size gage in the grinding of workpieces—and thus to obtain workpiece size control despite wheel wear—by methods and apparatus which (a) involve no sensing gage at all in some cases, or (b) which involve a conditioning element-sensing gage which may be much less expensive and complex and operate over a lesser range of distances as compared to a conventional workpiece sensing gage.

These and other objects and advantages will become apparent as the following detailed description proceeds, taken in conjunction with the accompanying drawings.

IDENTIFICATION OF DRAWING FIGURES

FIG. 2 is a fragmentary, diagrammatic representation of a surface grinding machine (as contrasted to the cylindrical grinding machine represented in FIG. 1) and which as a matter of background illustrates the various relative motions for surface grinding and truing of the grinding wheel.

FIG. 3 is a fragmentary, diagrammatic illustration of a surface grinding machine having wheel feed motions different from those shown in FIG. 2.

FIG. 4 is a fragmentary, diagrammatic representation of a roll grinding machine to illustrate the various motions there involved.

FIG. 5 is a fragmentary, diagrammatic representation of a cylindrical grinding machine and corresponds, in simplified form, to FIG. 1.

Figures 1, 1A:
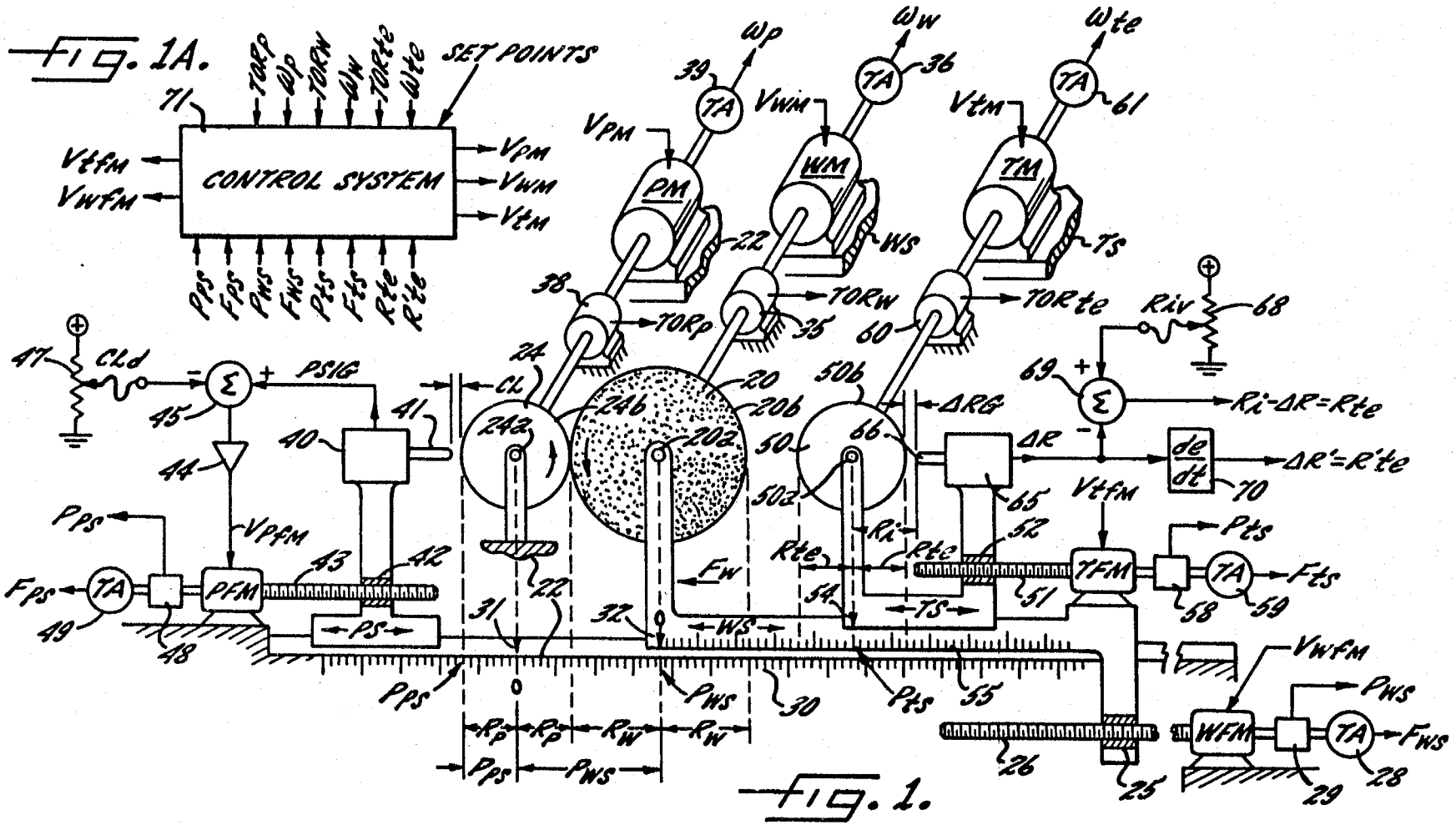
FIG. 1 is a diagrammatic illustration of an exemplary grinding machine with rotational and feed drives for the various relatively movable components, and with sensors for signaling the values of different physical parameters such as speeds, feed rates, positions and torques.
FIG. 1A is a generalized representation of a control system to be associated with the apparatus of FIG. 1 in the practice of the present invention according to any of several embodiments.
Figure 17:
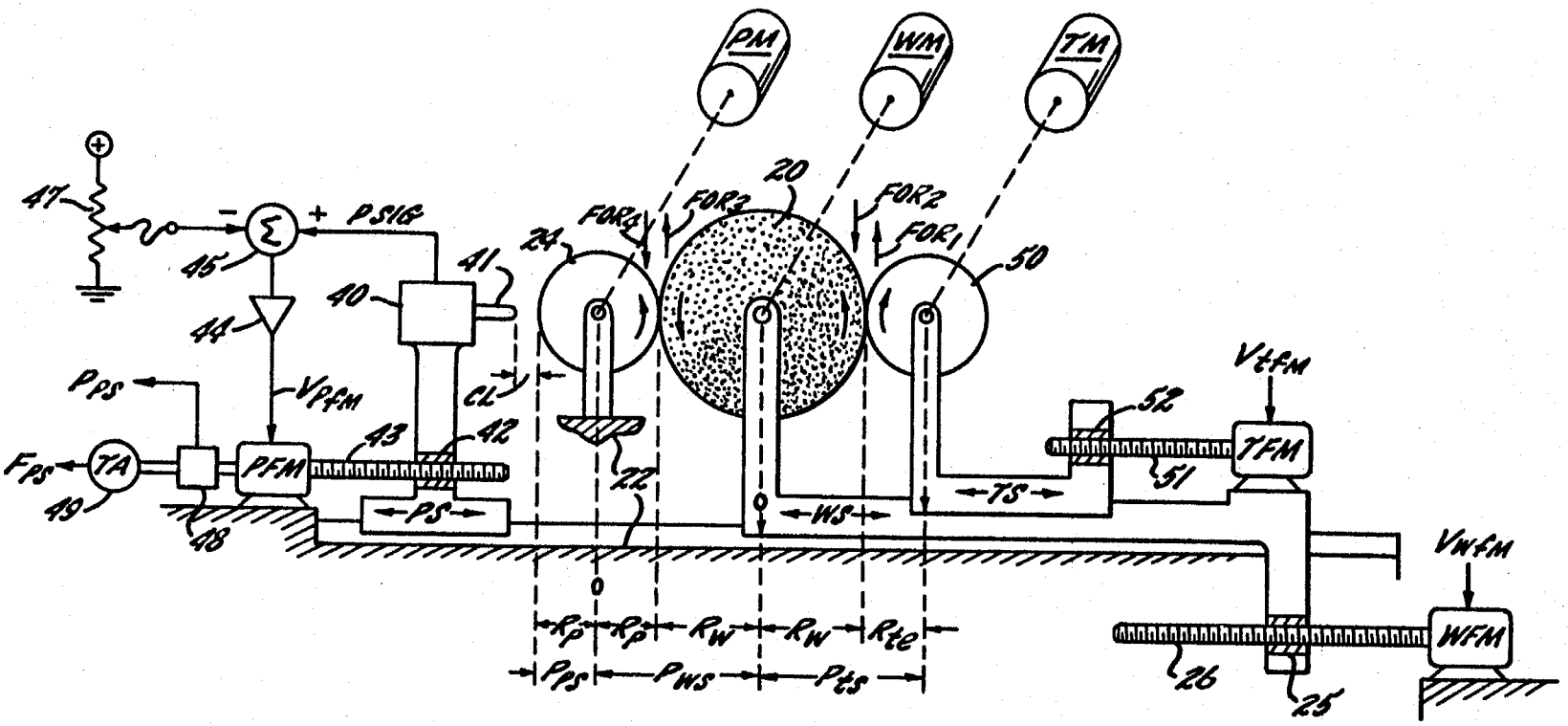
FIG. 17 is a simplified counterpart of FIG. 1 and illustrates the relative positioning of the different components when a grinding wheel is acting to grind a workpiece and is being simultaneously trued or conditioned by the action of a truing element.
Figure 18:
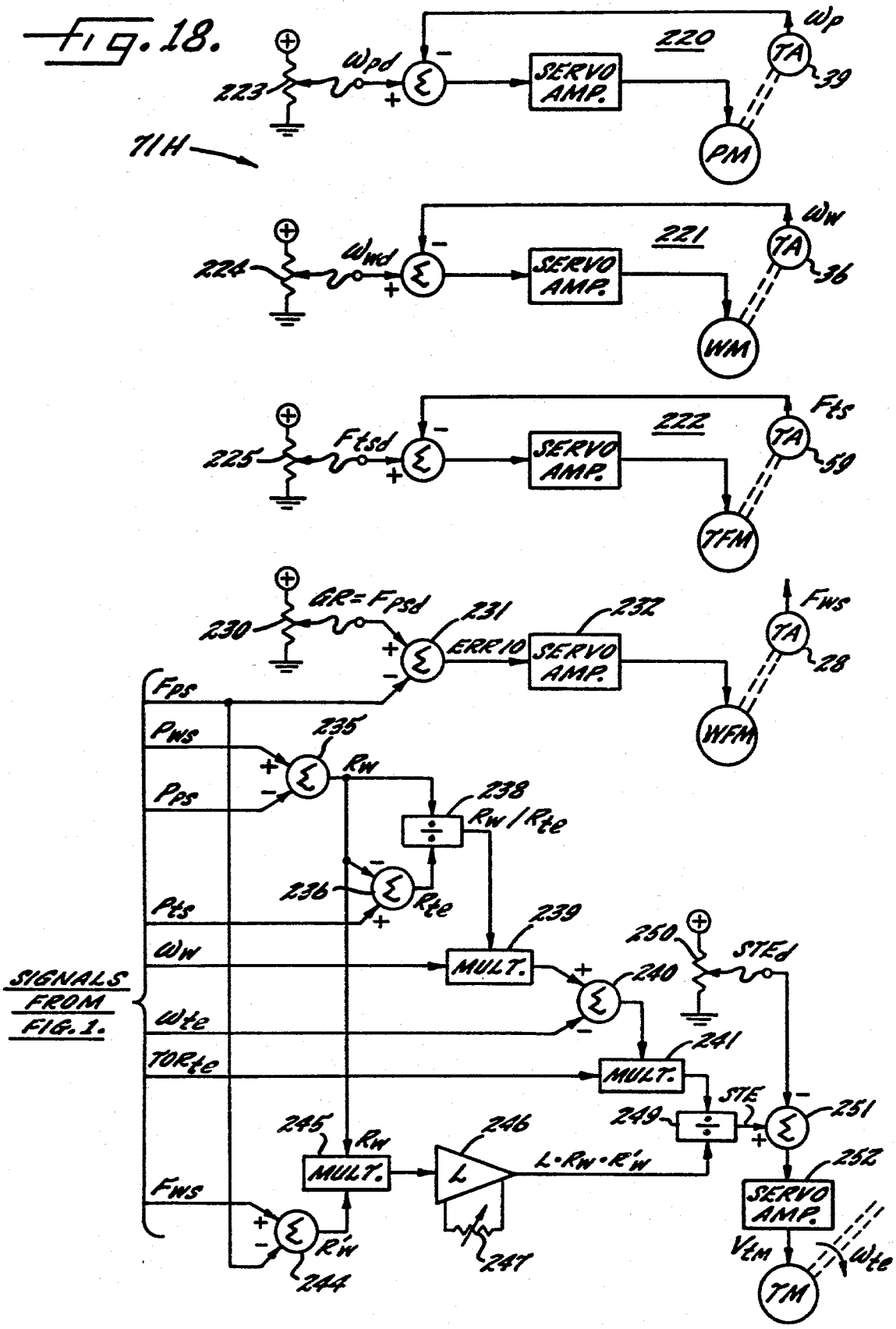

FIG. 18, taken with FIG. 17, is an electrical block diagram of one embodiment of the control system of FIG. 1A, and by which the STE ratio of truing action is controlled while grinding and truing are taking place simultaneously.

Figure 19:
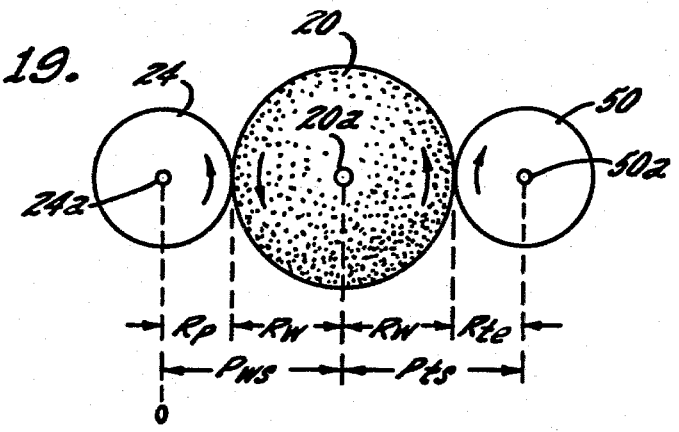
Figure 20:
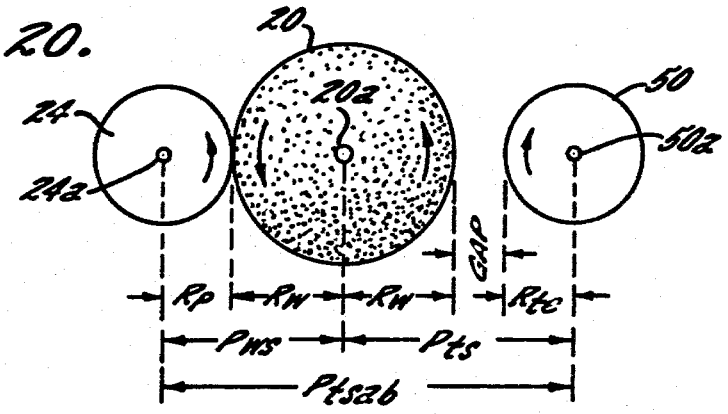
Figure 21:
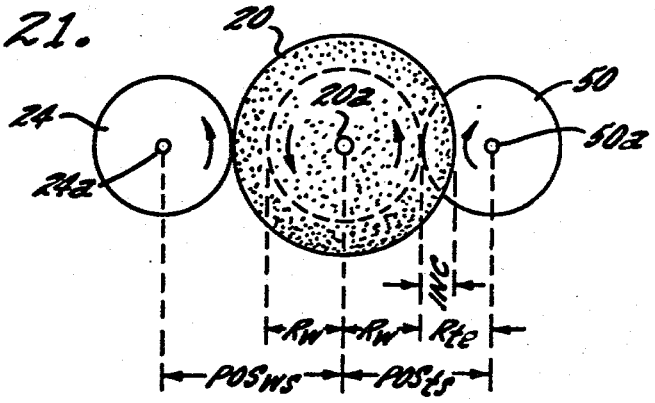

FIGS. 19, 20 and 21 are simplified diagrams illustrating the relative positions of a grinding wheel, a workpiece, and a truing or conditioning element at different stages within operations by which a truing element "follows with the gap" the wheel face and periodically engages the wheel face while the wheel continues grinding of a workpiece.

Figure 22A:
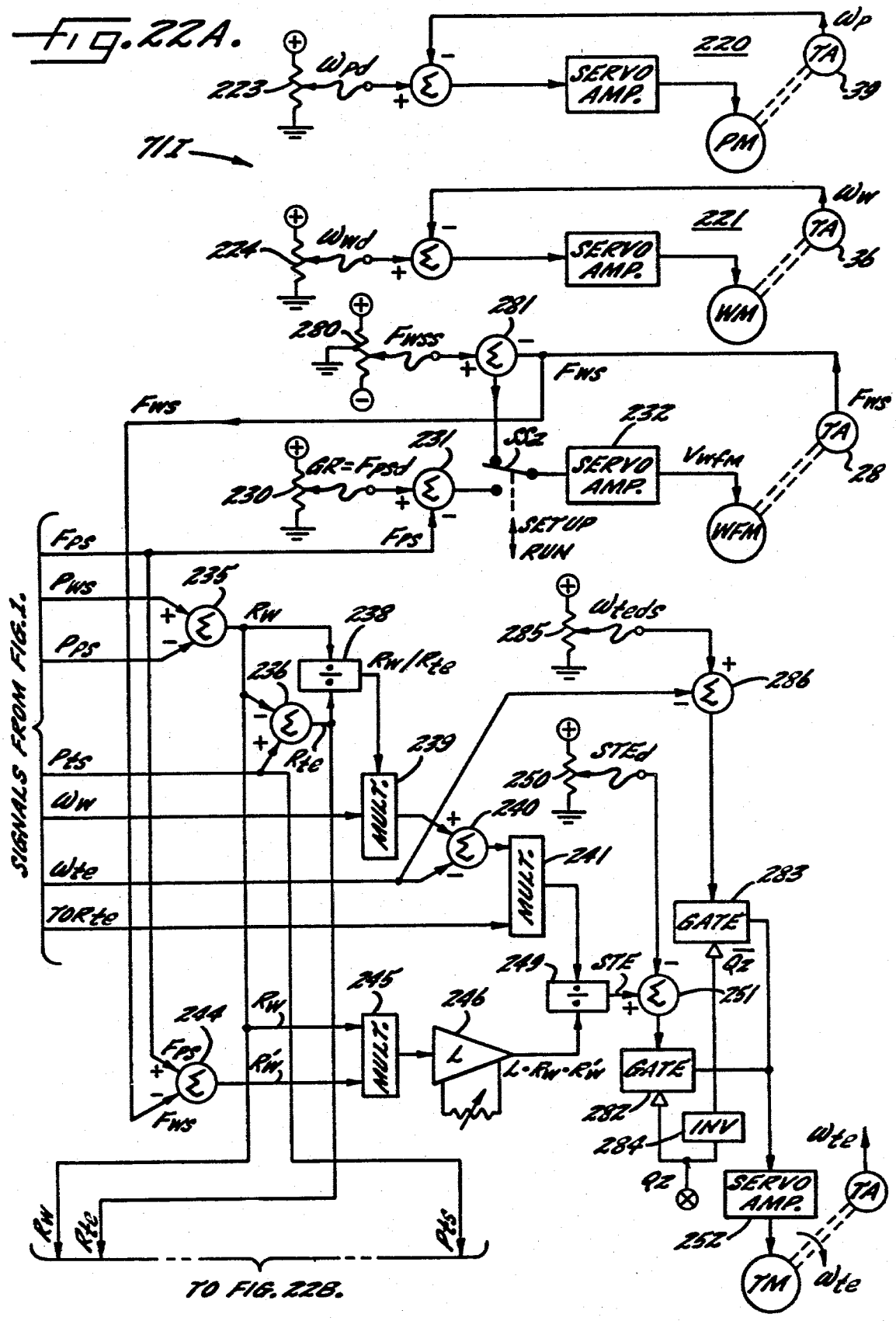
Figure 22B:
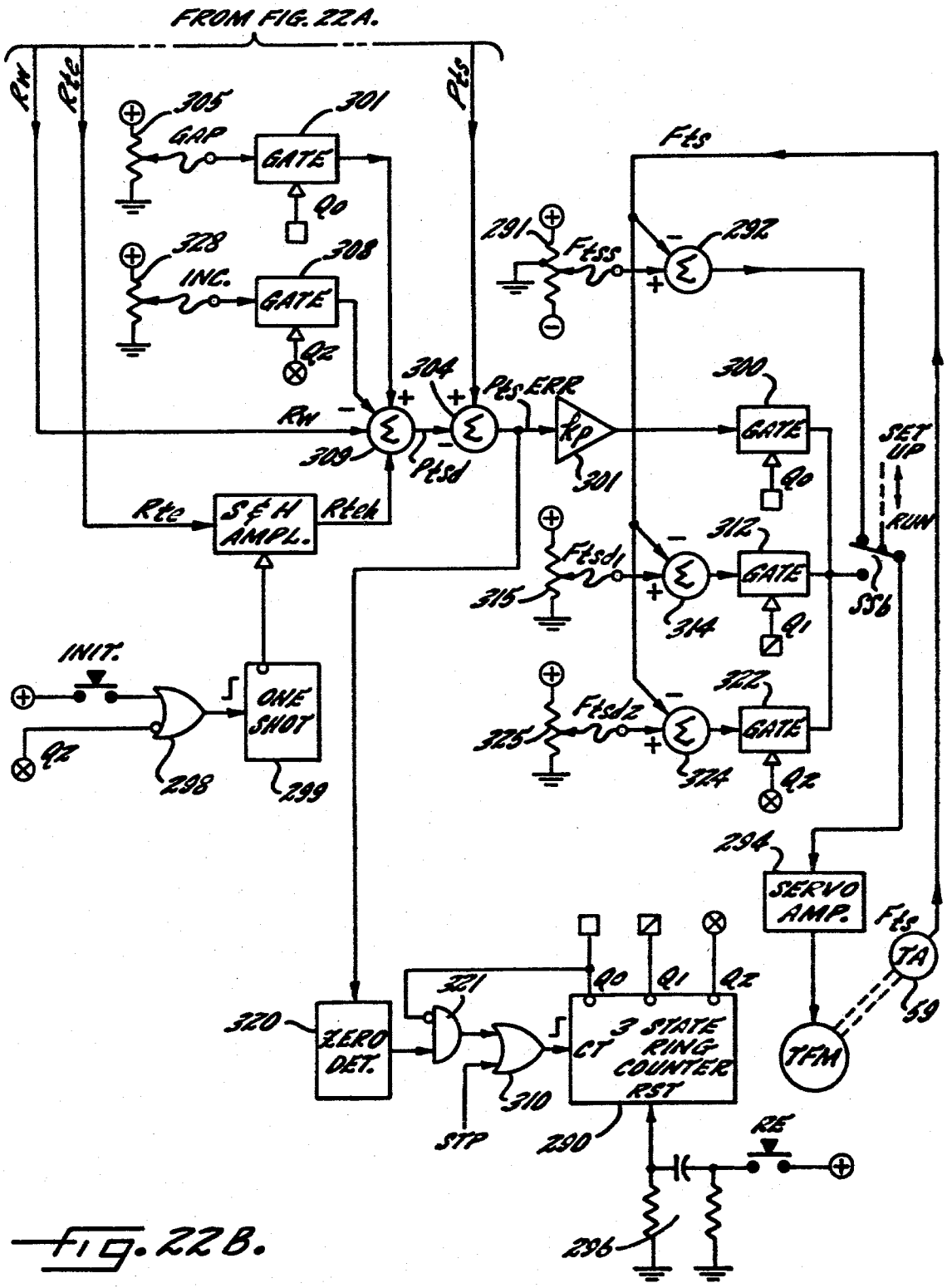

FIGS. 22A and 22B, when joined, constitute an electrical block diagram to be taken with FIGS. 17 and 19–21 for illustrating the manner in which periodic truing may be effected and with the truing element "following with the gap".

Figure 23:
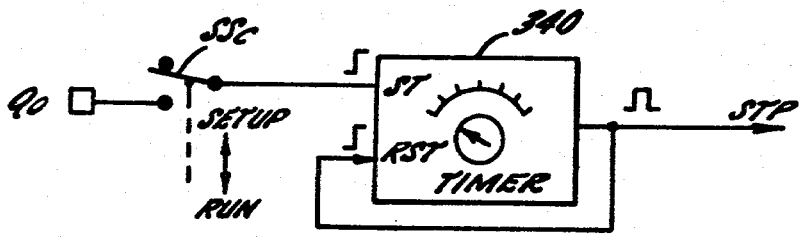

FIG. 23 illustrates diagrammatically one arrangement for periodically initiating the truing operations in the apparatus of FIGS. 22A, B.

Figure 24:
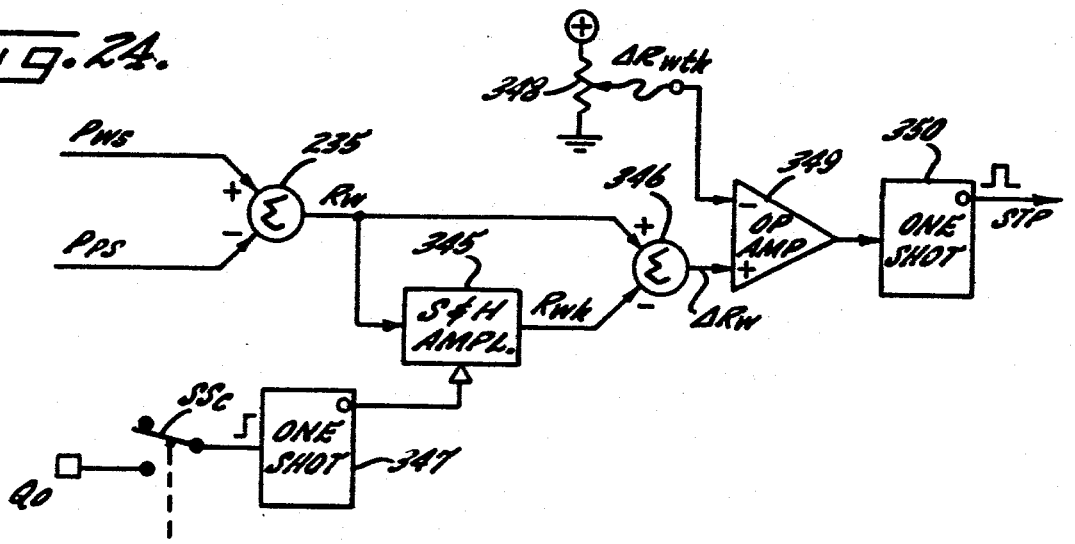

FIG. 24 illustrates an alternative embodiment of apparatus for initiating the intermittent truing procedures carried out by the system of FIGS. 22A, 22B at spaced instants which are determined by the radius reduction or wear of the grinding wheel.

Figure 25:
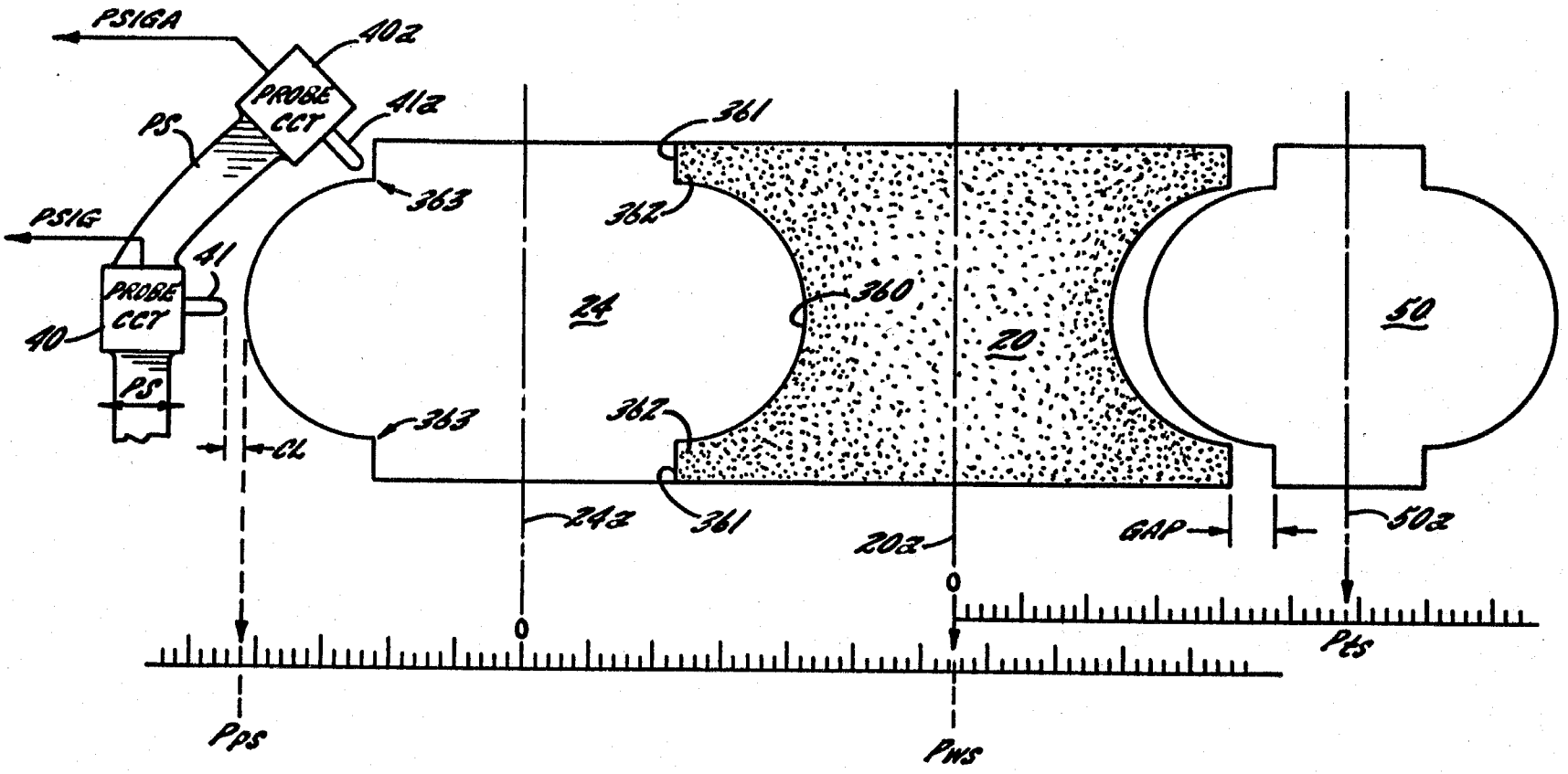

FIG. 25 is a diagrammatic plan view of a grinding wheel, workpiece and truing element for form grinding, and indicates one manner of sensing that the wheel face has deteriorated or lost its desired shape.

Figure 26:
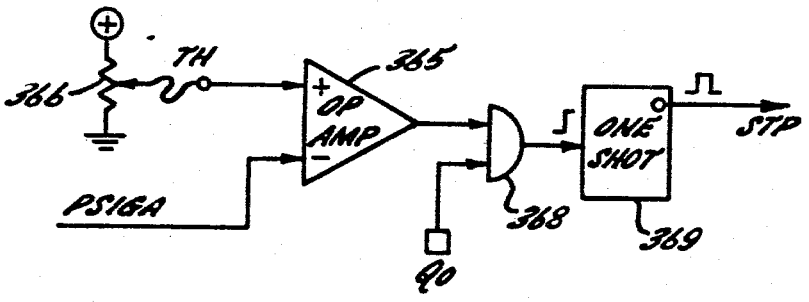

FIG. 26, taken with FIG. 25, illustrates still another arrangement for initiating periodic truing procedures carried out by the apparatus of FIGS. 22A, B at those successive instants in time when loss of shape by the wheel face is detected.

Figure 27:
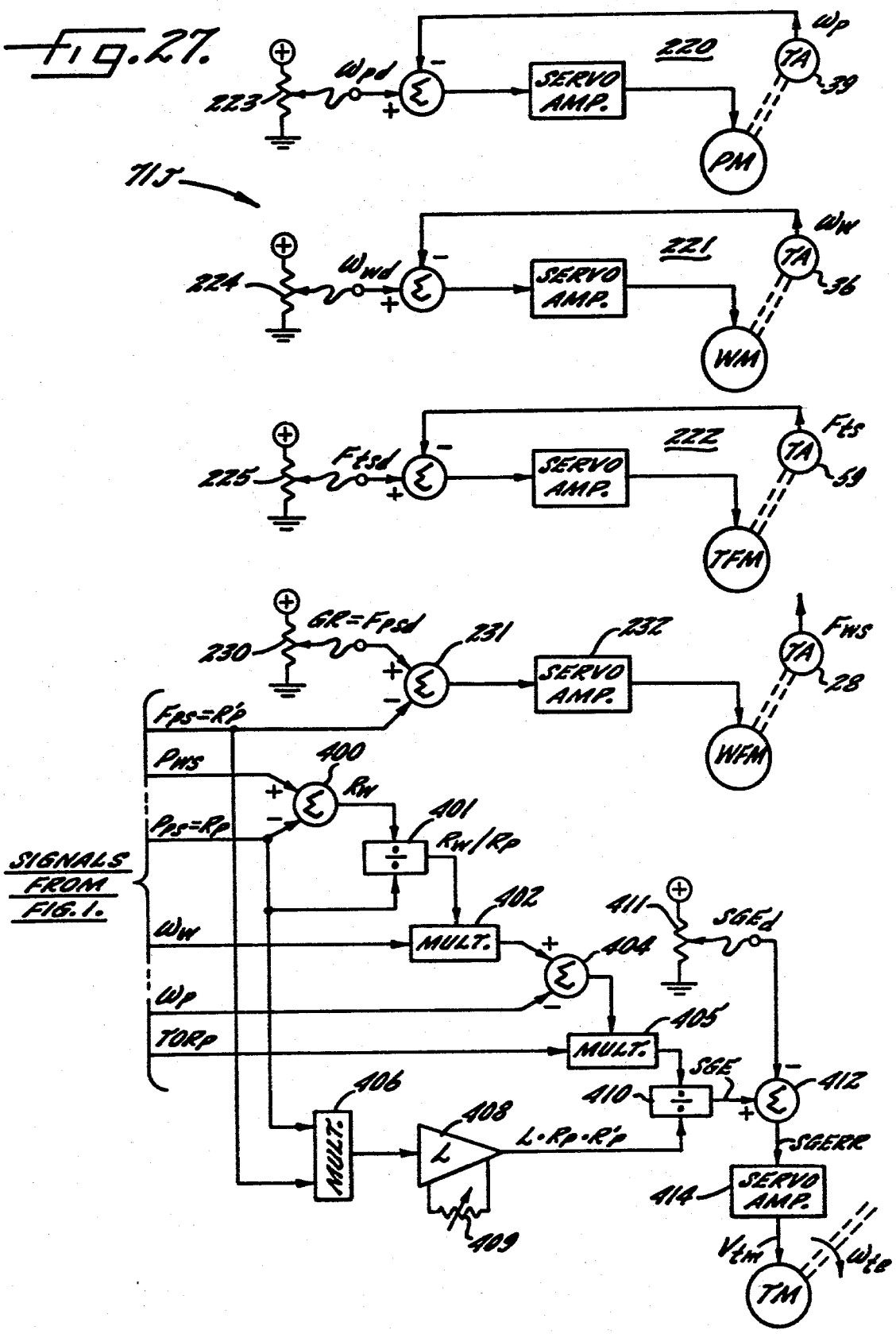

FIG. 27, taken with FIG. 17, illustrates still another embodiment of control methods and apparatus, and in this case for controlling the SGE of grinding action by automatic adjustment of the parameters with which truing or conditioning action is simultaneously created.

Figure 28:
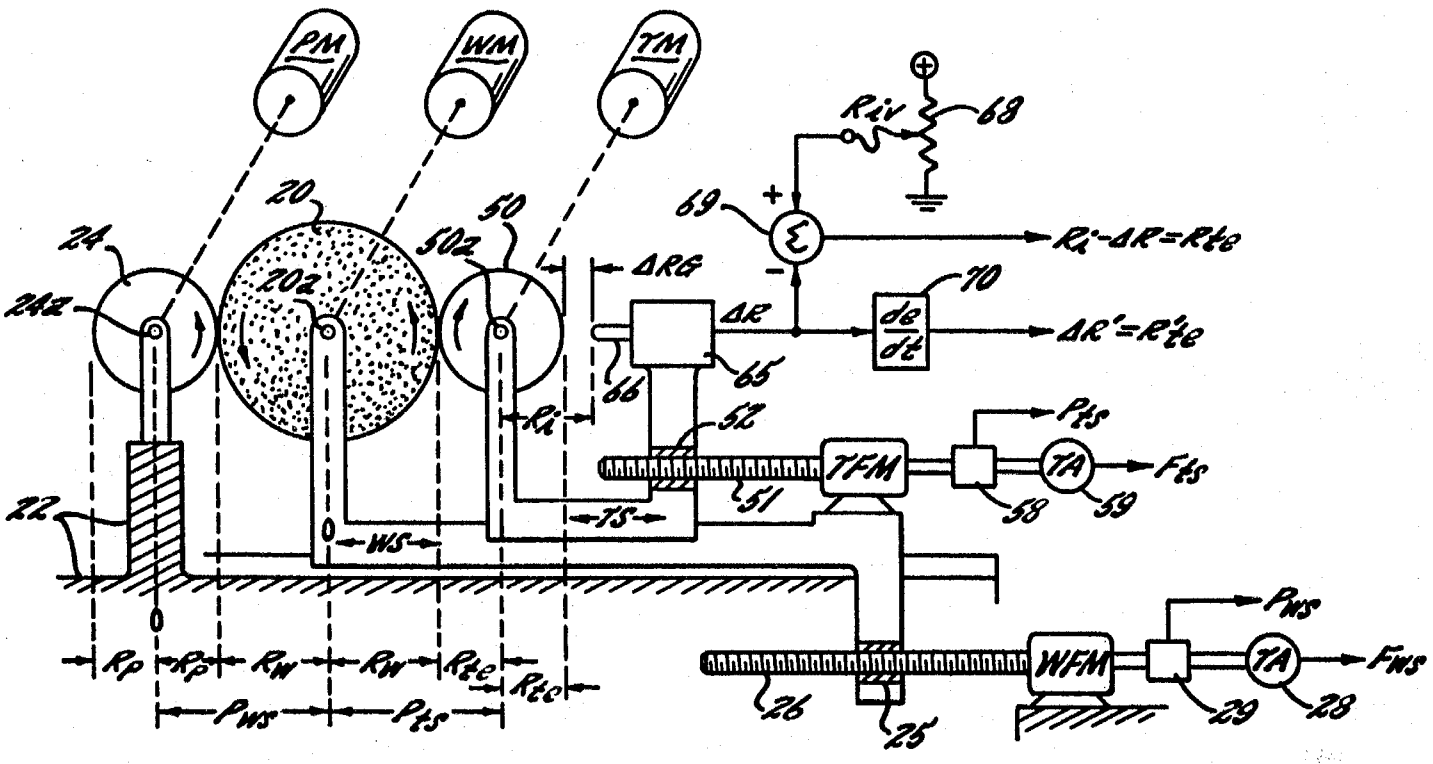

FIG. 28 is a simplified counterpart of FIG. 1 and shows the relative positions of grinding machine components while grinding and truing are occurring simultaneously with controls effected simply from a probe or gage sensing the truing element.

Figure 29:
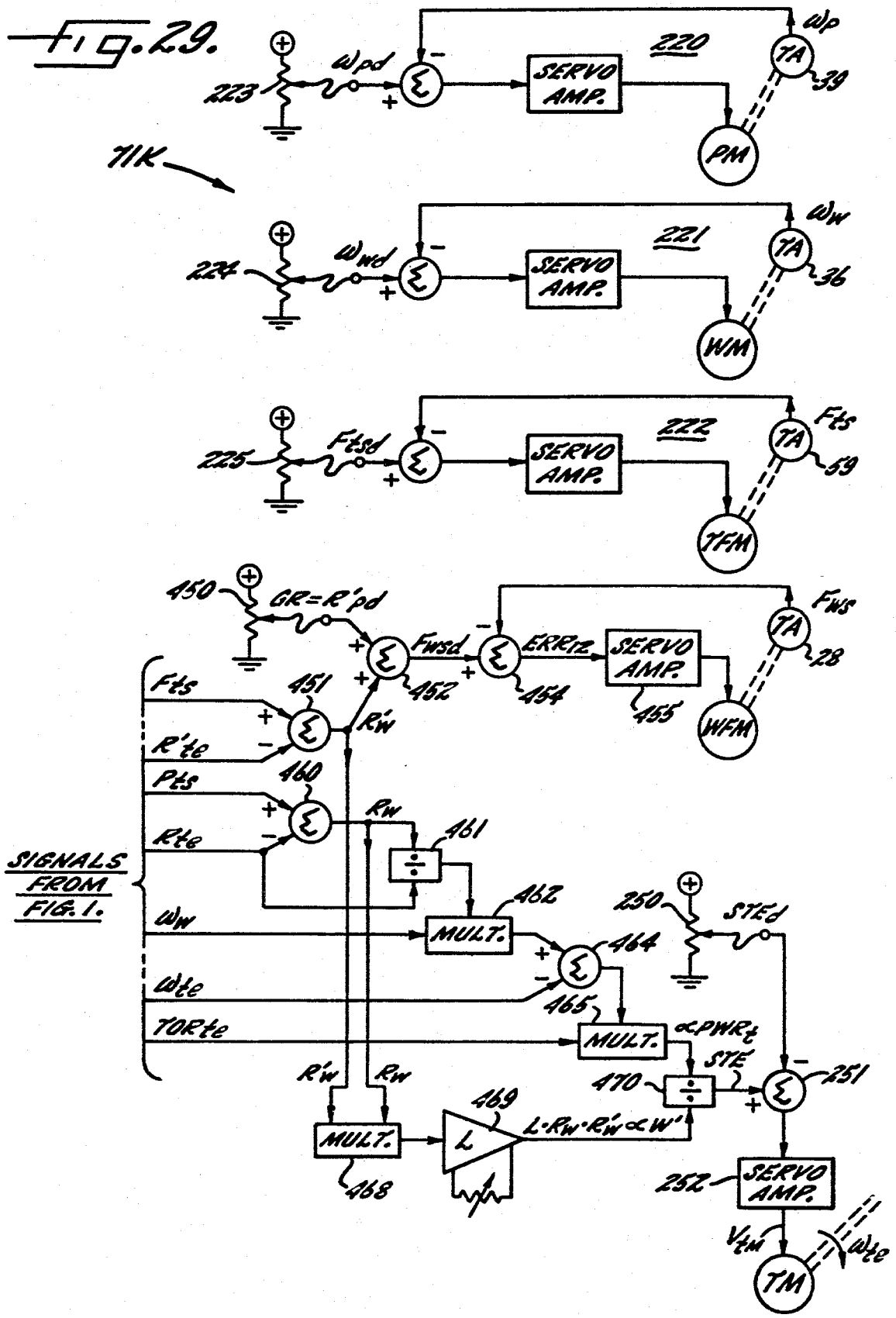

FIG. 29, taken with FIG. 28, illustrates another embodiment of control methods and apparatus for effecting truing or wheel conditioning operations while grinding is occurring and with the STE ratio maintained at a desired value.

Figure 30:
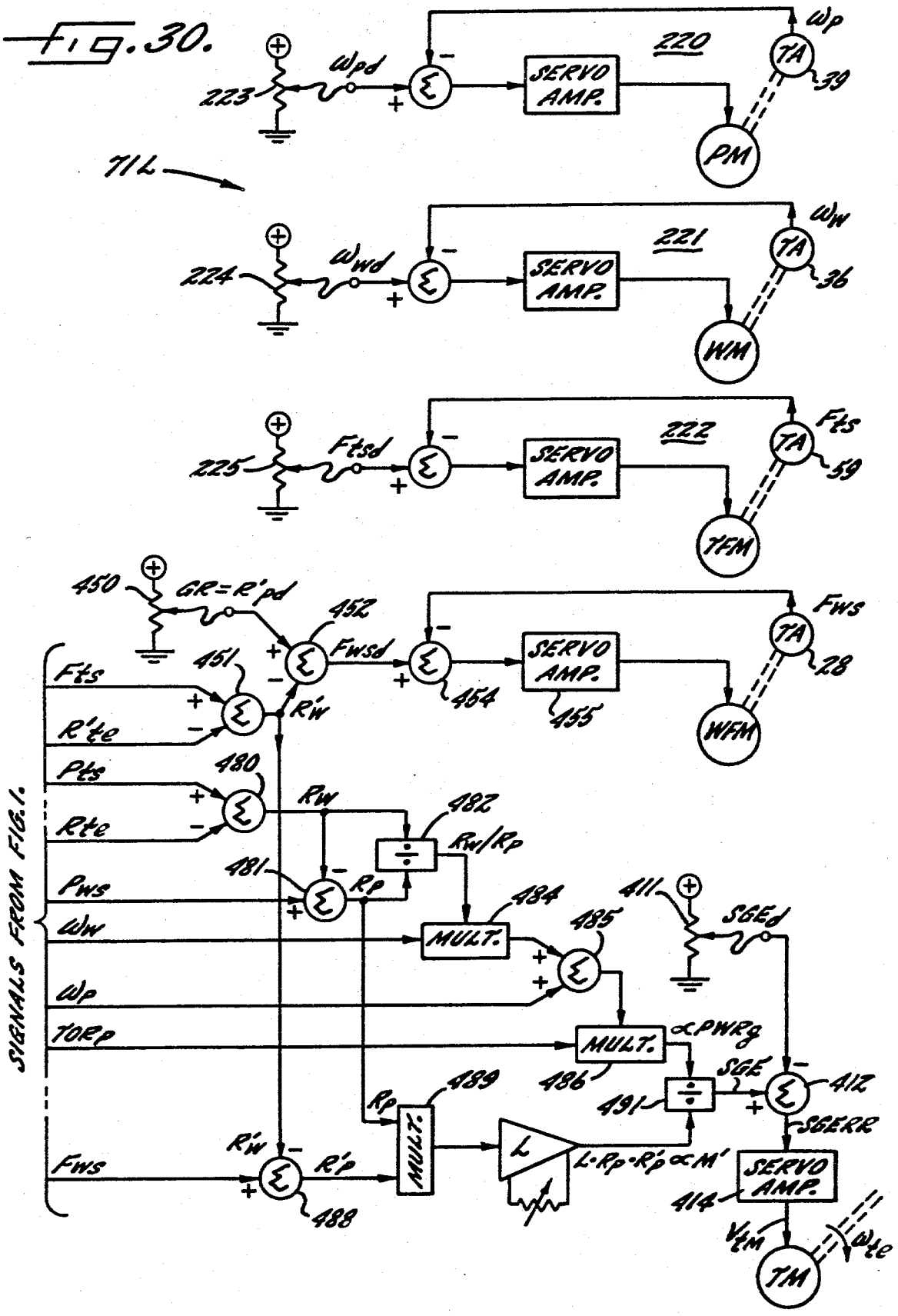

FIG. 30, taken with FIG. 28, is a block diagram of electrical apparatus for controlling the STE ratio at the grinding interface while grinding action and truing action are occurring simultaneously.

Figure 31:
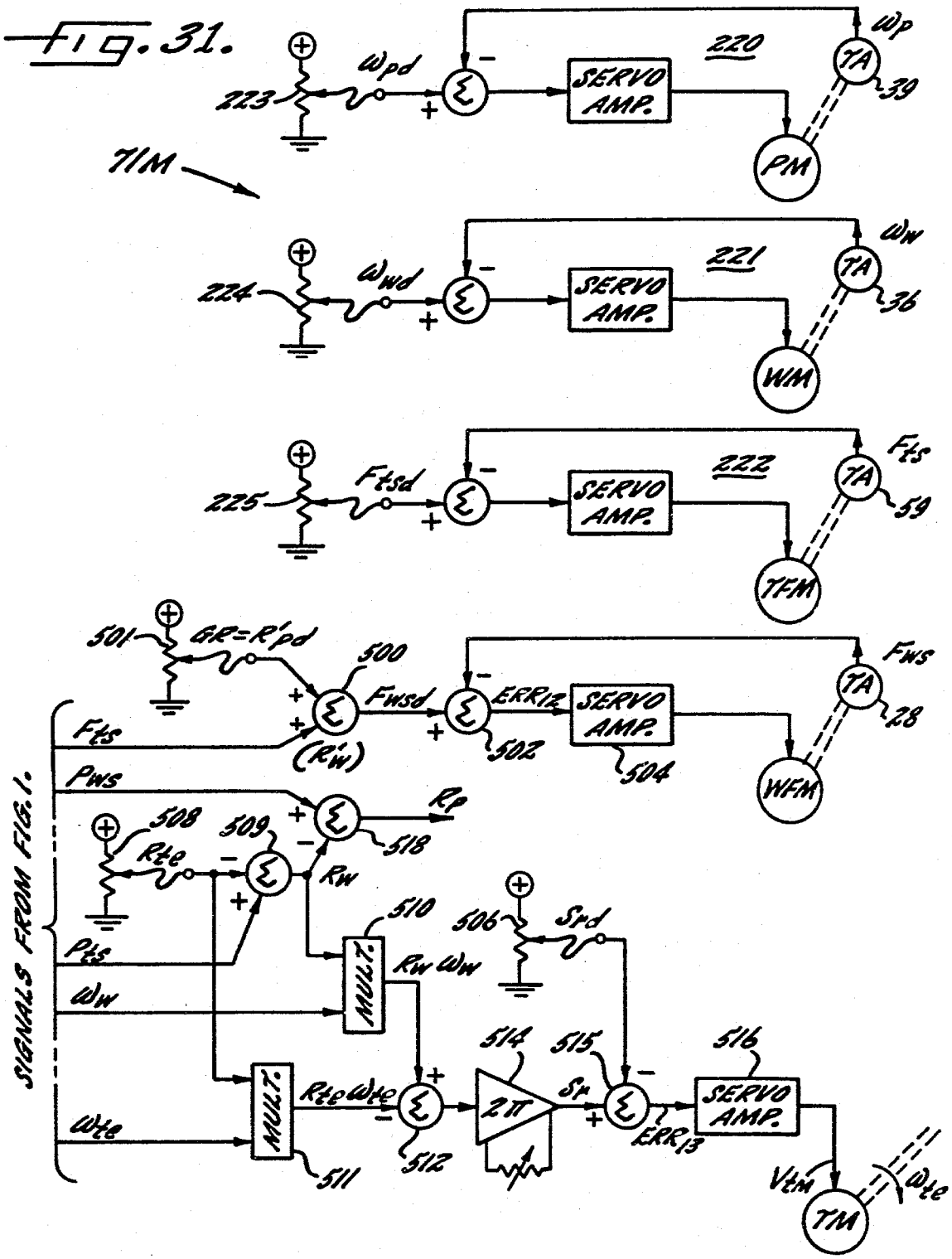

FIG. 31, taken with FIG. 28, is a block diagram of electrical apparatus for controlling grinding of a part at a desired rate and to a desired size with continued conditioning of the wheel face while grinding and truing are occuring simultaneously, and without the need for any in-process sizing gage.

TYPICAL GRINDING MACHINE CONFIGURATION AND COMPONENTS

FIG. 1 diagrammatically shows a typical grinding machine with its various relatively movable components, together with various sensors and driving motors or actuators. Not all of the sensors and actuators are required in certain ones of the method and apparatus embodiments to be described, but FIG. 1 may be taken as an "overall" figure illustrating all of the various machine-mounted components which are employed in one embodiment or another, so long as it is understood that certain ones of such components are to be omitted in some cases.

The grinding machine is here illustrated by way of example as a cylindrical grinder but the invention to be disclosed below is equally applicable to all other types of grinding machines such as surface grinders, roll grinders, etc. The machine includes a grinding wheel 20 journaled for rotation about an axis 20*a* and rotationally driven (here, counterclockwise) by a wheel motor WM. The wheel 20 and its spindle or axis 20*a* are bodily carried on a wheel slide WS slidable along ways of the machine bed 22. As shown, the face 20*b* of the wheel is brought into relative rubbing contact with the work surface 24*b* of a part or workpiece 24, and the wheel face is fed relatively into the workpiece by movement of the carriage WS toward the left, to create abrasive grinding action at the work/wheel interface.

In the exemplary arrangement shown, the workpiece 24 is generally cylindrical in shape (or its outer surface is a surface of revolution) and supported on fixed portions of the machine bed 22 but journaled for rotation about an axis 24*a*. The workpiece is rotationally driven (here, counterclockwise) by a part motor PM mounted on the bed 22. Since the workpiece and wheel surfaces move in opposite directions at their interface, the relative surface speed of their rubbing contact is equal to the sum of the peripheral surface speeds of the two cylindrical elements.

Any appropriate controllable means may be employed to move the slide WS left or right along the bed 22, including hydraulic cylinders or hydraulic rotary motors. As here shown, however, the slide WS mounts a nut 25 engaged with a lead screw 26 connected to be reversibly driven at controllable speeds by a wheel feed motor WFM fixed on the bed. It may be assumed for purposes of discussion that the motor WFM moves the slide WS, and thus the wheel 20, to the left or the right, according to the polarity of an energizing voltage $V_{wfm}$ applied to the motor, and at a rate proportional to the magnitude of such voltage.

To sense and signal the actual rate at which the wheel 20 is being fed, a dc. tachometer 28 is mechanically coupled to the lead screw 26 or the shaft of the motor WFM, the tachometer producing a signal in the form of a dc. voltage $F_{ws}$ which is proportional to the bodily feed rate of the slide WS and the wheel 20. Of course, any of a variety of alternative feed rate sensors or signaling means may be employed.

Also, any suitable means are employed as a position sensor 29 coupled to the slide WS or the lead screw 26 to produce a signal $P_{ws}$ which varies to represent the position of the wheel as it moves back or forth. In the present instance, the position of the wheel is measured along a scale 30 (fixed to the bed) as the distance between a zero reference point 31 and an index point 32 on the slide. The reference and index points 31 and 32 are for convenience of discussion here shown as vertically alined with the axes 24*a* and 20*a* and the signal $P_{ws}$ represents the position or horizontal distance of the wheel axis 20*a* relative to the workpiece axis 24*a*. One suitable position sensor 29 may comprise a bi-directional pulse generator feeding pulses into a reversible counter whose digital count contents are applied to a digital-to-analog converter which produces the signal $P_{ws}$ as a variable dc. voltage. Many other known forms of position signaling devices familiar to those skilled in the art may be used as a matter of choice.

In the practice of the invention in certain of its embodiments, it is desirable (for a purpose to be explained) to sense and signal the power which is being applied for rotational drive of the grinding wheel 20, and also to sense and signal the rotational speed of the wheel. While power may be sensed and signaled in a variety of ways, FIG. 1 illustrates for purposes of power computation a torque transducer 35 associated with the shaft which couples the wheel motor WM to the wheel 20. The torque sensor 35 produces a dc. voltage $TOR_w$ which is proportional to the torque exerted in driving the wheel to produce the rubbing contact described above at the interface of the wheel 20 and the workpiece 24. The wheel motor WM is one which is controllable in speed, and while that motor may take a variety of forms such as an hydraulic motor, it is here assumed to be a dc. motor which operates at a rotational speed $\omega_w$ which is proportional to an applied energizing voltage $V_{wm}$. As a convenient but exemplary device for sensing and signaling the actual rotational speed of the wheel 20, a tachometer 36 is here shown as coupled to the shaft of the motor WM and producing a dc. voltage $\omega_w$ proportional to the rotational speed (e.g., in units of r.p.m.) of the wheel 20.

In similar fashion, it is desirable in the practice of the invention according to certain ones of the embodiments to be described that the power and rotational speed of the workpiece or part 24 be signaled directly or indirectly. For this purpose, and as explained further below, a torque transducer 38 is associated with the shaft which drivingly couples the pat motor PM to drive the workpiece 24. The latter torque transducer may take any suitable known form and it will here be assumed that it produces, as an output signal, a dc. voltage $TOR_p$ proportional to the torque which is exerted by the motor PM in rotationally driving the part 24 counterclockwise during grinding action. The rotational speed of the part 24 is controllable, and in the present instance it is assumed that the motor PM drives the part 24 at an angular velocity $\omega_p$ proportional to the magnitude of a dc. energizing voltage $V_{pm}$ applied to that motor. Further, to sense the actual angular velocity of the rotationally driven part 24, a tachometer 39 is coupled to the shaft of the motor 39 and produces a dc. signal $\omega_p$ proportional to the workpiece speed.

Again, although not essential to the practice of the invention in all of its embodiments, FIG. 1 illustrates a typical and suitable arrangement for continuously sensing and signaling the size (i.e., radius) of the workpiece 24 as the latter is reduced in diameter due to the effects of grinding action. Such workpiece sensing devices are often called "in-process part gages" and one known type of such gage operates on the principle of variable inductive coupling between a probe and the metallic workpiece surface as the gap between those two components changes. While the invention is not limited to the specific in-process work gaging arrangement here illustrated, FIG. 1 shows a work-sensing gage 40 carried on a probe slide PS disposed to the left of the workpiece 24 and movable horizontally along the ways of the bed 22. The gage 40 includes a probe 41 extending along a horizontal line extending through the axes 24*a* and 20*a*. It includes known circuitry by which a probe signal PSIG is produced so as always to be proportional to the gap or clearance CL between the tip of the probe 41 and the adjacent surface of the workpiece. Because the workpiece in many instances will be ground down to reduce its radius considerably during the course of a given grinding operation, the gage 40 is associated with a positioning servomechanism which acts always to keep the clearance CL substantially equal to a constant but selectable value. As here shown, the probe slide PS carries a nut 42 engaged with a lead screw 43 reversibly driven by a probe feed motor PFM having its stator rigidly fixed to the bed 22. The motor PFM is here assumed to be a dc. motor which rotates in a direction according to the polarity of, and at a speed proportional to the magnitude of, the energizing voltage $V_{pfm}$ applied thereto from a suitable driver amplifier 44 whose input signal comes from the output of an algebraic summing circuit 45. The latter circuit receives, as a positive input, the signal PSIG which is proportional to the physical clearance CL; and it receives as its negative input voltage $CL_d$ created at the wiper of a potentiometer 47 energized from a suitable constant dc. voltage source.

Whenever the actual clearance CL is larger or smaller than the desired clearance $CL_d$, the output of the summing circuit 45 is positive or negative in polarity and proportional to the error. Thus, the motor PFM is energized to turn the lead screw 43 in a direction to shift the slide PS right or left until the actual clearance CL is restored to the set point value $CL_d$. As the workpiece 24 is gradually reduced in diameter, therefore, the probe slide will follow toward the right to maintain the gap CL constant.

In order to produce a signal which always represents the radius $R_p$ of the workpiece, a position sensor and signaling device 48 is suitably coupled to the probe slide PS, or as here shown, to the lead screw 43. The position sensor 48 may take a variety of forms and may be similar to the sensor 29; it need only be understood that it produces an output signal $P_{ps}$ here assumed to be a dc. voltage which in magnitude is proportional to the radius of the workpiece 24 measured from the reference point 31 on the scale 30. That is, the position sensor 48 is initially adjusted such that when the probe 41 is spaced from the workpiece 24 by a distance $CL_d$ then the signal $P_{ps}$ in its magnitude corresponds to the abscissa $P_{ps}$ labeled on the scale 30 in FIG. 1. As the workpiece 24 reduces in diameter, the probe slide PS will move to the right to keep the clearance CL constant, and the signal $P_{ps}$ will fall in value so that its magnitude is continuously proportional to the radius $R_p$ of the workpiece or part 24.

It may also be desirable in carrying out certain aspects of the present invention to create a signal which represents the rate at which the probe slide PS is being moved and which thus represents the rate $R'_p$ at which the radius of the workpiece 24 is being reduced. For this purpose, a tachometer 49 is coupled to the lead screw 43 and produces a signal $F_{ps}$ in the form of a dc. voltage proportional to the linear velocity at which the slide PS is moving.

As will be treated more fully below, as grinding of the part 24 by the wheel 20 proceeds, the wheel may not only become dull but is face may deteriorate from the desired shape. Accordingly, it has been the practice in the prior art to periodically "dress" the grinding wheel to restore sharpness and/or periodically "true" the grinding wheel face in order to restore its shape or geometric form to the desired shape. These related procedures of dressing and truing will here be generically called "conditioning" the wheel face, and the invention to be described in some detail below deals primarily with procedures for conditioning a grinding wheel face in novel and advantageous fashions.

For future reference, it may be noted here that the grinding machine of FIG. 1 includes a conditioning element or truing roll 50 having an operative surface **50*b* which conforms to the desired wheel face shape. Whenever truing or dressing is required or desired, the operative surface of the truing roll 50 may be relatively fed into relative rubbing contact with the wheel face 20*b* in order to either wear away that wheel face so it is restored to the desired shape, or to affect the sharpness of the abrasive grits carried at the wheel face. Thus, FIG. 1 shows the truing roll 50 as being mounted for rotation about its axis 50*a* on a spindle supported by a truing slide TS movable to the left or right relative to the wheel slide WS. That is, the truing slide TS is slidable along the ways formed on the wheel slide WS and it may be shifted or fed to the left or the right relative to the index mark 32 by a truing feed motor TFM mechanically coupled to a lead screw 51 engaged with a nut 52 in the slide TS. The motor TFM has its stator rigidly mounted on the wheel slide WS so that as the lead screw 51** turns in one direction or the other, the slide TS is fed to the left or right relative to the wheel slide WS. The motor TFM is here assumed, for simplicity, to be a dc. motor which drives the lead screw in a direction which corresponds to, and at a speed which is proportional to, the polarity and magnitude of an energizing voltage $V_{tfm}$.

The position of the truing roll 50 and the truing slide TS is measured, for convenience, relative to the index mark 32 on the wheel slide WS. As here shown, an index mark 54 vertically alined with the axis **50*a* indicates the position $P_{ts}$ of the wheel 50 along a scale 55 on the wheel slide, such scale having its zero reference location alined vertically with the axis 20*a* and the index mark 32. In order that the position of the truing roll 50 may at all times be known, a suitable position signaling device 58 is coupled to the lead screw 51. The device 58 may take any one of a variety of known forms and may be similar to the position sensor 29 previously described; in any event, it produces a signal $P_{ts}$ which in magnitude is proportional to the physical position $P_{ts}$ along the scale 55, i.e., proportional to the distance between the axes 20*a* and 50*a*** as the slide TS moves to the left or to the right.

For reasons to be explained below, it is desirable that the rate of feed or translation of the slide TS be signaled and known. For this purpose a tachometer 59 is coupled to the lead screw 51 and produces a dc. voltage $F_{ts}$ which in magnitude and polarity corresponds to the velocity and direction with which the truing slide is at any instant being moved.

When the conditioning element 50 is employed in a cylindrical grinding machine, it will usually take the form of a cylindrical roll having an operative surface which conforms to the desired shape of the wheel face. In order to produce the relative rubbing of the wheel and truing roll 50, the latter is rotationally driven or braked at controllable speeds by a truing motor TM which is mounted upon, and moves with, the truing slide TS. Merely for simplicity in the description which ensues, it is assumed that the motor TM is a dc. motor which may act bi-directionally, i.e., either as a source which drives the roll 50 in a clockwise direction or which affirmatively brakes the roll 50 (when the latter is driven c.w. by the wheel 20 in contact therewith) by torque acting in a c.c.w. direction. It is known in the motor art that a dc. motor may be controlled to act as a variable brake by regenerative action. Assuming that the grinding wheel 20 has been brought into peripheral contact with the roll 50, the motor TM may thus serve as a controllable brake producing a retarding effect proportional to an energizing voltage $V_{tm}$ applied thereto. If desired, one may view the motor as an electromagnetic brake creating a variable torque by which the rotational speed $\omega_{te}$ of the truing roll 50 is controlled by variation of the applied voltage $V_{tm}$. In this fashion, the relative rubbing surface speed between the wheel face and the truing roll 50 may be controlled by controlling the braking effort exerted by the motor TM through a shaft coupled to the roll 50.

Also for a purpose which will become clear, it is desired to sense or control the power expended in either driving or braking the truing roll 50 by the action of the motor TM during the relative rubbing contact. While a variety of known power sensing devices may be utilized, the arrangement illustrated by way of example in FIG. 1 includes a torque transducer 60 associated with the shaft which couples the motor TM to the truing roll 50. That transducer produces a signal in the form of a dc. voltage $TOR_{te}$ which is proportional to the torque transmitted (either by motoring or braking action, but usually the latter). Also, the rotational velocity of the truing roll 50 is desirably sensed and signaled for reasons to be made clear. For this purpose, a tachometer 61 is coupled to the roll 50 or to the shaft of the motor/-brake TM and it produces a dc. voltage $\omega_{te}$ which is proportional to the speed (expressible in r.p.m.) with which the roll 50 is turning at any instant.

During the course of rubbing contact between the conditioning element 50 and the grinding wheel 20, the former may wear down somewhat and thus be reduced in radius. It is desirable to sense and signal the radius of the truing roll 50 in order to practice the present invention in certain ones of its embodiments. While a variety of dimension-sensing gages may be used for this purpose, FIG. 1 shows an inductively-coupled gage 65 which is generally similar to the gage 40 previously described but acting to sense the surface of the roll 50. As here shown, the gage 65 is rigidly mounted on the slide TS so that its probe 66 is spaced by a gap $\Delta RG$ from the operative surface 50*b* of the roll 50. The initial distance from the axis 50*a* to the tip of the probe 66 is measured and known; it is here labeled $R_i$. This distance will remain constant even though the radius of the truing roll 50 is reduced. The gage 65 includes known circuits for producing an output signal $\Delta R$ proportional to the physical gap $\Delta RG$. As the radius of the roll 50 reduces so that the gap $\Delta RG$ increases, the signal $\Delta R$ will correspondingly increase. The initial distance $R_i$ is represented by a voltage $R_{iv}$ obtained from the adjustable wiper of a potentiometer 68 and fed to the positive input of an algebraic summing circuit 69. The latter receives the signal $\Delta R$ as its negative input. The output of the summing circuit 69 is equal to the difference $R_i - \Delta R$ and thus at all times represents the radius $R_{te}$ of the truing roll 50. In other words, the signal $R_{te}$ produced by the summing circuit 69 in FIG. 1 is proportional to and represents the physical distance labeled $R_{te}$ immediately above the scale 55. Still further, it may be desirable to sense and signal the rate at which the radius of the truing roll 50 is being reduced while truing or dressing action is taking place. For this purpose, the signal $\Delta R$ is fed through a known electronic differentiating circuit 70 which is shown as producing an output signal $\Delta R'$. Thus, when the radius $R_{te}$ of the roll 50 is being reduced at a rate $R'_{te}$ (expressible in inches per minute, for example) and the signal $\Delta R$ is increasing as the radius $R_{te}$ decreases, the signal $\Delta R'$ is proportional to the rate of change of $\Delta R$ and therefore represents the radius reduction rate $R'_{te}$.

FIG. 1A is a generic block representation of a control system 71 employed in the various embodiments of the invention to be described and which operates to carry out the inventive methods. In its most detailed form, the control system receives as inputs the signals $P_{ps}$, $F_{ps}$ $P_{ws}$, $F_{ws}$, $P_{ts}$, $F_{ts}$, $R_{te}$, $R'_{te}$, $TOR_p$, $W_p$, $TOR_w$, $W_w$, $TOR_{te}$, and $W_{te}$ produced as shown in FIG. 1; and it provides as output signals the motor energizing signals $V_{pm}$, $V_{wm}$, $V_{tm}$ which determine the rotational speeds of the workpiece 24, wheel 50 and truing roll 50—as well as the signals $V_{wfm}$ and $V_{tfm}$ which determine the feed rates of the slide WS and the slide TS. Yet, it will become apparent that not all of the sensors, and signals representing sensed physical variables, need be used in the practice of all embodiments of the invention. Several typical but different embodiments will be described in some detail, both as to apparatus and method, in the following portions of the present specification.

Prior Art Practices In Truing and Dressing

When a grinding wheel is actively grinding a workpiece, two things usually occur. At the commonly accepted ranges of feed rates and speeds used with a given wheel acting on a given workpiece material, the wheel becomes progressively duller; the torque required to drive the wheel increases; and if the speed of the wheel rotation is maintained, the wheel driving power increases until it reaches or exceeds the maximum, safe power at which the wheel-driving motor is rated. More heat is generated at the workpiece surface and the possibility of "burn" or metallurgical damage at the work surface increases as the wheel becomes duller and duller.

As a second effect, however, the wheel face may wear down (reduce in radius) unevenly so that its original, desired shape will deteriorate. This is especially troublesome when "formed" wheels (having wheel faces which are not purely cylindrical in their desired shape) are being used. To grind the desired shape on a work surface rubbed by the wheel, the wheel face must conform rigorously to that desired shape.

It has been the prior practice in the industry, therefore, to periodically "dress" a wheel face, i.e., to "sharpen" its grits, as it becomes dull. In simple systems the wheel is "dressed" after each of successive predetermined time periods of grinding have elapsed or a certain number of workpieces have been ground. In these situations, the grinding is carried out with a fixed feed rate and the operating wheel speed is made high in the hope that wheel wear rate will be low—in order to get longer life out of a given wheel. The "dressing" is commonly accomplished by causing a single point diamond tool to trace along the wheel face so it in effect cuts away a small layer and exposes fresh grits whose edges and corners are sharp.

When loss of form or shape occurs, the wheel must be "trued" to restore its shape. Again, the single point diamond tool may be used to trace along the face and cut away the high spots until the whole face takes on the desired shape. Truing has also been accomplished through the use of "truing rolls" which are almost universally manufactured to consist of small diamond (sythetic or natural) chips bonded in a matrix of hard material. The operative surface of the truing roll is shaped to conform to the desired shape for the wheel face (cylindrical or otherwise) and it is fed into relative rubbing engagement with the wheel face to purposely wear off the high spots.

All other conditions remaining constant, a dull wheel requires more energy to remove a given volume of metal from a workpiece, than does a sharp wheel. If one defines "Specific Grinding Energy" (SGE) as the ratio of (i) the power applied to effect grinding to (ii) the volumetric rate of removal of material from the workpiece, then a wheel when dull will operate with a higher SGE than the same wheel when sharp.

Applicant's earlier U.S. Pat. Nos. 3,653,855 and 3,798,846 teach that a wheel may be kept at and returned to a desired degree of sharpness or dullness by maintaining the SGE with which it operates at a predetermined set point value. If the actual SGE (i) increases above or (ii) falls below the set point, then (i) relative rubbing surface speed is decreased or feed rate is increased, or (ii) relative rubbing surface speed is increased or feed rate is decreased. Such corrective actions either change the "velocity impact strength" of the wheel grits or the feeding forces on the grits so that fracturing of the grits (which sharpens them) is changed, and the operation of the wheel thus restores automatically to the set point value of SGE. To a major extent, the need for wheel "dressing" is eliminated if the methods and apparatus of applicant's earlier patents are employed.

Those methods and apparatus, when used to their best, do result in the grinding wheel wearing away faster than experienced in conventional industry practice under which wheel speed is maintained high to lessen wheel wear rate and reduce the expense of shortened wheel life. Yet, the SGE method and apparatus provide an overall benefit in cost and efficacy of grinding parts since any increased expense of buying more grinding wheels is more than offset by the saving in time and labor which flows from (i) eliminating "dressing" tools and "dressing" time and (ii) grinding of required amounts of metal from workpieces at higher rates in a machine of a given wheel motor power rating.

Nevertheless, with either conventional grinding procedures or the SGE method, the grinding wheel will lose shape or form. It must be trued. Indeed, since wheel wear rate will be greater with the preferred practice of the SGE method, loss of wheel face shape may be accelerated. Thus, there is a need to see that the wheel face is "trued" and restored to its desired shape; and this need is especially critical when "formed" wheels are used under conditions which aim to increase the grinding rate by accepting increased wheel wear rates.

"Truing" as carried out in prior art, industry practice with diamond chip truing rolls has been, to the extent of applicant's knowledge, conducted at relative surface speeds and infeed rates which are not chosen on a basis which has any relation to the abrading action which the truing roll creates on the grinding wheel. In a conventional cylindrical grinding machine, for example, the truing roll is often rotationally driven at about 1725 r.p.m., regardless of its diameter, simply because that rotational speed is the one produced by a standard, low cost, four pole induction motor directly coupled to the truing roll. The grinding wheel is rotationally driven at its normal grinding speed (typically in the range of about 4000 to 12,000 peripheral surface feet per minute), and infeeding of the wheel relative to the diamond truing roll is arbitrarily conducted in steps of 0.001" followed by pauses of 3 or 4 seconds. Such infeeding is that recommended by the manufacturers of diamond truing rolls based upon experience as to how fast a diamond roll can be "pushed" into a grinding wheel without causing chatter or undue wear and damage to the diamond roll. Generally, a grinding wheel which has been trued with a diamond truing roll is "dull" because the diamond chips (the hardest material known) smooth off the sharp corners and edges of the grits exposed at the wheel face.

The grinding industry has also used what is known as "crush truing". In crush truing, there is no relative rubbing contact between the wheel face and the operative surface of a very hard (e.g., tungsten carbide) truing roll. Rather, that truing roll is simply journaled with freedom to rotate about its axis and brought with very high pressures into contact with the rotationally driven grinding wheel. The wheel face thus rotationally drives the truing roll to make their surface speeds equal and without rubbing or abrading action, and the truing roll "crushes" off high spots on the wheel face until the latter reasonably conforms to the shape of the operative surface of the crush truing roll. Crush truing requires a machine of unusual strength and stiffness to create the high forces required; it often does not precisely shape the wheel face because chunks of the wheel material may "crush" out unevenly and in a fashion which cannot be known in advance. The very high forces involved result in a relatively short useful life of a "crush truing roll" even though the latter is made of a very hard steel or metal alloy. It has been observed, however, that a grinding wheel, immediately after a crush truing operation, is very sharp. This comes about, it is believed, because crushing produces fracturing of the bonds between the wheel grits and their supporting matrix so that "fresh" grits are exposed which, due to the lack of previous rubbing, are not worn or flattened off.

So far as applicant is aware, those skilled in the art have not suggested systematic, varied control of, or actually systematically controlled, relative surface speed of rubbing contact and relative infeed at the interface between a grinding wheel and a conditioning element (e.g., truing roll) during the truing procedure. Nor has the art recognized that conditioning elements may advantageously be made of various available hard metal alloys (including the same material as that of the workpieces being ground), as contrasted with expensive diamond rolls, while still obtaining the desired truing and/or wheel sharpening action.

Definitions and Symbols

As noted above, during the use of a grinding wheel, it needs to be "dressed" to increase or decrease the sharpness of grits which are exposed at the wheel face, and it needs to be "trued" to restore the wheel face shape. As generic to dressing and/or truing, I have chosen the term "conditioning". Thus I define:

Wheel Conditioning: The modification of the face of a grinding wheel (i) to affect its sharpness (making it either duller or sharper); or (ii) to affect its shape, essentially to restore it to the desired shape; or (iii) to carry out both functions (i) and (ii).

Wheel Conditioning Element: Any member having an operative surface conforming to the desired shape of a grinding wheel to be conditioned, and which can be brought into contact with the face of the wheel to create both relative rubbing and feeding which causes material to be removed from the wheel (and in some cases undesirably causes material to be removed from the conditioning element). Throughout this specification the term "truing element" will be used as synonymous with "conditioning element" merely for convenience.

Relative Surface Speed: The relative surface velocity with which rubbing contact occurs at the wheel face/operative surface interface. If the wheel surface is moving in one direction at 3000 feet per minute and the operative surface is moving at 1000 feet per minute in the opposite direction, the relative surface speed is 4000 feet per minute. If the operative surface is not moving, then the relative speed of rubbing is equal to the surface speed of the wheel face due to wheel rotation. If the operative surface is moving in the same direction as the wheel face, the relative surface speed is the difference between the surface velocity of the wheel face and the surface velocity of the operative surface. If those two individual surface velocities are equal, the relative surface speed is zero, there is no relative rubbing of the wheel face and operative surface, even though they are in contact. This latter situation exists during crush truing.

Relative Feed: The relative bodily movement of a grinding wheel and conditioning element which causes progressive interference as the relative rubbing contact continues and by which the material of the wheel is progressively removed. It is of no consequence whether the wheel is moved bodily with the conditioning element stationary (although perhaps rotating about an axis) or vice versa, or if both the wheel and element are moved bodily. Feeding is expressible in units of velocity, e.g., inches per minute.

Rate of Material Removal: This refers to the volume of material removed from a grinding wheel (or some other component) per unit time. It has dimensional units such as cubic centimeters per second or cubic inches per minute. In the present application alphabetical symbols with a prime symbol added designate first derivatives with respect to time, and thus the symbol W′ represents volumetric rate of removal of material from a grinding wheel. In similar fashions, the symbols P′ and TE′ respectively represent volumetric rates of removal of material from a part (workpiece) and a truing element.

From the introductory treatment of FIG. 1, it will also be apparent that the following symbols designate different physical variables as summarized below:

PWR=power, i.e., energy expended per unit time $PWR_w$=power devoted by the wheel motor to rotationally drive a grinding wheel $PWR_p$=power devoted by the part motor to drive or brake the part (workpiece) to create, in part, the rubbing contact with the wheel $PWR_{te}$=power devoted by the truing element motor to drive or brake a truing element to create, in part, rubbing contact with wheel $PWR_{wt}$=that portion of $PWR_w$ devoted to truing action $PWR_{wg}$=that portion of $PWR_w$ devoted to grinding action $PWR_t$=total power devoted to truing action $PWR_g$=total power devoted to grinding action $TOR_w$=torque exerted to drive the wheel $TOR_p$=torque exerted to drive or brake the workpiece $TOR_t$=torque exerted to drive or brake the truing element $TOR_{wg}$=that portion of total wheel torque $TOR_w$ applied to rubbing action at the grinding interface, when truing and grinding are occurring simultaneously $TOR_{wt}$=similar to $TOR_{wg}$, but that portion of $TOR_w$ applied to rubbing action at the truing interface FOR=the force, in a direction tangential to a grinding wheel periphery, on a grinding wheel, a truing roll, or a workpiece due to rubbing action $\omega_w$=rotational speed of grinding wheel (typically in units of r.p.m.)

$\omega_p$=rotational speed of workpiece, i.e., the part to be ground $\omega_{te}$=rotational speed of the truing element $S_w$=the surface speed of the grinding wheel (typically in feet per minute)

$S_p$=the surface speed of the workpiece or part $S_{te}$=the surface speed of the truing element $S_r$=the relative surface speed of rubbing contact $R_w$=radius of grinding wheel $R_p$=radius of workpiece or part $R_{te}$=radius of truing element $P_{ws}$=position of wheel slide $P_{ps}$=position of probe slide $P_{ts}$=position of truing slide (relative to wheel axis)

$F_{ws}$=feed rate (velocity) of wheel slide $F_{ps}$=feed rate (velocity) of probe slide $F_{ts}$=feed rate (velocity) of truing slide $R'_w$=rate of radius reduction of wheel $R'_p$=rate of radius reduction of part being ground $R'_{te}$=rate of radius reduction of truing element L=axial length of wheel face or region of grinding or truing contact $R_i$=initial radial distance (as measured) from truing element axis to probe tip $\Delta R$=spacing from probe tip to truing element surface M′=the volumetric rate of removal of material (metal) from the part being ground. Exemplary units: cubic inches per min.

W′=the volumetric rate of removal of material from the wheel. Exemplary units: cubic inches per min.

TE′=the volumetric rate of removal of material from the truing element. Exemplary units: cubic inches per min.

NOTE: Any of the foregoing symbols with an added "d" subscript represents a "desired" or set point value for the corresponding variable. For example, $\omega_{wd}$ represents a commanded or set point value for the rotational speed of the wheel.

Certain ones of the foregoing symbols will be explained more fully as the description proceeds.

There has already been mentioned (as disclosed in the above-identified patents) the concept or variable called "Specific Grinding Energy" (herein designated by the symbol SGE). It is the ratio of energy used to the volume of material removed from a workpiece being ground. It might be expressed in numerical units of foot-pounds per cubic inch or watt-minutes per cubic centimeter, for example. If both the numerator and denominator are divided by the time which elapses to remove the material, then that ratio becomes energy per unit time to material volume removed per unit time. The ratio is thus expressible as the ratio of two rates, i.e., rate of energy expended and volumetric rate of material removal, and thus it can be determined at any given instant while grinding is in progress. Energy per unit time is the classical expression of power (e.g., power is expressible as foot-pounds per minute, one horsepower being 33,000 foot-pounds per minute). Volume removed per unit time is simply volumetric rate of removal, e.g., cubic inches per minute. In summary:

SGE=Specific Grinding Energy; the ratio of (i) energy consumed in removing workpiece material to (ii) the volume of material removed. The same ratio is represented by the ratio of (i) power (energy per unit time) to (ii) rate of material removal (volume of material removed per unit time)—i.e., PWR/M'. Exemplary units: Horsepower per cubic inch per minute, or gram-centimeters per second per cubic centimeter per second.

The present invention introduces a variable called "Specific Truing Energy" (herein designated STE). It will be described more fully below, but for ready reference, its definition is set out here:

STE=Specific Truing Energy; the ratio of (i) energy consumed in removing wheel material to (ii) the volume of such material removed. The same ratio is represented by the ratio of (i) power expended (energy per unit time) to (ii) rate of material removal (volume of material removed per unit time)—i.e., PWR/W'. Exemplary units: Horsepower per cubic inch per minute, or gram-centimeters per second per cubic centimeter per second.

As noted above, feeding motion requires only relative bodily movement of one component in relation to another. There are several different types of relative motions which occur in the different categories or types of grinding. These same different types of relative motions may also occur between a grinding wheel and a truing element in order to create the wheel conditioning action to be described. It will be helpful to consider these various motions in order to understand that the present invention may be practiced to advantage in all types or categories of grinding, and that the appended claims are to be construed as generically embracing such various types of motion.

With the wheel 20 grinding on the part 24, as shown in FIG. 1, the wheel is driven by the motor WM and the part is driven by the motor PM in order to create the relative rubbing contact of face 20*b* and work surface 24*b*. The wheel slide WS is moved to the left by the motor WFM at a "feed rate" $F_{ws}$ proportional to the voltage $V_{wfm}$ to advance the wheel 20 steadily into the part 24 as the radius of the latter is progressively reduced. When this is occurring, the feed rate $F_{ws}$ of the slide is equal to the sum of the rates $R'_p$ and $R'_w$ at which the part and wheel radii are being produced. In prior industrial practice, conditions are established which hopefully make $R'_w$ quite low in order to lengthen the useful life of the wheel 20 and reduce the expense of frequently replacing the worn out (and expensive) wheel with a new one.

It is apparent that in a cylindrical grinding machine (FIG. 1) the feeding motion of the wheel is along a horizontal path parallel to a radius of the wheel extending through the region of rubbing contact. This is here called "infeeding". It is the only relative feed which is required for cylindrical grinding (although as an obvious equivalent the rotating wheel could be bodily stationary and the part 24 then bodily fed to the right) and it results in material being a removed by abrasive action from the workpiece (as well as material being removed from the wheel due to wheel wear).

But other relative feeding motions are created in other types of grinding machines. Consider FIG. 2 which generally illustrates a surface grinder wherein a grinding wheel 75 rotationally driven about its axis 75*a* is supported on a wheel slide 76 horizontally translatable along path PA1 relative to a stationary workpiece 78 supported on the machine bed 79. In this case, the wheel slide is also vertically translatable along a path PA2. When the wheel periphery is positioned at a distance DEP below the unground surface of the workpiece, and the slide moved toward the left, a thin layer of the workpiece will be ground off during each cross-feeding pass. The "down feed" is employed to determine the depth DEP of each horizontal feed "pass" and to compensate for the reduction in wheel radius as wheel wear occurs. The term "feed" as used herein thus means any relative bodily movement of a grinding wheel and workpiece or truing element which causes physical interference to occur at the region of their relative rubbing contact. The more specific term "infeeding" is here used to designate relative motion between a wheel and workpiece along a line extending radially of the wheel axis and which has the effect of compensating for wheel radius reduction (and whether or not it also produces the interference which results in workpiece material removal). Thus, in FIG. 1, the "feeding" and "infeeding" are the same; in FIG. 2, the "feeding" is the cross-feed motion along path PA1, and the "infeeding" is along path PA2. Of course, it makes no difference whether any sort of feeding is created by keeping the wheel bodily stationary (although rotating) and moving the workpiece or vice versa; it is the relative bodily movement of the two components which is necessary.

FIG. 3 illustrates a modified form of surface grinder. Here the workpiece 80 is stationary on a bed 81 and the rotationally driven grinding wheel 82 is journaled in a wheel slide 84 translatable along a horizontal path PA3 which lies parallel to the wheel axis 82*a* (as contrasted to the path PA1 lying normal to the wheel axis 75*a* in FIG. 2). The wheel slide 84 is also translatable vertically along a path PA4 to adjust the depth DEP of each cross-feed pass and to compensate for wheel wear, and this constitutes "infeed".

Of course, in either FIG. 2 or FIG. 3, if the wheel slide is not moved horizontally but is simply moved vertically downward to "plunge grind" an arcuate slot in the workpiece, that infeed motion would constitute the total feeding action.

FIG. 4 diagrammatically illustrates a roll grinder. Here the wheel slide 83 is movable horizontally along a path PA5 and vertically along path PA6 (the motions being similar to those of FIG. 3) but the workpiece is a roll 86 which is rotationally driven about its axis 85. Thus the rotational speeds and radii of the wheel 87 and the roll 86 jointly determine the relative rubbing surface speed. The "infeeding" occurs along path PA6 to control the depth of cut and compensate for wheel radius reduction due to wheel wear.

FIG. 5 is similar to FIGS. 2–4 except it illustrates a cylindrical grinding machine configuration like that already treated in FIG. 1.

In summary:

(a) "Feeding" means relative motion which produces interference (and may or may not be infeeding).

(b) "Infeeding" means relative motion of a wheel and workpiece along a path radial of the wheel axis.

The directions of feeding motion may be different in various types of grinding machines, as indicated above, but the grinding is always characterized by (i) rotation of a grinding wheel about its axis, (ii) relative rubbing contact at the wheel face and the work surface of a workpiece, whether or not motion of the workpiece contributes to such rubbing, (iii) relative infeeding of the wheel and workpiece at least to compensate for wheel wear and consequently wheel radius reduction, and (iv) relative feeding of the wheel and workpiece to produce interference and removal of workpiece material (such feeding in some cases being in the same direction as infeeding).

Exemplary Types of Truing Elements

As explained earlier, in the practice of the present invention the conditioning element (shown in exemplary form as a truing roll 50 in FIG. 1) has its operative surface 50*b* brought into contact (see FIG. 8) with the face 20*b* of the wheel 20 under certain circumstances and with certain control of variables to be described. The objective of such contact is to wear off material from the wheel face, either for restoring the wheel face shape or for determining the sharpness of the exposed grits. Analogously to "grinding contact", the conditioning element contact involves (i) rotation of the grinding wheel about its axis, (ii) relative rubbing contact of the wheel face 20*b* and the operative surface 50*b* whether or not motion of the conditioning element contributes to such rubbing, (iii) relative "infeeding" of the wheel 20 and element 50 to compensate for truing element wear (if any) and (iv) relative feeding of the wheel 20 and element 50 to produce interference and removal of wheel material (such feeding in some cases being in the same direction as infeeding).

In FIG. 2, the conditioning element may take the form of a block-shaped member 90 into rubbing contact with which the wheel 75 is fed, as illustrated by the wheel in the dashed line position 75*c*. Motions of the wheel slide 76 along paths PA1 and PA2 determine the relative feeding, while rotation of the wheel 75 creates the relative rubbing contact. Alternatively, the wheel 75 may be brought to the elevation shown at the dashed line position 75*d* and fed to the right along path PA1 to establish rubbing contact with a conditioning element in the form of a roll 91 rotationally driven (or braked) about its axis. In this case, the wheel conditioning element and infeeding are essentially similar to those created in the arrangements of FIGS. 1 and 8.

In FIGS. 3 and 4, the conditioning element 93 is shown as a cylindrical member 93 rotatable about its axis. That member may be moved down, or the wheel slide 84 may be moved up (or both), to establish the relative feeding and rubbing contact which will condition the wheel face. In FIG. 5 (corresponding to FIG. 1) the conditioning element 50 is moved to the left, or the wheel 20 is moved to the right, or both, to establish the same sort of relative feeding and rubbing contact.

In summary, it is to be understood that a "conditioning element" may take various specific forms and shapes, and the contact between a wheel and a conditioning element may involve different types of specific feeding motions, although relative rubbing of the operative surface of the element and the wheel face is always involved. The conditioning element may have, but need not necessarily have, a shape or size which is the same as or similar to the workpieces to be ground, but its operative surface will always have a form or shape corresponding to the desired form or shape of the wheel face and the workpieces to be ground through the use of the wheel.

Figure 6:
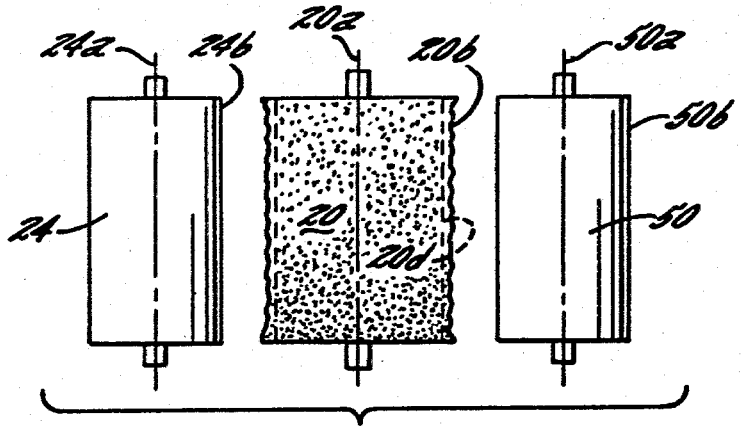
FIG. 6 is a plan view, taken generally along line 6—6 in FIG. 5, and showing the face of a cylindrical grinding wheel which has deteriorated from the desired shape and requires restoration by truing.

To pictorially confirm the difference between "formed" grinding wheels and ordinary grinding wheels, brief reference may be made to FIG. 6 which is a diagrammatic plan view taken along line 6—6 in FIG. 5. Here the grinding wheel is intended to have a desired, purely cylindrical face 20*b*, i.e., a surface of revolution defined by rotating a straight line, lying parallel to the axis 20*a*, about that axis. The workpiece 24 is to be ground down to a perfectly cylindrical shape. Loosely speaking, the desired shape of the wheel face is flat and straight along one axial element of the grinding wheel cylinder. But as shown to an exaggerated degree in FIG. 6, the wheel face will become rough and uneven ("lose form") when the wheel has been used for a relatively short interval, especially at a high rate of rough grinding. Such loss of form may make the rough grinding of the part inefficient; certainly it will create a drastically unacceptable final surface finish on the workpiece if uncorrected prior to finish grinding and spark-out. The "truing" operation involves bringing the conditioning element 50 into rubbing contact with the face 20*b* to wear off the wheel face down to the straight line 20*d*. Thus, truing to restore the wheel face to the desired shape involves purposely removing material from the wheel.

Figure 6A:
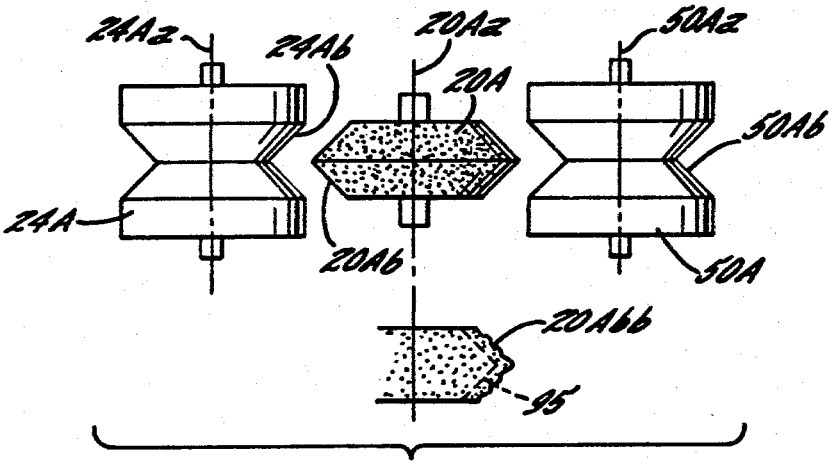
FIG. 6A is similar to FIG. 6 but shows a grinding wheel having a "formed" face associated with a workpiece and a truing element having correspondingly shaped work surfaces and operative surfaces.

FIG. 6A, by contrast to FIG. 6, illustrates an example of a formed grinding wheel 20A rotatable about an axis 20A*a*. It is to be used to grind a "V" notch in the periphery of an otherwise cylindrical workpiece 24A rotatable about an axis 24A*a*, the work surface being at 24A*b*. FIG. 6A shows the wheel 20A with the ideal, desired shape at its face 20A*b*, while the face in a typically deteriorated condition is shown, purposely with exaggeration, at 20A*bb*. Observe that the sharp nose at the point of maximum radius is blunted and rounded off, and the sides of the "V" are irregular. To restore the wheel to the desired shape, the wheel face is brought into rubbing contact with a truing roll having an operative surface 50A*b* which accurately conforms to the desired shape of the wheels face 20A*b*, thereby to wear down the deteriorated wheel face to the correct contour represented by lines 95. When a "formed" wheel (one having other than a purely cylindrical face) is to be used in order to grind a work surface to some special shape, the problem of loss of shape is accentuated, and the need for truing becomes even more critical than in the case of a cylindrical wheel face.

Figure 7:
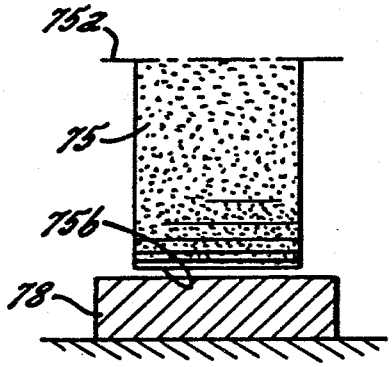
FIG. 7 is a vertical section, taken substantially along the line 7—7 in FIG. 2, and intended to show a grinding wheel having a cylindrical face acting on a generally flat workpiece in a surface grinder.
Figure 7A:
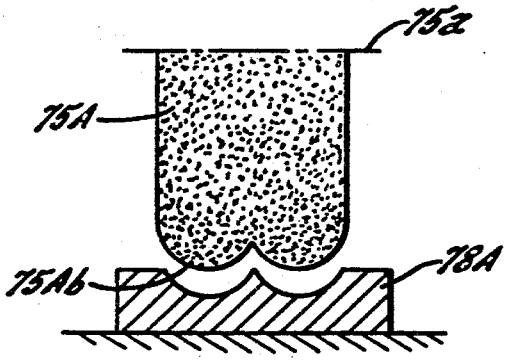
FIG. 7A is similar to FIG. 7 but illustrates a formed grinding wheel having a face other than one which is purely cylindrical in shape, and which grinds a formed surface on an associated workpiece.

One normally tends to think of a cylindrical wheel in connection with surface grinding. This is illustrated by FIG. 7 which is a diagrammatic view taken along the line 77 in FIG. 2. Here the loss of form from the desired cylindrical face shape creates the same problems explained with reference to FIG. 6. FIG. 7A indicates, however, that the wheel 75A may have a formed face 75A*b* in the configuration of two rounded ridges (merely as an example) intended to grind side-by-side rounded grooves extending across the slab-like workpiece 78A. This simply confirms that form grinding with specially shaped grinding wheel faces may exist in all the various categories of grinding machines; and the need to efficiently true wheel faces to their desired shapes creates a major challenge in industrial grinding operations.

A New and Basic Approach to Wheel Conditioning

I have discovered that the procedure of conditioning a grinding wheel, especially for purposes of truing the wheel face, may be vastly improved (in terms of less time required, better accuracy of wheel face shape, lower cost of the truing elements employed, and enhanced sharpness of the wheel at the termination of truing) by controlling the physical variables of the wheel face/truing element engagement in a particular fashion.

First, I have recognized that when one wishes to true a grinding wheel, the objective is to remove material from the wheel. My invention does not embrace procedures employing a single point diamond cutter used somewhat like a lathe tool to shave off the grinding wheel; on the contrary, my invention will find application and advantage in those cases where a conditioning element has an operative surface conforming to the desired shape of the wheel face—and wherein wheel material is removed by infeeding the wheel face and the elements operative surface into rubbing contact with one another.

Secondly, I initially recognized that because the objective is to remove material from the wheel, a guiding principle lies in the fact that, when truing is occurring, the truing element may be viewed, in effect, as "grinding" material off the wheel as a consequence of the relative rubbing and infeeding of the two. Indeed, when a diamond chip truing roll is employed, it is plain that because diamond is vastly harder than the grits (for example, aluminum oxide or silicon carbide) in the grinding wheel, the diamond chips "grind down" the wheel face and the grits therein. That principle, I learned, is not sufficient as a guide in all cases because I later discovered that I can accomplish truing of a wheel with a truing element made of a material (metal alloy or other substantially homogenous material) which is of lesser hardness than the material of the wheel grits. This is a startling discovery inasmuch as it bears little or no similarity to ordinary grinding action on a workpiece because rarely, if ever, does one grind a workpiece of a first material with a grinding wheel having grits of a second material where the first material is harder than the second. In such a situation, the wheel wear rate will almost certainly exceed the workpiece wear rate—and grinding will proceed very slowly and at high expense for replacing worn-out wheels.

My invention was conceived fully by observing that a grinding wheel is not a substantially homogeneous body of material. Its "material" is a physical mixture of discrete, albiet small, grits of a first hard material which are bound (bonded) in a supporting matrix of a second strong (in a tensile or compression sense) but perceptibly softer material. And from this I continued my thoughts to perceive that I could accomplish truing of a wheel in a controlled fashion if I would establish relative rubbing speeds and feeds of a grinding wheel and truing element which (i) promote wheel wear and (ii) reduce or tend to minimize truing element wear.

To true a wheel, I create relative rubbing speeds and feeds of the wheel and truing element which—if one viewed the wheel as grinding on the element—would create very poor grinding performance. That is, the wheel wear rate is high and the truing element wear rate is low.

To do this in accordance with my invention, (i) the relative surface speed of the rubbing contact between the wheel face and operative surface of the conditioning element and (ii) the relative feeding of the wheel face and operative surface are conjointly established to make the ratio of (a) wheel material volumetric rate of removal to (b) element material volumetric rate of removal extremely high—and higher than anyone (to the extent of my knowledge of the art) has ever achieved in practice or suggested in the literature. That ratio is symbolically expressible as W'/TE', and the control of variables (as explained below) according to my invention involves making W' very high for a given level of TE', or making TE' very low for a given level of W'. Ideally, for fastest and yet most economical truing action, W' is maximized within the capability and stiffness of the grinding machine being used, while TE' is minimized. But to obtain significant benefits of the invention, it is not really required that such maximum W' and minimum TE' actually be realized.

There are, of course, many different specific materials which have been used to serve as (i) grits in a grinding wheel and (ii) workpieces which are to be ground. Just a few typical materials are listed below in ascending order of hardness, with those used for grits identified by an asterisk:

1. Aluminum
2. Cast Iron

Mild, low carbon steels, hardened by heat treating 3. e.g., 1020 steel
4. 1050 steel
5. 1090 steel M Series Cutting Tool Steels, hardened by heat treat 6. M 1 steel
7. M 2 steel etc.
8. Aluminum Oxide*
9. Tungsten Carbide
10. Silicon Carbide*
11. Boron Nitride* (known by trademark BOROZON)
12. Diamond*

The foregoing list is not complete by any sense; it is intended only to indicate that the higher the number in the list, the harder is the material. The list obviously could be expanded to include many other materials in the order of relative hardness.

Now, for the purpose of grinding workpieces of a given material, it is the logical practice of industry to procure and use grinding wheels having grits that are harder than the workpiece material, and yet which are near the lowest cost of the several grit materials which will do the job. For example, cast iron workpieces could be ground with grinding wheels having diamond or silicon carbide grits; but since aluminum oxide grits do the job adequately and are less costly, they would be the choice. Similarly, 1020 steel will be ground with a wheel having aluminum oxide grits, but the more expensive silicon carbide or diamond grits could in theory be used to advantage if cost were no factor. On the other hand, M2 steel so closely approaches aluminum oxide in hardness that wheels having boron nitride grits are usually chosen to grind hardened M2 steel parts. And to grind tungsten carbide (a very hard and difficult-to-grind material), silicon carbide or diamond grits will be the choice. Diamond grits are used in grinding wheels only when there is no viable alternative, due to their high cost.

The foregoing "relative hardness ranking" of a limited number of materials illustrates an important, known axiom: In order to grind workpieces, the grinding wheel is chosen to contain grits which are relatively harder than the workpiece material. This is so because the abrading action of grits requires that they gouge or scoop out minute pieces of the workpiece as they "rub through" the region of contact between the wheel face and work surface. If the grits are softer than the workpiece material, the result would be simply that the grits would wear down and flatten, or they would fracture and break off—so that wheel wear rate or dulling would detract from the overall success of grinding.

A second axiom becomes apparent: Because grinding wheels inevitably will wear to some extent (with truing and dressing contributing) and will sooner or later wear out to require replacement, the cost of the wheel grit chosen bears heavily on the choice of wheel grit material employed in the grinding of any given workpiece material.

It should be noted here that diamond (synthetic or natural) is the hardest material known to man. I estimate that its hardness, relative to silicon carbide or boron nitride, is greater by a factor of at least twenty. But its price is likewise extremely high—and this has limited the use of diamond grits in grinding wheels. Diamond chip truing elements or rolls are used—almost exclusively for truing in those instances where single point diamond tools with path control are not employed—with their very high cost reluctantly accepted, because they have been perceived by those skilled in the art as the only implements which could true a grinding wheel without suffering rapid and intolerable wear and loss of form. If the element used to true a formed grinding wheel wears and loses its shape (and unless it is replaceable at very low cost), it is essentially useless in a practical, economic sense.

In any event, when speaking of diamond grits or chips carried in a grinding wheel or truing element, one must recognize that diamond stands as a class by itself in terms of hardness and cost.

Because my invention may be practiced by controlling the physical parameters of rubbing contact between a grinding wheel and a truing element, and where (i) the truing element material is softer than the wheel grit material, or (ii) the truing element material is of equal or greater hardness than the hardness of the wheel grit material, or (iii) the truing element material is diamond chips in a supporting matrix and therefore vastly harder than the wheel grit material, it is difficult to characterize or define the invention in terms which are both precise and generic to all such cases. Therefore, my invention is to be considered in three distinct classes according to the materials involved, with a common thread or physical parameter control being present in all classes but with different boundary limits for each class. For this purpose, I have defined three classes of truing contact between a wheel face and a truing element, as follows:

CLASS I: The truing element hardness is less than the hardness of the grit material of the wheel.

CLASS II: The truing element hardness is equal to or greater than the hardness of the grit material in the wheel, but not by such a degree that CLASS III applies.

CLASS III: The truing element material so vastly harder than the wheel grit material that attrition type wear (defined below) of the truing element material does not perceptibly occur.

Examples of CLASS I: The truing element is made of 1020 steel and the wheel grits are aluminum oxide; or the truing element material is M2 steel and the wheel grits are silicon carbide.

Examples of CLASS II: The truing element material is tungsten carbide and the wheel grits are aluminum oxide.

Example of CLASS III: The truing element material is diamond chips bonded in a matrix and the wheel grits are silicon carbide.

A word of explanation is in order with respect to CLASS III. It is known in the art that when a grinding wheel is employed to grind a metal workpiece, three types of "wear" occur on the wheel. These are:

(a) Attritious Wear: Due simply to the rubbing of the grits through the workpiece material, and the heat and oxygen present, the sharp corners and edges of individual grits are flattened off and made smooth. They tend to become flush with the support matrix in which they are bonded. To some extent, attritious wear involves chemical reaction of the grit material with the workpiece material. Attritious wear per se results in a relative low rate in the reduction of wheel radius.

(b) Grit Fracturing: At the relative surface speeds between a wheel face and a work surface, the individual wheel grits impact into the work. If the work is hard and the grits less hard, the impact breaks and fractures off small pieces of the grits. This results in the wheel "wearing away", but it has the advantage of exposing fresh, sharp corners or edges of a given grit until the latter is totally consumed or removed. As attritious wear rounding occurs, it tends to lessen the grit fracturing because impact forces become of lesser intensity.

(c) Blood Fracture: Here the infeed forces are sufficiently great, and the impact forces are high enough, that entire grits are bodily knocked out of the bonding "sockets" in the supporting matrix, which then wears away and exposes fresh grits which in turn get knocked out. If this type of wheel wear predominates, it eats up wheels fast. The degree of bond fracture depends, of course, in part upon the substance chosen for the matrix and for grit bonds, but it is in part determined by the sharpness of the grits and their hardness which enables them to go through the workpiece without creating high reactive forces which impose breaking stress on the bonds.

No doubt all three types of wear, each to a greater or lesser degree, occur simultaneously when grinding of a part is in progress. The first type dulls the wheel but results in relatively low wheel radius reduction. The second type reduces the wheel radius considerably but tends to keep the wheel from becoming progressively duller. The third type tends to wear down the wheel radius; but certainly the freshly exposed grits should be in a sharp condition.

In the case of a diamond grit wheel, the grits are so hard that they experience very little attritious wear. Dulling is not a serious problem unless friction-generated heat at the interface leads to heat-generated fracture of the diamond material. The same relationship exists if, say, boron nitride is used as a wheel grit material to grind a very soft material.

My new method for conditioning (truing) of grinding wheels includes the steps of 1. Rotating the grinding wheel and feeding the wheel face into relative rubbing contact with the operative surface of a truing element, such surface conforming to the desired shape for the wheel face;
2. Conjointly establishing (i) the relative surface velocity of the rubbing contact and (ii) the relative feed rate of such rubbing contact in such fashion that 3a. For CLASS I, the ratio W'/TE' is greater than 1.0 and preferably much higher in the range of 10 to 100;

3b. For CLASS II, the ratio W'/TE' is greater than 10 and preferably much higher in the range of 100 to 1000; and 3c. For CLASS III, the wearing off of the wheel is promoted in the grit and bond fracturing modes as contrasted with attrition rounding or smoothing of the wheel grits, and particularly by making the relative surface speed less than 3000 feet per minute;

where W' and TE' are the volumetric rates of removal of materials from the grinding wheel and the truing element, respectively. The ratio W'/TE' may be called the truing ratio TR.

The conjoint control of relative surface speed and relative feed, in general terms, is carried out by (a) making the relative surface speed much lower than the relative surface speeds heretofore employed in either the grinding of workpieces or the truing of wheels by rubbing action, or (b) making the relative feed rate much higher than feed rates heretofore employed in either the grinding of workpieces or the truing of wheels by rubbing action, or (c) a combination of low relative surface speed and high relative feed rate.

My experience has confirmed that the ratio W'/TE' varies as an inverse generally monotonic function of relative surface speed and as a direct generally monotonic function of feed rate. Assuming that the relationships are linear, although that is not necessarily true, this may be expressed:

$$TR = \frac{W'}{TE'} = k' \frac{F}{S_r} \qquad \text{(a)}$$

where F is feed rate, $S_r$ is relative surface speed and k is a factor of proportionality. In order to keep the W'/TE' ratio above the lower limits defined at 3a and 3b above, it is only necessary to keep the ratio $F/S_r$ above some value which can be readily ascertained by simple tests with grinding wheels of a given type (grits and matrix) while being acted upon by a truing element of a given material. It makes no difference whether one chooses to employ (a) a high feed rate and a more or less conventional surface speed, (b) a low surface speed and a more or less conventional feed rate, or (c) a feed rate which is reasonably higher than, and a surface speed which is reasonably lower than, the feed and speeds which would normally be used if the wheel were to be employed in grinding a workpiece made of the same material as the truing element.

With respect to CLASS III and the requirement 3c set out above, I am presently aware of only one truing element material which falls in this class. Such material is diamond chips carried in a matrix to form the truing element. Such chips are of strength and hardness that they can fracture and knock out the grits of a wheel (if the relative surface speed is low) without smoothing and rounding those grits and without the chips themselves being attritiously worn or fractured. I acknowledge that diamond chip truing rolls have been used in the prior art to true grinding wheels, but such prior practices have usually involved driving the grinding wheel at about 6,000 to 12,000 surface feet per minute and with little significance being given to (i) the relative surface speed of rubbing contact which is affected by both the direction of rotation of the truing element and its surface speed, or (ii) the rate of relative infeeding. Indeed, infeeding by increments rather than at a selected rate has been the usual prior practice. Prior practices of truing a grinding wheel by use of a diamond truing roll are known to leave the wheel dull. Undoubtedly this undesired result of the prior practices flows from the use of high relative speed (4,000 s.f.m. or more) and feed rates so modest that attritious flattening of the wheel grits takes place. The prior art did not (a) remove grinding wheel material as fast as my invention in CLASS III and 3c achieves, or (b) reduce wear of the diamond roll to extend its life as much as my invention achieves.

The method set out above in sub-paragraphs 1, 2, 3a, 3b, 3c produces a high wheel wear rate W' (and therefore rapid truing of a deteriorated wheel face to the desired shape) by creating fracture of grits and bond fractures in the wheel. It does so by creating high effective forces on the wheel grits by the joint effects of (i) making the "velocity factor" of strength for the grits and their bonds low and/or (ii) imposing relatively high forces due to a high feed rate and which tend to fracture the grits or their bonds.

It is known that any solid object has greater hardness and strength against breakage or deformation when it moves relatively into another body at high velocity, as contrasted to low velocity. This is the "velocity factor" phenomenon to which I have referred above. It is readily understood from the example: If a lead bullet is slowly pushed into a wood plank by an hydraulic press, the bullet will deform and crumble; but if the same bullet is fired with high velocity from a rifle at the plank, it will penetrate through and with very little deformation or crumbling. The same effect applies to wheel grits and grit bonds; by my method of making the ratio $F/S_r$ high through the avenue of making relative surface speed low, I lessen the "velocity factor" with which the wheel grits and their bonds would otherwise resist fracture.

Further, by making the ratio $F/S_r$ high through the avenue of making the feed rate F high, I increase the physical force which is imparted upon the wheel grits and their bonds, so that grit and bond fracture is promoted.

Both factors F and $S_r$ bear upon the ratio W'/TE' but I prefer to use relative surface speed as the major controlling influence. For this reason, and as explained below, I prefer to use an "up cut" for the rubbing contact of a wheel and truing cylinder in order to effect truing at relative surface speeds much lower than the art has heretofore used for either (a) grinding of workpieces or (b) truing of wheels by the rubbing action of a truing roll.

My invention greatly extends the useful life of the truing element. This is important in dealing with formed wheels where the truing element must be manufactured with an operative surface of complex shape. The truing element life is extended because the wear rate on its operative surface is reduced to a very low (and in some cases, negligible) value. This flows from the fact that at the high ratio of W'/TE' employed in the method of 3a and 3b (and the low surface speed of less than 3000 feet per minute in the method category 3c) the "velocity factor" of the wheel grits makes them have insufficient strength to gouge through the surface layer of the truing element without fracturing. The material of the truing element is not eroded or worn away at an appreciable rate and the shape of the operative surface is retained as the wheel face is worn off to a much greater extent.

The truing method here disclosed may be practiced in a wide variety of specific procedures which all lie within the generic boundaries in one of the classes set out in sub-paragraphs 1 to 3c, supra. That is:

(a) The truing element operative surface may or may not itself have surface velocity which in part contributes to the relative rubbing speed $S_r$; compare the truing elements 90 and 91 in FIG. 2.

(b) The feed rate of the truing element relative to the wheel may result from bodily movement of the wheel, bodily movement of the truing element, or both.

(c) The relative surface speed and relative feed rate of the rubbing contact may be established by open loop or closed loop action. It is not necessary for the CLASS I or CLASS II categories that the ratio W'/TE' be kept constant; on the contrary, the relative speed $S_r$ and the relative feed rate F may be permitted to vary widely so long as the ratio W'/TE' is kept above 1.0 (CLASS I), 10.0 (CLASS II) or so long as speed $S_r$ is kept lower than 3,000 feet per minute (CLASS III). In all such cases the benefits and advantages over the prior art will, at least to a significant extent, be obtained.

(d) The contact between a wheel to be trued and the truing element may be created intermittently or continuously; while the grinding wheel is or is not in grinding contact with a workpiece; and either when the wheel is operatively mounted in a grinding machine used to grind workpieces or when such wheel has been removed to a separate machine in which the truing operation is performed. Indeed, the invention may be practiced with the truing element mounted in the place of a workpiece within the machine by which the wheel is employed to grind workpieces, and in fact (as noted below) the truing element may be one of the workpieces.

(e) Further, if the truing operation is performed intermittently by the method here disclosed, the method may be practiced (i) after each of successive predetermined time intervals of grinding action performed by the wheel, (ii) each time after a certain number of workpieces have been ground by the wheel or after a predetermined thickness or volume has been ground off of a workpiece, or (iii) each time after an appropriate sensing and signaling device has indicated that the wheel face has lost its desired shape or has worn down a predetermined amount.

Figure 8:
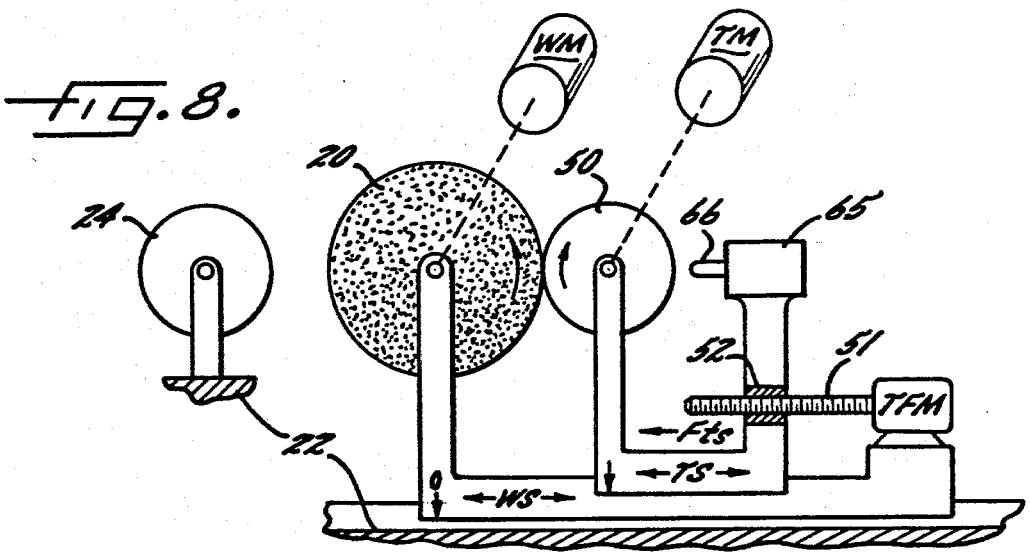
FIG. 8 is a simplified counterpart of FIG. 1 and shows a grinding wheel being conditioned by relative rubbing and feeding contact with a truing element, the wheel being free of grinding engagement with any workpiece.
Figure 9:
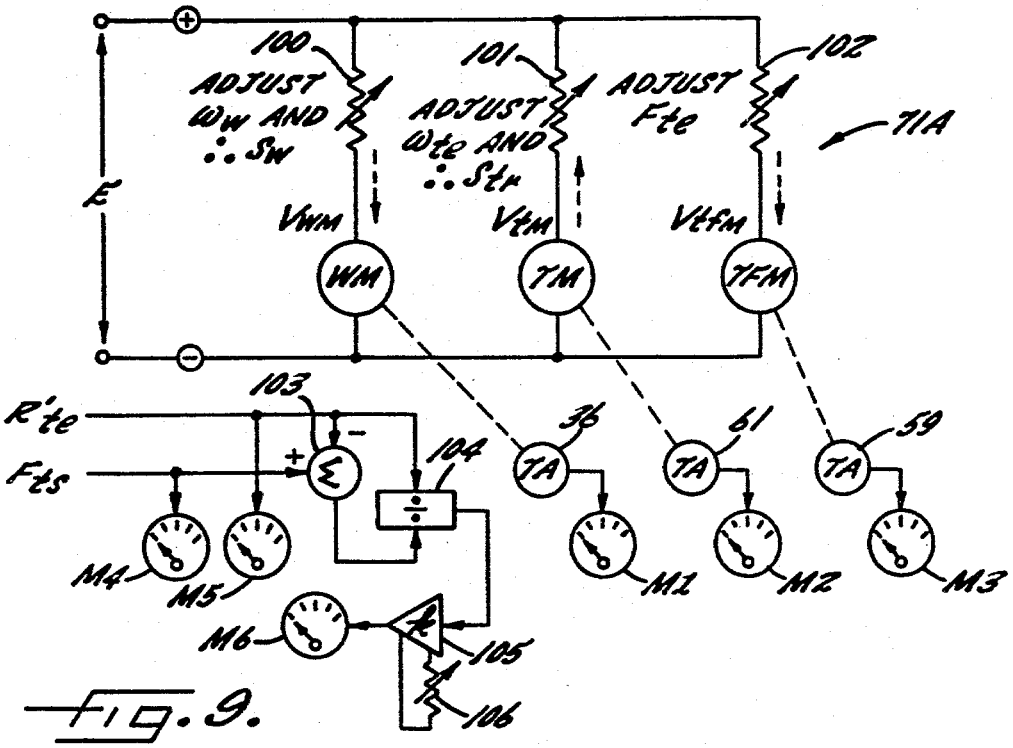
FIG. 9 is an electrical block diagram, to be taken with FIG. 8, of apparatus constituting one embodiment of the system shown generally in FIG. 1A, for controlling the truing ratio TR with which a grinding wheel is trued to restore its face to a desired shape.

FIGS. 1, 8 and 9

Reference may be made to FIGS. 8 and 9 for one embodiment of apparatus suitable for carrying out the method explained above. FIG. 8 corresponds to FIG. 1 except some of the components of the latter figure have been omitted, the slide WS has been moved to the right to retract the wheel 20 clear of the workpiece 24, and the slide TS has been moved to the left (on the slide WS) to bring the truing roll 50 into rubbing contact with the wheel face.

In the control system 71A, motors WM, TM and TFM are each controlled in speed by connection through respective manually adjustable rheostats 100, 101, 102 to a dc. source voltage E (FIG. 9). It is to be observed that the motor WM acts as a motor and drives the wheel 20 counterclockwise. The wheel in rubbing against element 50 drives the latter clockwise, but the motor TM when rotating in that direction acts as a controllable regenerative brake whose current is fed back into the source E. Motor TFM acts as a motor which drives the lead screw 51 to move the slide TS toward the left at a feed rate $F_{ts}$ which is adjustable by setting the rheostat 102.

The manual adjustment of the rheostat 100 is made to create a preselected surface speed $S_w$ for the wheel 20. The wheel radius $R_w$ having been previously measured, it is easy to adjust the rheostat 100 to make the surface speed $S_w$, say, about 2500 feet per minute (f.p.m.) bearing in mind the relationship:

$$S_w = 2\pi R_w \cdot \omega_w \quad (1)$$

If $R_w$ is expressed in feet and $\omega_w$ in r.p.m. then $S_w$ is in feet per minute (f.p.m.). To make $S_w$ 2500 f.p.m., a human operator simply adjusts the rheostat 100 until an appropriately calibrated meter M1 indicates that $\omega_w$ is equal to $(2500/2\pi R_w)$ in r.p.m. Further, the rheostat 101 is adjusted to make the relative surface speed $S_r$ of rubbing contact have a very low value (compared to relative surface speeds employed in grinding) such for example as 400 f.p.m. Bearing in mind the relation:

$$S_{te} = 2\pi R_{te} \cdot \omega_{te} \quad (2)$$

and the radius $R_{te}$ having been previously measured (in feet) so it is known, the rheostat 101 is adjusted until the angular velocity $\omega_{te}$ makes the truing roll surface speed $S_{te}$ aproximately equal, for example, to 2100 f.p.m. That is, the rheostat 101 is adjusted until a meter M2 indicates that $\omega_{te}$ is equal to $(2100/2\pi R_{te})$ in r.p.m.

The relative surface speed $S_r$ is in this case expressible:

$$S_r = S_w - S_{te} \quad (3)$$

and according to the values given by way of example:

$$S_r = 2500 - 2100 = 400 \text{ f.p.m.} \quad (4)$$

The rheostat 102 is adjusted to make the feed rate $F_{ts}$ have a high value (relative to feed rates employed in grinding of workpieces with the particular wheel 20 here involved) such as 0.040"/min. If desired, a meter M3 coupled to the tachometer 59 and calibrated in mils per minute may be used to facilitate such adjustment.

As the feeding of the slide TS occurs, the radius $R_w$ of the wheel will be reduced at a rate $R'_w$ and the radius $R_{te}$ of the element 50 will (in most cases) reduce at a rate $R'_{te}$. Simply from inspection of FIG. 8:

$$F_{ts}=R'_w+R'_{te}\cdot R'_w=F_{ts}-R'_{te} \quad (5)$$

This means that if the feed rate $F_{ts}$ is constant, as the wheel wear rate $R'_w$ increases, the element wear rate $R'_{te}$ will decrease.

If the rheostat 100 is adjusted to decrease its resistance value, the surface speed $S_w$ will increase, and the relative speed $S_r$ will increase, as made clear by Equation (3). Conversely, if the rheostat 101 is decreased in resistance value and the speed $S_{te}$ increases, the relative surface speed $S_r$ will decrease. As the surface speed $S_r$ is decreased or increased, the lowering or raising of the "velocity factor" strength of the wheel grits will make the wheel wear rate $R'_w$ increase or decrease. Assuming that the feed rate $F_{ts}$ remains constant, the element wear rate $R'_{te}$ will correspondingly decrease or increase in accordance with Equation (5).

To an approximation (see the exact relation in Equation 11, infra) which is sufficiently close, the volumetric material removal rates W' and TE' are proportional to the radius reduction rates. This approximation may be expressed:

$$\text{TRUING RATIO} = TR = \frac{W'}{TE'} \cong k\frac{R'_w}{R'_{te}} \quad (6)$$

where k is the ratio of the starting radii $R_w/R_{te}$. By substitution from Equation (5) this becomes $$TR = \frac{W'}{TE'} \approx k\frac{F_{ts}-R'_{te}}{R'_{te}} \quad (6a)$$

Thus, by adjusting either the rheostat 100 or 101, the truing ratio TR may be brought to approximately a desired value, such as 20 or 50. The key is to establish a lower and lower relative surface speed $S_r$ when it is desired to make the ratio TR higher and higher.

On the other hand, if the rheostat 102 is increased or decreased in resistance, the feed rate $F_{ts}$ will be decreased or increased. Increasing $F_{ts}$ will cause both of the wear rates $R'_w$ and $R'_{te}$ to increase, but not equally. Since the wheel is composed of discrete grits in a supporting softer matrix, an increase in the feed rate will increase the infeed force at the wheel-element interface, and this will cause the wheel wear rate $R'_w$ to increase more than the element wear rate $R'_{te}$ increases. This, in turn, will make the TR ratio W'/TE' increase; see Equation (6).

For the specific, exemplary relative surface speed of 1000 f.p.m. and a feed rate $F_{ts}$ of 0.040"/min., the radius reduction rates might typically be $R'_w$=0.038"/min. and $R'_{te}$=0.002"/min., so that the truing ratio TR according to approximation (6) would be 19 when a truing element and grinding wheel falling in CLASS I are involved. Although it is not essential, instrumentation may be included in the apparatus to permit observation of the actual truing ratio TR so that manual adjustments may be made on the rheostats 100, 101, 102 to obtain a desired value or range of values of TR. For this purpose, the signals $F_{ts}$ and $R'_{te}$ (from FIG. 1) are fed respectively to voltmeters M4 and M5 (FIG. 9) appropriately calibrated so that a human operator may read the truing slide feed rate and the truing roll radius reduction rate. These same signals are applied to a suitable known type of summing circuit 103 whose output is fed to a known type of dividing circuit 104. The second input to the latter is the signal $R'_{te}$ from FIG. 1, so that its output varies as the value of $$\frac{F_{ts}-R'_{te}}{R'_{te}}$$

That output is fed to an adjustable gain amplifier 105 which is set by a resistor 106 to have a gain of k, where k is equal to the ratio $R_w/R_{te}$ of the initially measured radii. The amplifier 105 feeds an appropriately calibrated meter M6 which displays the value of TR according to the relation of Equation (6a), supra. For the CLASS I example here given, adjustments at 100, 101 and 102 may be made until the meter M6 gives a reading of 19 or 20— or TR of whatever value may be desired.

For a grinding wheel and truing element falling in CLASS II, the radius reduction rates might typically be $R'_w$=0.0195"/min. and $R'_{te}$=0.005"/min., the TR ratio thus being 39.0.

If the grinding wheel and truing element are in CLASS III, then the rheostats 100, 101 are simply adjusted to make the relative surface speed $S_r$ less than 3000 ft./min., such as in the given numerical example where $S_r$ is about 400 f.p.m. according to Equation (4). The truing element will not wear a perceptible amount (i.e., no wear is discernible by micrometer measurement) over hours of truing operation. I have been unable to obtain a finite number for the truing ratio TR, and I can only state with certainty that it will lie well above 1000 and approaches infinity in the CLASS III practice of my invention.

The truing ratio W'/TE' is, in a precise sense, a ratio of volumetric rates of material removed. In FIG. 8, the volume W of the cylindrical wheel 50 is the area of an end face times the axial length L of truing contact, viz.:

$$W=\pi R_w^2\cdot L \quad (7)$$

By differentiating, it is seen that when the wheel radius is reducing at a rate $R'_w$, the material removal rate becomes:

$$\frac{dW}{dt} = W' = 2\pi R_w\cdot\frac{dR_w}{dt}\cdot L = 2\pi LR_w\cdot R'_w \quad (8)$$

Of course, the wheel face may be slightly jagged or uneven (as shown with exaggeration at **20*b* in FIG. 6**) so that the volumetric removal rate W' is not represented by Equation (8) with extreme precision. It is, nevertheless, sufficiently accurate to assume that the wheel face is purely cylindrical in computing the rate W'.

Similar expressions apply to the truing element 50 here shown as cylindrical in shape:

$$TE=\pi R^2_{te}\cdot L \quad (9)$$

$$TE'=2\pi LR_{te}\cdot R'_{te} \quad (10)$$

The truing ratio TR more accurately expressed—in contrast to approximation (6)—thus becomes:

$$TR = \frac{W'}{TE'} = \frac{2\pi LR_w\cdot R'_w}{2\pi LR_{te}\cdot R'_{te}} = \frac{R_w}{R_{te}}\cdot\frac{R'_w}{R'_{te}} \quad (11)$$

Assuming as an illustrative example that the grinding wheel and the truing element are initially 10" and 5" in radius, the ratio $R_w/R_{te}$ will be 2.0 and will not change appreciably as several thousandths are taken off of the wheel radius and a few thousandths are taken off of the truing roll radius. Thus, approximation (6), where the factor k representing $R_w/R_{te}$ is assumed to be constant, is sufficiently accurate as an expression of the ratio W'/TE' and may be used effectively in the practice of my invention.

Figure 10A:
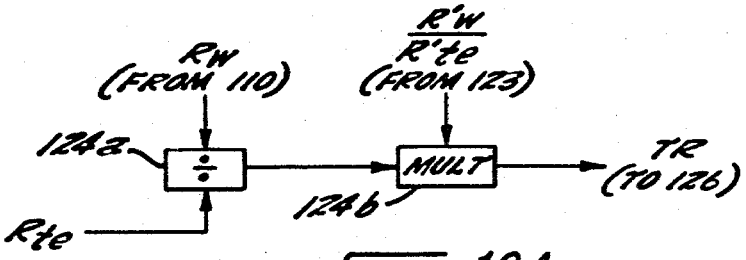
FIG. 10 is an electrical block diagram, to be taken in conjunction with FIG. 8, illustrating another embodiment of a control system for maintaining the ratio TR at a desired value when truing action is occurring in accordance with the principles of the invention to be described.
Figure 10:
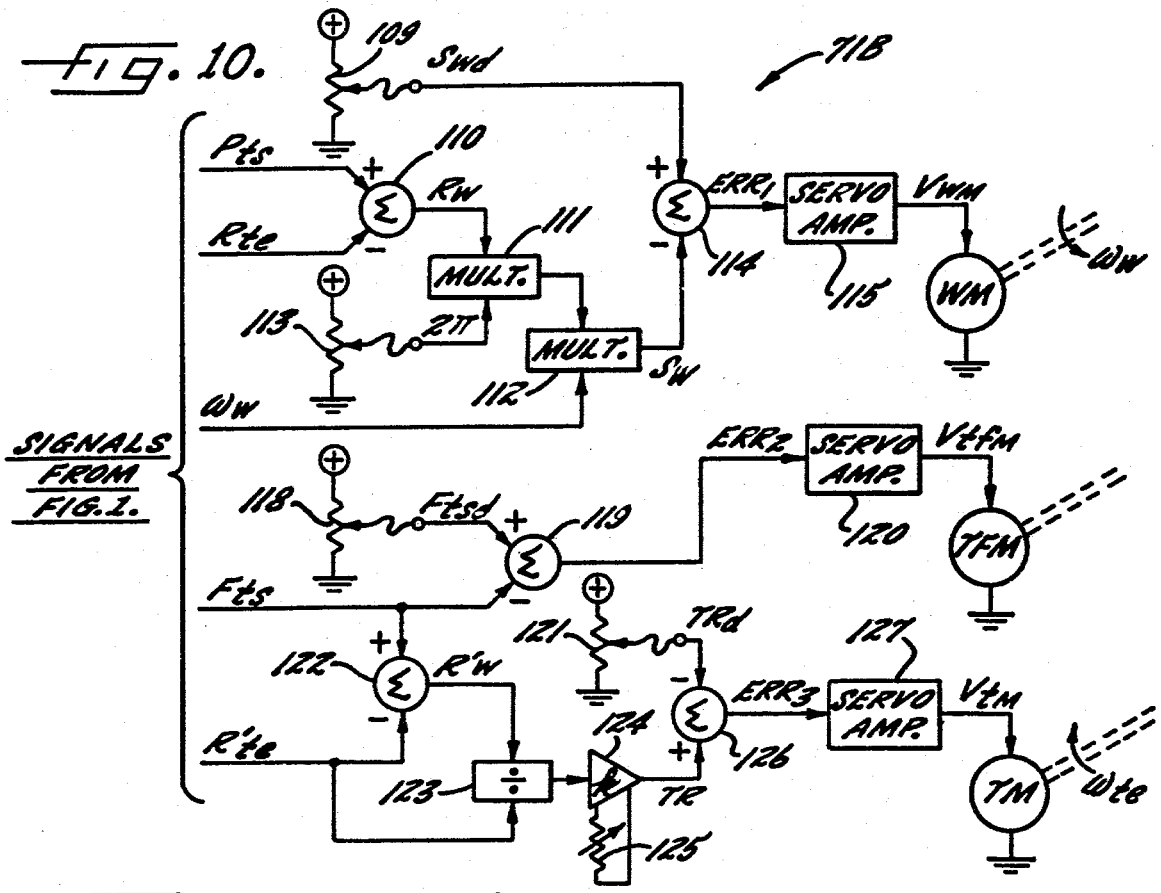

FIGS. 1, 8 and 10

A second embodiment of apparatus according to my invention, and which may be used to carry out my method, is constituted by FIG. 10 taken with FIGS. 1 and 8. FIG. 10 shows one form of a control system 71B accepting signals corresponding to certain sensed physical parameters to conjointly establish and control the relative surface velocity and relative feeding in a manner to keep the ratio W'/TE' within a desired range—and indeed at a desired set point value which satisfies the foregoing sub-paragraphs 3a and 3b with respect to CLASS I and CLASS II.

In FIG. 10, the signals labeled at the left come from FIG. 1 and have already been identified. It is assumed that the truing roll 50 and the grinding wheel 20 are, however, in rubbing contact as shown and explained with reference to FIG. 8. To establish with reasonable precision (and this is not required in all embodiments of my invention) the surface speed $S_w$ of the wheel 20 as the latter changes its radius over a wide range, the circuitry of FIG. 10 controls the motor WM according to the relationship of Equation (1), supra. Thus, in FIG. 10 a potentiometer 109 is adjusted to produce a signal $S_{wd}$ representing the desired or set point value of wheel surface speed. From FIGS. 1 and 8 it is apparent that, during truing contact:

$$R_w = P_{ts} - R_{te} \qquad (12)$$

With the signals $P_{ts}$ and $R_{te}$ applied to an algebraic summing circuit 110, the output of the latter represents the radius $R_w$. A multiplier circuit 111 of known organization receives that output and a voltage (from a potentiometer 113) representing the constant $2\pi$ to feed the product $2\pi R_w$ to a second multiplier 112 having the signal $\omega_w$ as its other input. The output $S_w$ thus varies as the actual surface speed of the grinding wheel 20 according to Equation (1). This is applied, in bucking relation to the signal $S_{wd}$, to a summing circuit 114, the output of which therefore represents the error between the desired and actual wheel surface speeds. The error signal $ERR_1$ is applied to the input of a servo amplifier 115 which creates and applies the energizing voltage $V_{wm}$ to the motor WM. The driver amplifier may include servo action stabilizing and enhancing components which, in known fashion, provide proportional, integral and derivative (PID) action. Also, the amplifier 115 may contain a bias circuit which keeps the motor WM running at a preselected "center speed" even when the error signaled from summing circuit 114 is exactly zero, so that small changes in the error result in the motor speed $\omega_w$ being corrected to bring the speed to a value which makes the error return substantially to zero. In any event, if the surface speed $S_w$ falls or rises from the desired value $S_{wd}$ for any reason, the closed loop of FIG. 10 controlling the motor WM will increase or decrease the voltage $V_{wm}$ so as to change the angular speed $\omega_w$ until the signal $S_w$ is restored to approximate equality with the set point signal $S_{wd}$. If potentiometer 109 is adjusted to make the signal $S_{wd}$ represent (by an applicable scaling factor) a surface velocity of 2500 f.p.m., the wheel face will be maintained substantially at that linear speed despite changes in loading or changes in wheel radius $R_w$.

Throughout the drawings, the representations of servo amplifiers (such as 115 in FIG. 10) are intended to illustrate amplifiers with proportional plus integral action, plus derivative action if that is desired. The servo circuits may also include a constant bias signal so that the output from the final stage of the amplifier energizes the associated motor or brake to keep its speed as a "center" value absent any integration of the error signal. The closed servo loops may be designed through the exercise of ordinary skill by servo control engineers, and the details of the servo amplifiers thus need not be illustrated or described. In FIG. 10 and similar figures to be discussed, it is sufficient to understand that the servo loop for the motor WM is constructed with sufficient gain and integration that the $ERR_1$ signal will be restored essentially to zero, and the speed $S_w$ will be returned essentially to the value represented by the signal $S_{wd}$ when any disturbance or change in physical parameters causes the controlled value to tend to depart from the desired set point.

As further shown in FIG. 10, the motor TFM is controlled by a closed loop to maintain the feed rate $F_{ts}$ essentially constant at a desired set point $F_{tsd}$. The set point is selected by adjusting a potentiometer 118 to produce a signal $F_{tsd}$ which is bucked in a summing circuit 119 with the actual feed rate signal $F_{ts}$ to produce an error signal $ERR_2$ fed to a PID servo amplifier 120 to excite the motor TFM.

The torque of the motor TM is variably controlled so as to adjust the speed $\omega_{te}$ such that the ratio TR is maintained at least approximately in agreement with a desired value. That desired value is signaled as $TR_d$ by setting a potentiometer 121. The signals $F_{ts}$ and $R'_{te}$ are subtracted in a summing circuit 122 to feed the difference $R'_w$ (see Equation 5) to one input of a known type of analog divider 123. The output of the latter feeds an amplifier 124 whose gain k is adjusted by manual setting of a rheostat 125 to equal the ratio $R_w/R_{te}$ determined from manual measurement of the two radii $R_w$ and $R_{te}$. The output signal from amplifier 124 is $k(R'_w/R'_{te})$ and is thus approximately equal to the actual truing ratio TR as expressed in Equation (6), supra. That output is algebraically compared in a summing circuit 126 with the set point signal $TR_d$ to create an error voltage $ERR_3$ forming the input to a PID servo amplifier 127. The latter produces a voltage $V_{tm}$ to energize the motor TM (acting as a brake) such that the speed $\omega_{te}$ of the truing roll 50 is increased or decreased when the actual ratio TR falls below or rises above the set point $TR_d$. In other words, if the actual truing ratio TR is less than $TR_d$, the error signal $ERR_3$ becomes positive and this increases the voltage $V_{tm}$ from its mid-bias value, so less regenerative braking current flows through the motor TM, braking torque decreases, and thus the angular and surface speeds $\omega_{te}$ and $S_{te}$ of the truing roll increase. From Equation (3), this decreases the relative speed $S_r$ of rubbing contact. That, in turn (and for the reasons explained above), causes the radius reduction rate $R'_w$ to increase and the rate $R'_{te}$ to decrease—thereby increasing the signal TR until the error $ERR_3$ is restored to zero.

In selecting and setting the set point $S_{wd}$ (FIG. 10) a relatively low value will ordinarily be chosen in the practice of the invention because it is preferred to operate in ranges of the speeds $S_w$ and $S_{te}$ which make $S_r$ low. Once the set point $S_{wd}$ is chosen, then the closed loop servo which includes the amplifier 127 will variably brake (or forwardly drive) the truing element 50 to cause the speed $S_{te}$ to increase or decrease, as required, to keep the truing ratio TR substantially equal to the set point $TR_d$. In this aspect, the apparatus acts to maintain:

$$TR - TR_d = ERR_3 = 0 \quad (13)$$

$$TR = \frac{W'}{TE'} \approx k\frac{R'_w}{R'_{te}} \approx k\frac{F_{ts} - R'_{te}}{R'_{te}} = TR_d \quad (14)$$

It is apparent therefore that since $F_{ts}$ is held essentially constant at the value $F_{tsd}$, when $R'_{te}$ tends to rise or fall, and the truing ratio departs from $TR_d$, then the relative surface speed $S_{te}$ is changed to correctively adjust $S_r$ until the actual truing ratio returns to the set point. This action flows from the fact that grinding wheel wear rate $R'_w$ varies inversely and monotonically (but not necessarily linearly) with relative surface speed $S_r$, and truing roll wear rate $R'_{te}$ varies oppositely to $R'_w$ for a given value of the feed rate $F_{ts}$ (see Equation 5).

From the foregoing, it may be observed that an embodiment of apparatus alternative to that of FIG. 10 may readily be constructed in which the surface speed $S_{te}$ is held generally constant but the wheel surface speed $S_w$ and angular speed $\omega_w$ are correctively varied in response to the difference between TR and $TR_d$. Indeed, since it is the relative surface speed $S_r$ which makes the truing ratio change (for a given feed rate $F_{ts}$), control apparatus may be constructed in the light of the foregoing teachings to keep the truing ratio TR at a desired value by variably adjusting both $\omega_{te}$ and $\omega_w$ in response to the error $TR - TR_d$.

Further, from Equation (14), if the feed rate $F_{ts}$ is increased or decreased (all other conditions remaining constant), then the truing ratio TR will increase or decrease. The truing roll wear rate $R'_{te}$ will in most cases change with changes in feed rate $F_{ts}$, but not to the same extent that wheel wear rate $R'_w$ changes. Thus, if the value of $F_{ts}$ is changed, the relative "weighting" of $R'_w$ and $R'_{te}$ in Equation (5) will change. Therefore, as an alternative to the specific embodiment of FIG. 10, the angular speeds $\omega_w$ and $\omega_{te}$ may be controlled to keep the relative surface speed $S_r$ at some set point value, and the error $TR - TR_d$ employed to cause the motor TFM to increase or decrease the feed rate $F_{ts}$ when the truing ratio TR falls below or rises above the desired value $TR_d$.

Generally, the preferred practice is to set the feed rate $F_{tsd}$ at a relatively high value and hold it generally constant, as in FIG. 10, with $\omega_w$ or $\omega_{te}$ being variably controlled to keep the actual ratio TR within a predetermind range or generally equal to the chosen set point $TR_d$. The higher the feed rate the faster the removal of material from a deteriorated wheel face to restore the latter to its desired shape. Thus for truing operations, the feed rate will be chosen as high as reasonably possible for the strength and stiffness of the machine components and the performance capabilities of the servo loop. Yet, it is to be stressed that the feed rate $F_{ts}$ and the relative surface speed $S_r$ are conjointly controlled to make the ratio TR fall in a predetermined range or match a predetermined desired value. Either or both of those parameters $F_{ts}$ and $S_r$ may be the controlled variable.

In the practice of the method through the use and operation of the apparatus of FIGS. 1, 8 and 10, if the grit materials of the wheel 20 and the material of the truing roll 50 fall in CLASS I, then the potentiometer 121 will be set to make the signal $TR_d$ represent a ratio of greater than 1.0 and preferably in the range of 10 to 100. When truing contact as shown in FIG. 8 occurs, the apparatus of FIG. 10 will keep the ratio TR at or near the set point value, produce grit and/or bond fracture in the wheel face, and result in the volumetric removal rate W' being much greater than the rate TE'. The truing element will thus wear down very slowly and it can be employed for many truing operations before it "wears out".

Example for Class I: A wheel 20 of aluminum oxide grit in a matrix of ceramic is trued with an element 50 made of 1050 quench hardened steel, the latter having an operative surface (whether truly cylindrical or otherwise) of 3" radius conforming to the desired wheel face shape. If the measured radii $R_w$ and $R_{te}$ are respectively 5" and 3", the gain k for the amplifier 124 is set to 1.66. The truing slide feed rate $F_{tsd}$ is set at 0.062"/min., and the wheel surface velocity $S_{wd}$ is set at 2000 f.p.m. The set point signal $TR_d$ is adjusted to represent a desired ratio of 50. The wheel radius reduction rate $R'_w$ in these conditions may be approximately 0.060"/min. To "true off" the wheel by 6.0 mils only 6 seconds of rubbing contact will be required; and during this interval the truing element radius will wear down by only about 0.2 mils. Thus, truing is accomplished rapidly but without appreciable wearing of the homogeneous metal truing roll 50.

If the practice of the invention by the apparatus of FIGS. 8 and 10 involves Class II material relationships, the signal $TR_d$ will be set to represent a ratio greater than ten, and preferably in the range of 100 to 1000. In this case, the feed rate $F_{tsd}$ may be set even higher and the wearing down of the wheel face will occur even more rapidly.

Example for Class II: A wheel 20 of silicon carbide grits in a matrix of ceramic is trued with an element 50 made of tungsten carbide. The truing slide feed rate $F_{tsd}$ is set at 0.100"/min. and the wheel surface velocity $S_{wd}$ is set at about 1500 f.p.m. If the measured radii $R_w$ and $R_{te}$ are 10" and 5", respectively, the gain k for the amplifier is adjusted to 2.0. The set point signal $TR_d$ is adjusted to represent a ratio of 200. The wheel radius reduction rate $R'_w$ in these conditions may be approximately 99.5 mils/min. with the radius reduction rate $R'_{te}$ being about 0.5 mils per minute. "Truing off" 5 mils from the wheel face will require only about three seconds, during which time the truing element radius will wear down only about 0.025 mils—and the truing roll will thus retain its size and shape.

As noted above with respect to Equations (6), (11) and (14) the actual truing ratio may be approximated because the ratio $R_w/R_{te}$ does not change very much. If those radii start, for example, with values of 10" and 4" then the ratio $R_w/R_{te}$ will not vary appreciably over a long time span during which $R_w$ decreases by 0.25" and $R_{te}$ decreases by 0.02". If desired, the truing ratio TR may be signaled more accurately and without the approximation, as illustrated in FIG. 10A. The latter figure shows components for replacing the amplifier 124 in FIG. 10. The signals $R_w$ and $R_{te}$ are fed to a divider 124a to produce an output varying as $R_w/R_{te}$; the latter signal is applied to a multiplier 124b which also receives the output signal from the divider 123 of FIG. 10, thereby producing an output signal TR (fed to summing circuit 126 in FIG. 10) which varies according to the relation evident from Equations (11) and (12):

$$TR = \frac{W'}{TE'} = \frac{R_w}{R_{te}} \cdot \frac{R'_w}{R'_{te}} = \frac{R_w}{R_{te}} \cdot \frac{F_{ts} - R'_{te}}{R'_{te}}$$

This FIG. 10A modification to FIG. 10 will therefore maintain the actual truing ratio TR in agreement with the desired value $TR_d$ even if the radii of the wheel and truing roll change over a wide range. But in cases where truing action does not produce a significant percentage change in wheel or truing element radius (and there are many such cases in industrial practice), one may treat radius wear rate $R'_w$ or $R'_{te}$ as representing volumetric removal rate W' or TE', this being here indicated by Equation (6) and FIG. 10.

Figure 11:
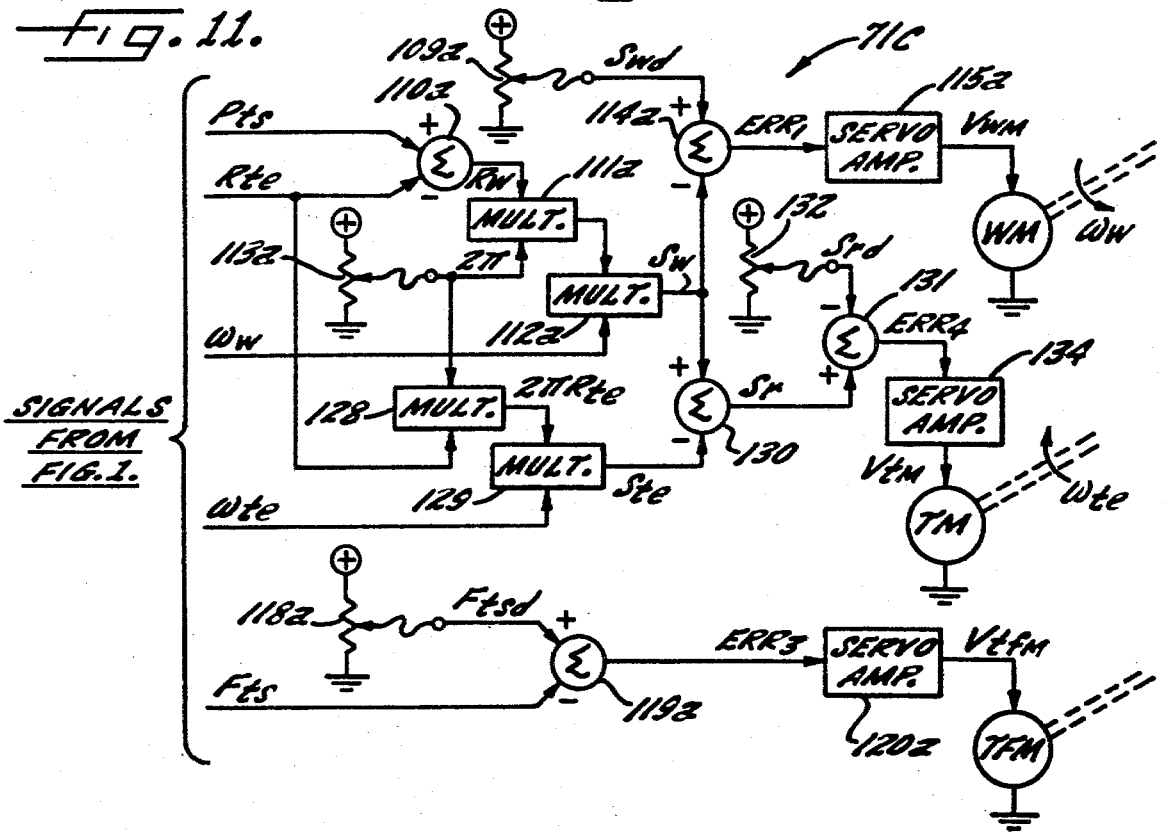
FIG. 11 is an electrical block diagram, constituting another form of the control system of FIG. 1A, and illustrating—together with FIG. 8—the control of parameters to carry out truing in accordance with the invention when the truing element and the grinding wheel fall in Class III (to be defined).

FIGS. 1, 8 and 11

If the practice of the invention by the apparatus involves Class III material relationships, then the truing ratio will approach infinity if the relative surface speed $S_r$ is less than 3000 f.p.m. Thus, the control system 71C of FIG. 11 (taken with FIGS. 1 and 8) may be employed. Here, the components 109a–120a are organized and operate in the same ways as the corresponding components 109–120 described with reference to FIG. 10. In FIG. 11, a feed rate $F_{ts}$ is selected and maintained, but the motor TM is controlled simply to keep the relative surface speed $S_r$ at a set point $S_{rd}$ which is less than 3000 f.p.m. For this purpose, the signals $R_{te}$ and $2\pi$ are applied to a first multiplier 128 whose output, along with the signal $\omega_{te}$ is fed to a second multiplier 129. The latter produces a signal proportional to $2\pi R_{te}\omega_{te}$ which thus represents the truing element surface speed $S_{te}$ (see Equation 2). That signal is algebraically subtracted from the signal $S_w$ in a summing circuit 130 to produce a relative speed signal $S_r$ (see Equation 3). This is compared in a summing circuit 131 with the set point signal $S_{rd}$ from a manually adjustable potentiometer 132 to create an error signal $ERR_4$ fed to a servo amplifier 134. The latter produces the voltage $V_{tm}$ which determines the braking torque on the truing roll 50 and thus the speed $\omega_{te}$. When the relative surface speed $S_r$ differs from the set point $S_{rd}$, the motor (brake) TM is controlled to remove the error.

As stated, when the Class III conditioning is practiced with a diamond chip truing roll, the radius reduction $R'_{te}$ is essentially zero. The feed rate $F_{ts}$ may be set relatively high (e.g., 40 mils/minute) and because the relative surface speed is low, the wheel grits are bodily fractured or knocked from their bonding sockets in the matrix material.

Example for Class III: A grinding wheel with silicon carbide grits bonded in a matrix of ceramic is trued with a truing roll of diamond chips set in a matrix of tungsten carbide. The feed rate $F_{tsd}$ is set and maintained at approximately 40 mils/min. and the wheel and roll speeds $\omega_w$ and $\omega_{te}$ are controlled to make the relative surface speed $S_r$ about 400 f.p.m. It will require only about 4.5 seconds to "true off" 3 mils from the wheel face; and the diamond truing roll will not wear enough to be measured. That truing roll may be used for many, many such separate truing operations, and its useful life will be greatly longer than that of diamond truing rolls as used in prior, conventional procedures.

Figure 12:
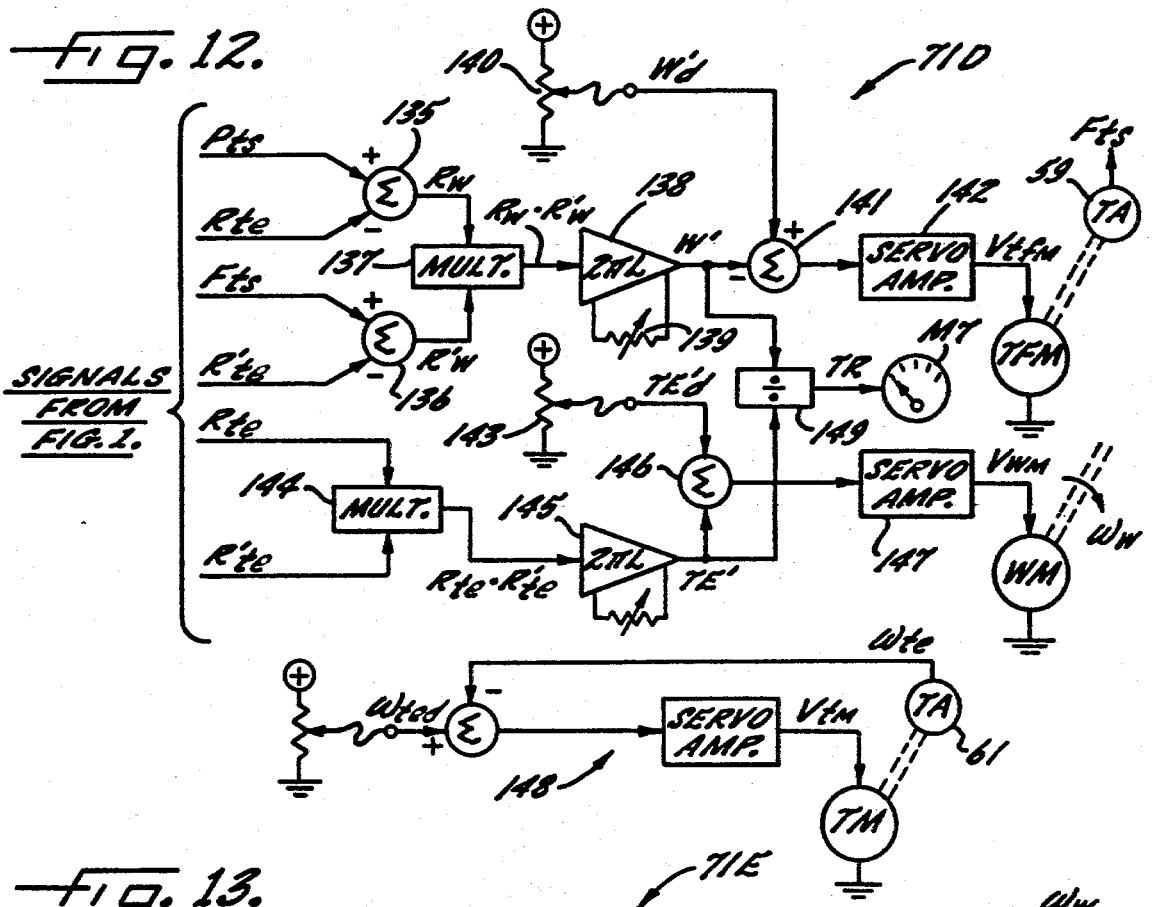
FIG. 12 is to be taken with FIG. 8 and illustrates still another specific embodiment of control apparatus for effecting truing of a grinding wheel in accordance with principles of the present invention.

FIGS. 1, 8 and 12

Another of the various possible control apparatus forms for keeping the ratio TR in agreement with a desired value is illustrated in FIG. 12. In the system 71D, two summing circuits 135, 136 respectively receive input signal pairs $P_{ts}$, $R_{te}$ and $F_{ts}$, $R_{te}$ to produce output signals varying to represent $R_w$ and $R'_w$ in accordance with Equations (12) and (5). These are fed to a multiplier 137 whose output $R_w \cdot R'_w$ is applied to an amplifier 138 having its gain adjusted by setting of a rheostat 139 to a value of $2\pi L$, where L is the length of the wheel face being trued. The output of amplifier 138 therefore signals the value of volumetric wear rate W' (see Equation 8). A potentiometer 140 is set to produce a set point signal $W'_d$ which is fed along with signal W' to a summing circuit 141 to produce an error signal applied to a servo amplifier 142 energizing the motor TFM. In this fashion, the feed rate $F_{ts}$ is automatically varied to keep the wear rate W' substantially equal to the desired value $W'_d$ selected at the potentiometer 140.

The volumetric removal rate TE' is also controlled automatically to agree with a selected set point $TE'_d$ signaled from a potentiometer 143. The signals $R_{te}$ and $R'_{te}$ are multiplied at 144 and the signal $R_{te} \cdot R'_{te}$ is fed to an amplifier 145 having a gain set to $2\pi L$. The output thus varies as TE' (see Equation 10) and is fed to a summing circuit 146 in opposition to the signal $TE'_d$, the resulting error signal being the input to a servo amplifier 147 controlling the motor WM. The speed $\omega_w$ is thus automatically varied to keep TE' substantially constant and equal to the set point $TE'_d$.

The motor TM is controlled by a closed loop servo circuit 148 to keep $\omega_{te}$ at some selected set point value $\omega_{ted}$.

Since the apparatus of FIG. 12 keeps W' and TE' constant at set point values, a human operator may know and determine the truing ratio TR simply by selecting those two values and thus their ratio W'/TE'. The truing ratio need not be actually signaled. Merely as an optional convenience, FIG. 12 includes a divider 149 receiving the signals W' and TE' to energize a meter M7 which displays the numerical value of TR and aids an operator in setting the potentiometers 140, 143 so that a truing ratio TR greater than 1.0 (Class I) or greater than 10.0 (Class II) is obtained. The amplifiers 138, 145 are not strictly necessary since their effects cancel in the divider 149 (see Equation 11), but those amplifiers are here shown for completeness. Those skilled in the art will understand that scaling factors may be introduced so that potentiometers 140 and 143 may be calibrated in cubic inches per minute or any other dimensional units which may be desired.

In the Class I and Class II wheel truing operations described above, it is immaterial what relative surface speed value is chosen so long as the relative feed rate $F_{ts}$ is made sufficiently high to give the desired range of values or value for the truing ratio TR; conversely it is immaterial what relative feed rate $F_{ts}$ is chosen (except where rapid truing is of the essence) so long as the relative surface speed $S_r$ is made sufficiently low to give the desired range of values or value for the truing ratio TR. When holding the ratio TR reasonably in agreement with a set point $TR_d$, I prefer to keep the volumetric rate W' constant and to automatically adjust the relative surface speed $S_r$ by automatic control of the wheel motor speed $\omega_w$ (FIG. 12). But in any event, for rapid wheel face shape restoration the truing procedure is in its preferred form carried out with the relative surface speed $S_r$ lying or varying within a range of values substantially lower than the range of relative surface speeds created when the wheel is being trued according to conventional industry practices. Likewise, the relative feed rate $F_{ts}$ is created to lie or vary within a range of values which is substantially higher than the range of feed rates employed when the wheel is used in conventional grinding of workpieces. Although it is not essential in the broadest aspects of my invention, its preferred practice may be viewed informally as truing a wheel by rubbing contact with a truing element such that the relative surface speed and the feed rate at the truing interface are respectively much lower and much higher than the surface speed and feed rate which would be selected by a skilled artisan to be used when that same wheel is conventionally employed in grinding a workpiece.

Supplemental Actions

The method and apparatus here described with reference to FIGS. 9, 10, 10A, 11 and 12 will result in rapid removal of material from the grinding wheel face—and thus quick restoration of the desired shape. Not only is this main objective obtained, but in all cases there are the further benefits that (a) the truing element wear is relatively slight so it remains usable over a long time span and (b) the wheel face is left sharp! The rapid wheel material removal and the resulting sharpness of exposed wheel face grits both come about because the relative feeding and surface speed of the rubbing contact between the wheel 20 and the truing element 50 are conjointly controlled to fracture the wheel grits and indeed fracture wheel grit bonds (so that fresh grits are exposed).

I have recognized that supplemental procedures and apparatus may optionally be employed to further promote wheel grit fracture and grit bond fracture—and thereby make the noted advantages even more pronounced. Specifically, I propose purposely to induce vibrations at the region of rubbing contact between the grinding wheel and a truing element, so that the impact forces on grits are increased, thereby promoting greater grit fracture and bond fracture (while lessening to an even greater degree abrasion of the truing element surface). Thus, in the practice of the methods and apparatus already described (in any of Classes I, II, III), I may induce vibrations at a rate of several cycles per revolution of the grinding wheel and in either or both (a) a direction tangential to the region of rubbing contact, and (b) a direction normal to the region of rubbing contact.

For tangential vibrations, I may create "dither" in the voltage $V_{wm}$ or $V_{tm}$ so that either or both of the wheel and the truing element have small, rapid rotational vibrations while their average rotational speeds $\omega_w$ and $\omega_{te}$ remain at the selected or adjusted values.

For translational vibrations along a path normal to the wheel axis and extending through the region of rubbing contact, I may create "dither" in the voltage $V_{tfm}$ so that the truing elemtnt 50 in FIG. 8 vibrates left and right while continuing an average feed rate $F_{ts}$ toward the left.

It will be apparent to those skilled in the art how a "dither" signal may be injected into the one or more of the servo amplifiers 115, 120, 127 (FIG. 10) or the servo amplifiers 115*a*, 134, 120*a* in FIG. 11 thereby to create one or more of the vibrating actions described above.

Further as a supplemental aid promoting rapid wheel wear (and low rate of truing element wear), I may construct the truing element 50 with serrations or slots extending parallel to the axis of the grinding wheel—but with the operative surface otherwise corresponding to the desired shape for the wheel face. In the case of a cylindrical truing element, it would thus appear somewhat like a splined shaft. In the use of such a "slotted" truing element, impact will be greater as the leading edge of each rib strikes the region of rubbing with the wheel face, and thus grit and bond fracture action will be enhanced.

Finally, to create vibrations for the effect here described I may purposely construct the truing element such that it is dynamically unbalanced and so that it thus vibrates as a result of its rotational speed.

A Second Approach By Setting or Controlling STE Conditioning of Grinding Wheels Thus far my invention has been shown to be practiced by methods and apparatus in which the truing ratio TR is initially set or continuously controlled so that it always resides above 1.0 for Class I materials or above 10.0 for Class II materials. For Class III materials, the relative surface speed $S_r$ or rubbing contact between the wheel and truing element is set or continuously controlled so that it always resides below 3000 f.p.m. The relative truing feed rate $F_{ts}$ is chosen (whether it is variably controlled or held constant, the latter being shown in FIGS. 10 and 11) such that the wheel radius $R_w$ wears down fast—this being the objective when it is desired to "true" or restore the shape of a deteriorated wheel face. The high truing ratios TR (above the minimums of 1.0 for Class I and 10.0 for Class II) vastly exceed values heretofore employed or suggested, so far as I know, in the art. And the low surface speeds $S_r$ (below 3000 f.p.m. for Class III) are greatly less than values employed or suggested, so far as I know, in the art. The synergistic and surprising result of the invention as thus far described is that the truing element wears down slowly—even in Class I or Class II where that element is an homogeneous crystaline material such as a 1050 steel or an M1 steel, and in Class III where it appears that the useful life of a diamond truing roll will be virtually infinite. Thus, the main objective of rapidly truing a wheel by removing material from its face may be accomplished with a low cost truing element, the operative surface thereof retaining its shape over a long span of usage; and a diamond truing roll becomes, in effect one of low cost because of its greatly extended useful life.

My invention may be practiced, however, with all those same advantages by a second control approach which is more flexible and which yields many additional advantages to be described. The second approach may here be given the short name "STE Control" and it is next treated herein.

The action which takes place at the rubbing interface between a wheel and a conditioning element is subject to many variables. The best indicator of the action at that interface, and of the degree of "sharpness" being produced at the wheel face is the energy efficiency with which material is being removed from the grinding wheel. I call such energy efficiency "Specific Truing Energy" (STE) and define it as the amount of energy expended in removing a given amount (volume) of wheel material. This is expressible as a ratio of an amount of energy $E_t$ expended in removing a given volume W of wheel material:

$$STE = \frac{\text{Energy Expended}}{\text{Wheel Volume Removed}} = \frac{E_t}{W} \quad (16)$$

The dimensional units of STE are expressible, for example, as foot-pounds per cubic inch, watt-minutes per cubic centimeter, or horsepower-minutes per cubic inch.

If one divides the numerator and denominator in Equation (16) by the time span during which the volume W is removed, then STE becomes the ratio of power applied in removing wheel material to the volumetric rate of material removal. This is expressed:

$$STE = \frac{PWR_t}{W} \quad (17)$$

Consider that a grinding wheel 20 is rotationally driven in relative rubbing contact with, and with infeeding relative to, a truing element 50 as shown in FIG. 8, and that certain physical variables are signaled as explained above with reference to FIG. 1. The power (rate of energy expended) in rotationally driving the wheel 20 is expressible:

$$PWR_w = 2\pi \cdot TOR_w \cdot \omega_w \quad (18)$$

Normally that power would be expressed in dimensional units of ft.-lbs./min. but it can easily be converted to other units such as horsepower.

Likewise, the power applied in driving or braking the element (and thereby contributing to the rubbing action) is $$PWR_{te} = 2\pi \cdot TOR_{te} \cdot \omega_{te} \quad (19)$$

The total power $PWR_t$ applied to the rubbing contact at the interface between the wheel face 20*b* and the element's operative surface 50*b* thus becomes $$PWR_t = \pm PWR_w \pm PWR_{te} = 2\pi(\pm TOR_w \cdot \omega_w \pm TOR_{te} \cdot \omega_{te}) \quad (20)$$

It may be noted that Equation (3) as an expression for relative surface speed $S_r$ may be more rigorously written:

$$S_r = |S_w + S_{te}| \quad (21)$$

where $S_w$ and $S_{te}$ are taken as terms each having its own sign designating a positive or negative direction. If in FIG. 8, a positive direction is taken as vertically upward at the rubbing contact region, and with the wheel 20 driven c.c.w. and the element 50 turning c.w. (but being braked), then Equation (3) becomes a specific and correct reflection of Equation (21) with direction signs applied. In order to create rubbing at the region of contact, however, it is only necessary that the surface speed $S_w$ and $S_{te}$ have different values regardless of their directions. Thus, one may state the several cases:

Case 1: $\omega_w$ is c.c.w.; $S_w$ is positive; $\omega_{te}$ is c.w.; $S_{te}$ is positive; $S_w > S_{te}$ Case 1a: Same as 1 but $S_{te} > S_w$ Case 2: $\omega_w$ is c.c.w.; $S_w$ is positive; $\omega_{te}$ is c.c.w.; $S_w$ is negative; $S_w > S_{te}$ Case 2a: Same as 2 but $S_{te} > S_w$ Case 3: $\omega_w$ is c.w.; $S_w$ is negative $\omega_{te}$ is c.c.w.; $S_{te}$ is negative; $S_w > S_{te}$ Case 3a: Same as 3 but $S_{te} > S_w$ Case 4: $\omega_w$ is c.w.; $S_w$ is negative $\omega_{te}$ is c.w.; $S_{te}$ is positive; $S_w > S_{te}$ Case 4a: Same as 4, but $S_{te} > S_w$ In all such cases, the relative surface speed $S_r$ is finite (other than zero)—and the only requirement for this is that $S_w$ and $S_{te}$ be unequal. The sign or direction of $S_r$ is immaterial. Further, in Cases 1, 1a, 3 and 3a, the magnitude or $S_r$ is determined by subtracting the magnitude of $S_{te}$ from that of $S_w$; and in Cases 2, 2a, 4 and 4a the magnitude of $S_r$ is determined by adding the magnitude of $S_{te}$ to that of $S_w$.

Further, it is apparent that in Cases 2, 2a, 4 and 4a the motors WM and TM both act affirmatively as motors to produce torques in the direction of their rotations. Both motors thus contribute energy to the rubbing action at the wheel-element interface, such energy creating in part work that removes material and creating in part heat due to friction. In these cases the $PWR_t$ in Equation (20) is arrived at by taking the + symbols as +.

But in Case 1 (see FIG. 8) power $PWR_w$ from motor WM goes in part to drive the element TE, and the motor TM acts as a brake because its torque is in a direction opposite to its rotation. Thus, the power $PWR_t$ (producing work to remove material and heat at the interface) is found in Equation (20) by taking the $PWR_w$ sign as + and the $PWR_{te}$ sign as −. Conversely, in Case 1a the motor TM drives the element 50 by acting as a motor, and to control the speed $\omega_w$, the motor WM will act as a brake which absorbs some of the power produced by the motor TM. Thus, Equation (20) for Case 1a will be used with a + sign for $PWR_{te}$ and a − sign for $PWR_w$.

From what has been said, it will be seen that for Case 3, the sign of $PWR_w$ will be + and the sign of $PWR_{te}$ will be − in Equation (20) and the motor TM will act as a brake; further, for Case 3a, the sign of $PWR_w$ will be taken as − and the sign of $PWR_{te}$ as +, because the motor WM acts as a brake.

These several cases are mentioned here for the sake of completeness because it is purely a matter of choice as to which case is used to create the rubbing relative surface velocity $S_r$. Indeed, in a surface grinding machine if the conditioning element is a stationary member (see 90 in FIG. 2) then the surface speed $S_{te}$ and the power $PWR_{te}$ are both zero. But for a cylindrical grinding machine and a moving (rotating) conditioning element 50 as exemplified in FIG. 8, I prefer to employ Case 1 because it permits relative speeds $S_r$ less than wheel surface speeds $S_w$—and thus lower values of $S_r$ even if the motor WM is not controllable down to low values of $\omega_w$. And Case 1 (like all except Cases 1a and 3a) does not require that the motor WM have the capability of acting also as a brake.

For the balance of this specification, therefore, I will assume that the rotational directions and surface speeds $S_w$ and $S_{te}$ fall into Case 1 as illustrated in FIG. 8. Equation (3) may be taken as a specifically applicable form of Equation (21). Also, as a specifically applicable form of Equation (20), I shall use for purposes of discussion:

$$PWR_t = PWR_w - PWR_{te} = 2\pi(TOR_w \cdot \omega_w - TOR_{te} \cdot \omega_{te}) \quad (22)$$

Those skilled in the art may choose to use any case other than Case 1; but in any event they will be able to apply the teachings which follow by using the correct signs in the equations which reflect physical relationships.

Considering the volumetric wheel wear rate W', one may first note that the truing element 50 is being fed toward the left (FIG. 8) and toward the wheel at a rate $F_{ts}$ (expressible, for example, in inches per minute). The wheel radius $R_w$ will be wearing down at a rate $R'_w$ and the element radius $R_{te}$ will be wearing down at a rate $R'_{te}$. The latter two values are signaled from the probe 65 (FIG. 1) but neither $R_w$ or $R'_w$ are directly known from the sensors employed in FIG. 1. Yet, as noted by equations set out above, $R_w$ may be found from the relationship $$R_w = P_{ts} - R_{te} \tag{12}$$

and $R'_w$ may be found from the relationship $$F_{ts} = R'_w + R'_{te} \cdot R'_w = F_{ts} - R'_{te} \tag{5}$$

The volumetric wheel removal rate is thus determinable from $$W' = 2\pi \cdot L \cdot R_w \cdot R_w' \tag{8}$$

and by substitution from Equations (12) and (5) this is rewritable $$W' = 2\pi \cdot L(P_{ts} - R_{te})(F_{ts} - R'_{te}) \tag{8a}$$

The STE ratio from Equation (17) becomes by substitution from Equations (22) and (8a):

$$STE = \frac{PWR_t}{W'} = \frac{(TOR_w \cdot \omega_w - TOR_{te} \cdot \omega_{te})}{L \cdot R_w \cdot R_w'} = \frac{(TOR_w \cdot \omega_w - TOR_{te} \cdot \omega_{te})}{L(P_{ts} - R_{te})(F_{ts} - R'_{te})} \tag{23}$$

The numerator and denominator are respectively proportional to $PWR_t$ and W'.

In accordance with an important aspect of my invention, I have discovered that rapid truing of a grinding wheel and low wear rates on the truing element are obtained when the relative rubbing and feeding action of the wheel and element are set up or controlled to make the STE ratio lie always within a low range. By "low", I mean at least an order of magnitude less than the SGE ratio which has been used or suggested in the art when the same grinding wheel involved is employed in grinding of a workpiece. If the STE ratio is expressed in dimensional units of horsepower per cubic inch per minute, the "low range" here referred to denotes a value of 0.5 or less. At any STE of 0.5 or below—and irrespective of whether the wheel and element materials fall in Class I, II or III—the truing action will be rapid (assuming that $F_{ts}$ is chosen or controlled to be sufficiently high), the wear rate $R'_{te}$ and volume rate TE' will be low, and the wheel face will be made sharp (or left sharp after a truing operation ends).

Figure 13:
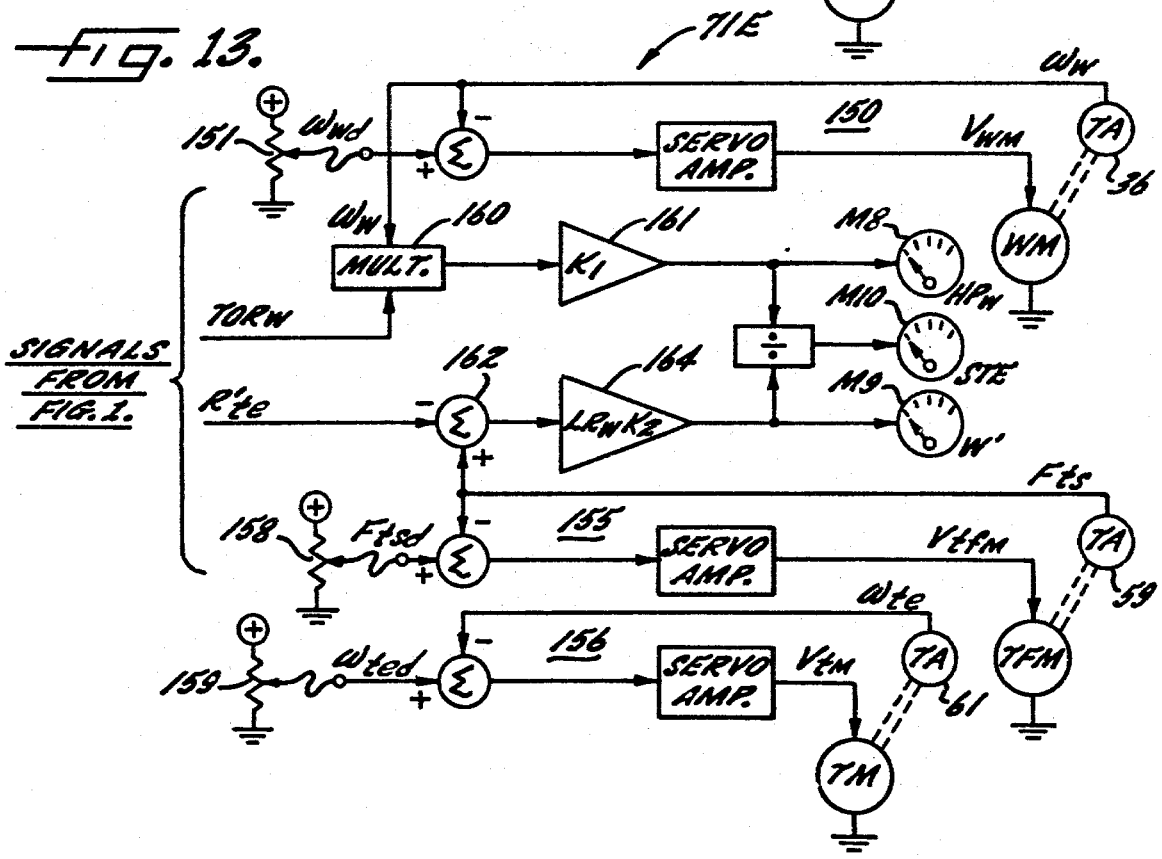
FIG. 13 is an electrical block diagram, to be taken with FIG. 8, of still another control apparatus embodiment usable in the practice of the present invention in maintaining the STE ratio (to be defined) within a predetermined range during truing of a grinding wheel.

FIGS. 1, 8 and 13

To achieve these results it is not necessary that the STE ratio be accurately known or controlled. Indeed, it may vary widely, and approximations may be used, so long as STE remains low for rapid truing action. A simple and low cost method and apparatus system 71E is illustrated in FIG. 13 taken with FIGS. 1 and 8. In FIG. 13 a closed loop servo circuit 150 is associated with a set point potentiometer 151 to control the wheel motor WM and the speed $\omega_w$ to agree with a set point signal $\omega_{wd}$. By manually adjusting the potentiometer 151 the speed $\omega_w$ may be changed. The servo circuit 150 includes a summing device 152 and a PID servo amplifier 154, and it operates in the same way explained above with reference to the control of the motor TFM in FIG. 11.

In FIG. 13 two identical servo circuits 155 and 156 are associated with the motors TFM and TM so that the truing slide feed rate $F_{ts}$ and the truing element speed $\omega_{te}$ are held in agreement with set points selected by adjusting respective potentiometers 158 and 159.

Although not essential, apparatus in FIG. 13 serves as an aid in making manual adjustments to keep the STE ratio within a desired range or near, if not equal, to a desired value. For this purpose, the signals $TOR_w$ and $\omega_w$ from FIG. 1 are applied to a multiplier circuit 160 driving an amplifier 161 having a gain of $K_1$ and an output coupled to a meter M8. The amplifier output varies as $$K_1 \cdot TOR_w \cdot \omega_w$$

where $K_1$ is a proportionality factor chosen to permit the meter M8 to be calibrated directly in horsepower (see Eq. 18).

The signals $R'_{te}$ and $F_{ts}$ are bucked in a summing circuit 162 which drives an amplifier 164 having a gain of $LR_wK_2$, the output of the latter thus being $$K_2 \cdot L \cdot R_w \cdot (F_{ts} - R'_{te})$$

where $K_2$ is a constant of proportionality which, taken with the previously measured values of truing interface length L and radius $R_w$, permits a meter M9 to be calibrated in cubic inches per minute.

The outputs of the two amplifiers 161 and 164 are fed to a dividing circuit 165 the output of which is applied to a meter M10. The input signal to that meter varies according to the value of $$\frac{K_1 \cdot TOR_w \cdot \omega_w}{K_2 \cdot L \cdot R_w(F_{ts} - R'_{te})} = \frac{PWR_w}{W'} \tag{24}$$

The numerator $PWR_w$ in that expression may be read from meter M8 as an indication of the horsepower being delivered by the wheel motor WM. The denominator W' may be read from meter M9 and represents the wheel material removal rate in cubic inches per minute. The ratio displayed on the meter M10 represents, to an approximation, STE.

It is to be noted that Equation (24) omits the truing element power term $TOR_{te} \cdot \omega_{te}$ which appears in Equation (23). This omission may be made because the wheel motor power $PWR_w$ is in most cases very large relative to the truing element motor (braking) power $PWR_{te}$ and sufficient accuracy is obtained despite the omission. Also, Equation (24) employs a constant factor $R_w$ rather than the variable factor $(P_{ts} - R_{te})$ in Equation (23), thus treating the wheel radius as constant even though that is not in fact the case. Yet, if the wheel radius is initially 10" and represented by the constant factor $R_w$ in Equation (24), then as the wheel wears by several tenths of an inch the approximation will still be sufficient.

In the use of the FIG. 13 apparatus, a human operator brings the truing element 50 into contact with the wheel 20 (FIG. 8) and then sets the potentiometers 158 and 159 to produce desired values of $F_{ts}$ and $\omega_{te}$. He reads the meter M10 to observe the STE value and then adjusts the potentiometer until he obtains an indicated ratio of, say, 0.25 horsepower per cubic inch per minute. This will not be a truly accurate indication of STE, due to the approximations explained, but it will not be off by more than about 25%. If the meter M10 first reads higher or lower than 0.25, the operator may adjust the potentiometer 151 to decrease or increase $\omega_w$ and thus to bring the meter reading to that value. Such adjustment has the effect of decreasing or increasing the value of $PWR_w$ and therefore $PWR_t$ in Equation (23).

Alternatively, the operator may adjust the potentiometer 158 to change $F_{ts}$. If $F_{ts}$ is increased or decreased, the wheel radius reduction rate will increase or decrease, so W' will increase or decrease, and STE will tend to decrease or increase. Torque $TOR_w$ will tend to increase or decrease and make the numerator in Equation (24) in part cancel such change in STE, but there will not be total cancellation. The adjustment of $F_{ts}$ may therefore also be used to adjust STE. Likewise, the operator may adjust the potentiometer 159 to change $\omega_{te}$ (and therefore relative surface speed $S_r$) which due to changes at the interface will cause the wheel power $PWR_w$ to change and thereby cause the STE (as indicated on meter M10) to change.

Once the initial reading of 0.25, or thereabout, has been established on meter M10, the truing may continue—and even though the STE value so indicated rises or falls by 30 to 40 percent, it will be known that the STE ratio is somewhere below 0.50. Truing will be accomplished by rapid wear of the wheel; the wear on the truing element will be slight; and when truing action is terminated the wheel face will be sharp.

Figure 14:
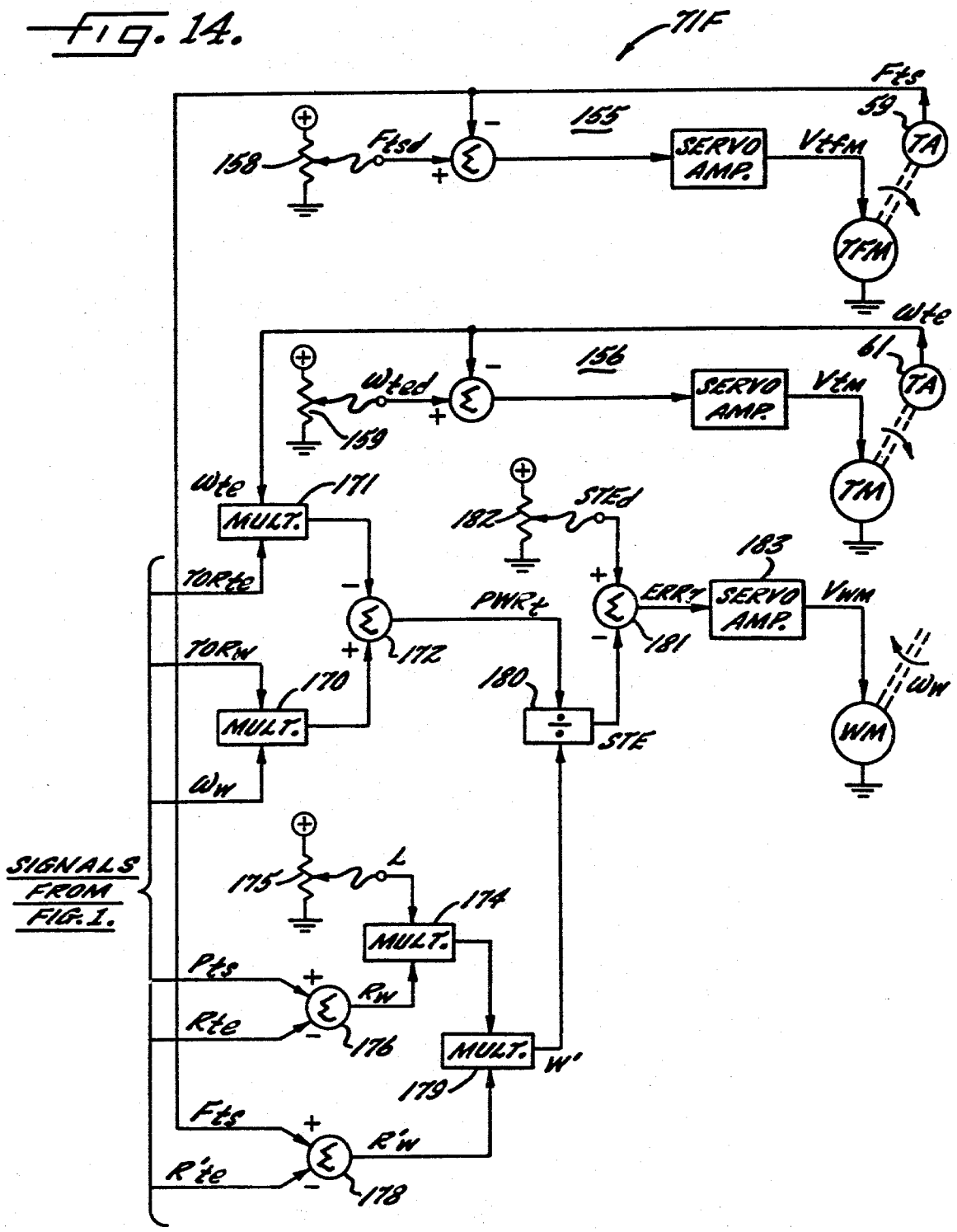
FIG. 14 is an electrical block diagram which, with FIG. 8, depicts a control method and apparatus embodiment for maintaining the STE ratio at a desired value.

FIGS. 1, 8 and 14

FIG. 14 when taken with FIGS. 1 and 8 illustrates another embodiment of the present method and apparatus for controlling the STE ratio without the approximations mentioned above with respect to FIG. 13. In the system 71F of FIG. 14, the truing feed motor TFM and the truing slide rate $F_{ts}$ are controlled by a servo circuit 155 identical to that previously described with reference to FIG. 13. Similarly, a servo circuit 156 is employed to control the truing element speed $\omega_{te}$ such that it is kept substantially equal to a set point value $\omega_{ted}$ as established by adjustment of the potentiometer 159. Thus, in the operation of the apparatus shown in FIG. 14 the feed rate $F_{ts}$ and the element's rotational speed $\omega_{te}$ are both maintained essentially constant and equal to preselected set point values.

In order to sense and signal the value of the STE ratio actually existing in the machine while truing is occurring, first and second multipliers 170 and 171 feed their output signals to a summing circuit 172. The first multiplier receives the signals $TOR_w$ and $\omega_w$, while the second multiplier receives the signals $TOR_{te}$ and $\omega_{te}$. The output of the summing circuit 172 varies as the total power $PWR_t$ and represents the numerator in Equation (23).

Further a multiplier 174 receives as its inputs a signal L from an adjusted potentiometer 175 (representing the axial length of the truing interface) and the output of a summing circuit 176. The latter receives the signals $P_{ts}$ and $R_{te}$ so that its output varies in accordance with the wheel radius $R_w$ in accordance with Equation (12). Another summing circuit 178 receives the input signals $F_{ts}$ and $R'_{te}$ to produce an output signal which varies as the wheel radius reduction rate $R'_w$ in accordance with Equation (5). The outputs from the summing circuit 178 and the multiplier 174 are applied to a multiplier 179 which produces an output signal here labeled W'. This latter signal thus varies in accordance with the denominator in Equation (23) and is fed to a divider circuit 180 along with the signal $PWR_t$ from the summing circuit 172. The output from the divider 180 varies in accordance with the actual value of STE existing in the machine while truing is in progress (FIG. 8). That signal is fed subtractively to a summing circuit 181 which also receives additively a set point signal $STE_d$ from an adjusted potentiometer 182. The operator of the system may set up on the potentiometer a desired value of the STE ratio which he wishes to have automatically maintained during the course of the truing procedure. If the actual value of STE differs from the set point, the summing circuit 181 produces an error signal $ERR_7$ fed to a PID servo amplifier 183 which supplies the energizing voltage $V_{wm}$ to the wheel motor WM. In this fashion, if an error exists, the motor WM adjusts the speed $\omega_w$ until the signaled value of the actual STE agrees with the set point value and the error $ERR_7$ is restored to zero.

If rapid truing of a deteriorated wheel face is desired and with relatively small wear on the truing element being employed, the operator of the system will set the potentiometer to call for an STE ratio of 0.5 HP/in.$^3$/-min., or less. Wheel speed $\omega_w$ will then be adjusted to maintain the STE ratio and the system will operate with a combined truing feed rate and relative surface speed such that the wheel wear occurs mainly by grit fracture and grit bond fracture. When the truing operation is terminated, the wheel face will be sharp.

In FIG. 14 the correctively adjusted value is $\omega_w$. If STE becomes greater or less than $STE_d$, the wheel speed $\omega_w$ is decreased or increased; and thus the surface speed $S_w$ is decreased or increased (see Equation 1); and the relative rubbing surface speed $S_r$ is decreased or increased (see Equation 3) because $\omega_{te}$ is held constant by the servo loop 156. As noted above, if $S_r$ is decreased, impact strength of wheel grits and grit bonds is decreased so that wheel radius reduction rate $R'_w$ increases (and $R'_{te}$ decreases with $F_{ts}$ remaining constant). Alternatively, if $S_r$ is increased, the wheel radius reduction rate $R'_w$ decreases and $R'_{te}$ increases, while, in this embodiment, the feed rate $F_{ts}$ is held constant. Therefore, by selecting a set point $STE_d$ and keeping the actual STE equal to it, the apparatus and method depicted by FIGS. 1, 8 and 14 will vary the relative surface speed $S_r$ to change the truing ratio TR.

It should be understood that other variables besides $\omega_w$ may be adjusted automatically in order to keep STE constant and equal to a selected set point value. The STE ratio will change if either the truing element speed $\omega_{te}$ or the truing feed rate $F_{ts}$ is changed, and either of these quantities may be controlled automatically to provide corrective adjustments whenever an error arises between the actual value and the set point value of STE.

Figure 15:
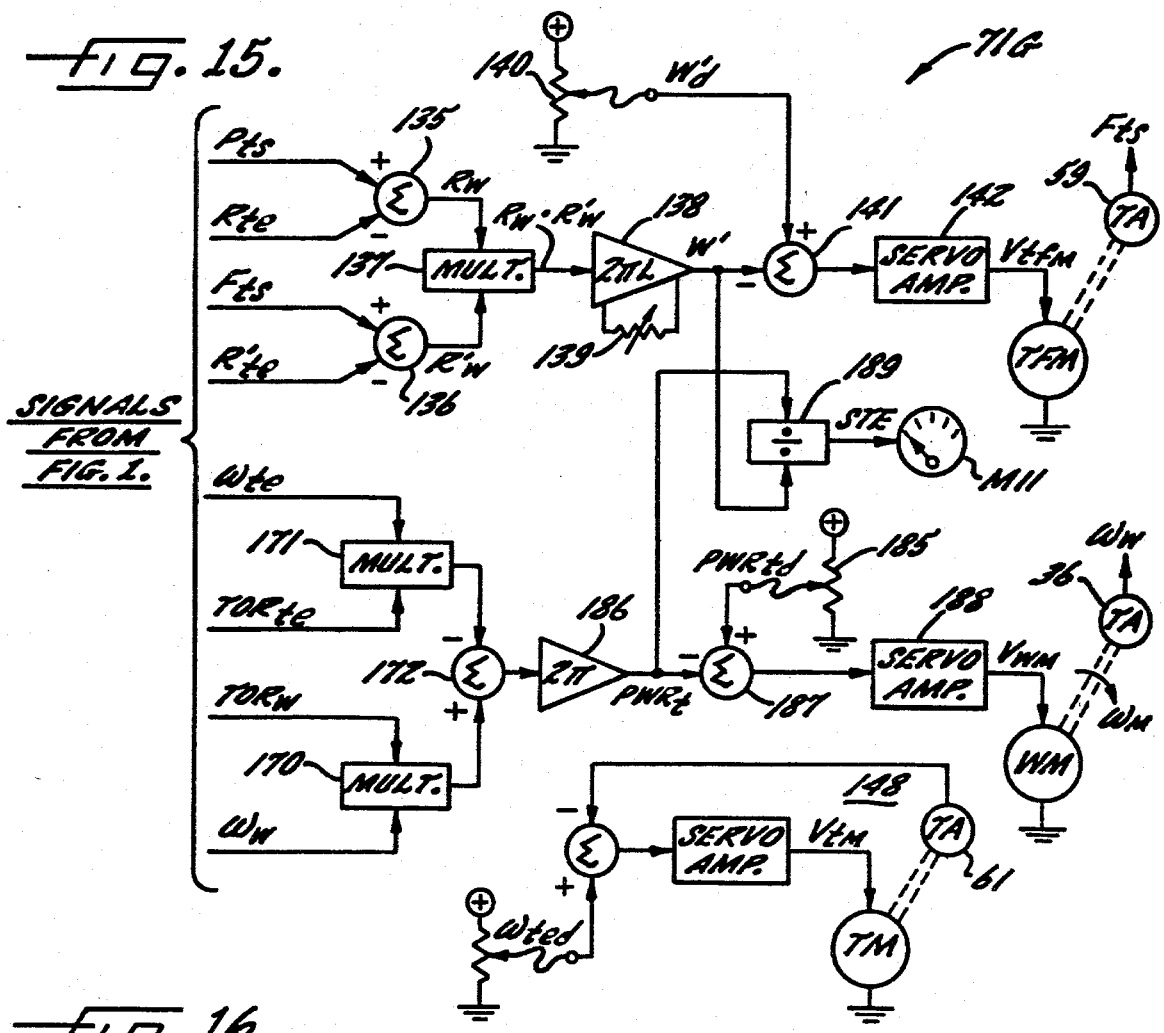
FIG. 15 is similar to FIGS. 13 and 14 but relates to still another specific embodiment of a control system for carrying out wheel truing in accordance with one aspect of the invention.

FIGS. 1, 8 and 15

It is not essential that the value of STE actually be computed and signaled in order to keep the STE ratio within a desired range or at a desired set point. An alternative form of control apparatus is shown in FIG. 15 (taken with FIGS. 1 and 8) to conform this. In the system 71G of FIG. 15, the wheel material removal rate W' is controlled to agree with a desired set point $W'_d$ by the components 135 to 142 which are identical in organization and operation to those components identified by the same reference characters in FIG. 12. In addition the total truing power $PWR_t$ is, in FIG. 15, controlled to agree with a set point $PWR_{td}$ selected by an operator who adjusts a potentiometer 185. For this purpose, two multipliers 170, 171 and a summing circuit 172 (organized and operating as previously explained relative to FIG. 14) produce a signal proportional to $(TOR_w \cdot \omega_w)-(TOR_{te} \cdot \omega_{te})$ fed through an amplifier 186 having a gain of $2\pi$. The amplifier output varies as $PWR_t$ (see Equation 22) and is fed in bucking relation to a summing circuit 187 to create an error signal applied to a PID servo amplifier 188 controlling the motor WM. The speed $\omega_w$ is thus automatically varied to keep $PWR_t$ substantially constant and equal to the set point $PWR_{td}$.

In FIG. 15, the motor TM is controlled by a closed loop servo circuit 148 to keep $\omega_{te}$ at some selected set point value $\omega_{ted}$ (in the same fashion previously shown by FIG. 12).

Since the apparatus of FIG. 15 keeps W' and $PWR_t$ constant at set point values, a human operator may know and determine the STE ratio simply by selecting those values and thus their ratio $PWR_t/W'$. The STE ratio need not be actually signaled. Merely as an optional convenience, FIG. 15 includes a divider circuit 189 receiving the signals $PWR_t$ and W' to energize a meter M11 which displays the numerical value of STE (see Equation 23) and aids an operator in setting the potentiometers 140, 185 so that an STE ratio of less than 0.5 (or some other value) is obtained. The amplifiers 138 and 186 are here shown for the sake of completeness with gains conforming to Equations (22) and (8). Such gains are not strictly necessary, however, if scaling factors are otherwise provided so that potentiometers 140 and 185 are calibrated respectively in (a) cubic inches per minute and (b) horsepower—or any other dimensional units which may be desired.

Methods Yielding Marked Economies and Advantages

While the controlling of STE so that it resides within a range of preselected values, or so that it is maintained substantially equal to a selected set point value, may be applied to effect rapid and efficient truing with the advantages heretofore noted when the ratio is kept below 0.5, and preferably at about 0.05 to 0.03, there are other advantages to be gained from controlling STE at different set points and in different ranges in a fashion to be made clear hereafter.

Thus far I have described two approaches for obtaining fast wheel truing while leaving the wheel sharp. One may keep the truing ratio TR above a value of 1.0 for Class I, or 10.0 for Class II, or keep $S_r$ below 3000 f.p.m. for Class III. One may accomplish these same results by controlling the ratio STE within a range or at a set point which is below 0.5 horsepower per cubic inch per minute. In all such procedures it is a startling fact that the wear on the operative face of the truing element will be quite small over a considerable time and as a considerable amount is trued off of the wheel (whether in time-spaced truing operations or one long one)—and even if the truing element is a grindable, substantially homogeneous material such as hardened M1 steel (as contrasted to a discrete particle material such as diamond chips set in a matrix).

My methods for truing with Class I or Class II materials thus include the procedure of forming a truing element of an homogeneous crystaline metal such as 1020 or M2 steel so that it has an operative surface which conforms to the desired shape of the wheel face to be trued. The truing element may be one of many materials which heretofore those skilled in the art would not have dreamed to be feasible. The truing element and its operative surface may be created in the first instance by machining the steel to approximately the desired size and shape, heat treating to harden it, and then hand finishing to exactly the desired shape. Alternatively, the final shaping of the operative surface may be performed by grinding with a wheel known to have almost perfectly the desired face shape, so the truing element operative surface ends up in the correct configuration. Merely as an example, if a grinding wheel of aluminum oxide grits is to be employed to grind workpieces of cast iron, the truing element is made of M2 steel and its operative surface is initially shaped by grinding the truing element with a second wheel of boron nitride grits having a face known to be accurately shaped. When the first wheel (of aluminum oxide) is later trued by rubbing contact with that M2 steel truing element, the truing operation will fall in Class II and the TR ratio will be held above 10.0 or the STE will be held below 0.5.

Another example: A wheel of silicon carbide grits is to be used in production grinding of M1 hardened steel parts. A truing element of M2 steel is formed by hand finishing the operative surface to have the desired shape. Thereafter, as production grinding of successive M1 steel parts proceeds, the wheel is periodically trued by rubbing contact with the M2 steel element, and with relative surface speeds and infeed rates conjointly controlled, for Class I, to give a ratio TR greater than 1.0 and preferably about 30 (or to provide an STE less than 0.5 and preferably about 0.3). If and when the truing element itself ceases to have a sufficiently accurate shape (possibly after 20 or 30 wheel truing operations) it is again restored by hand finishing.

Workpiece Substitution

These considerations have led me to a further subclass of my truing methods. I call it "workpiece substitution". In that procedure the truing element employed to restore the shape of a given grinding wheel is made of the same material as the workpieces which are to be ground by that wheel when the latter is employed in the production grinding of parts. And, indeed, the truing element itself may be a workpiece whose operative surface has been shaped earlier by grinding action of the wheel to be trued.

EXAMPLE I

More specifically, to carry out the "substitution" method (a) Obtain, in any suitable way, a first workpiece of a given material and shape—and which is identical to the desired finished shape of a second workpiece which has not yet been ground;

(b) Obtain a grinding wheel having a face which at least approximately, if not exactly, conforms to the desired shape of the work surface of a workpiece to be ground;

(c) Utilize the grinding wheel to grind the second workpiece; and (d) Prior to, during or at intermittent stages in the course of grinding the second workpiece, true the wheel by rotationally driving it and relatively feeding it into rubbing contact with the work surface of the first workpiece, the latter serving as a truing element, while conjointly establishing the relative surface speed $S_r$ and the relative infeed rate to make the truing ratio TR greater than 1.0.

In that method, it is likely that the wheel grits will be harder than the truing element (first workpiece) material because the wheel grits will be chosen for good grinding action on the second workpiece. The truing will probably (but need not inevitably) be Class I. It will be preferred, nevertheless, to make the truing ratio TR fall in the general range of 20 to 50. And, of course, this may also be accomplished by holding the STE ratio below 0.5 and preferably about 0.3 during the truing procedure (d).

EXAMPLE II

As a further version and example of my substitution method as applied to production grinding of a series of identical workpieces to a desired size and final shape, despite progressive deterioration in the shape of a given grinding wheel employed:

(a) Create, by any suitable procedure, a first of said workpieces with a work surface having the desired shape (its size is not important);

(b) Obtain a grinding wheel having a face which at least approximately, if not exactly, conforms to said desired final shape;

(c) Utilize said wheel to grind the second and successive ones of the workpieces to the desired final size and shape; and (d) From time-to-time during the course of procedure (c) (when the wheel face no longer sufficiently conforms to the desired shape) create relative rubbing and infeeding of the wheel face and the work surface of the first workpiece (which serves as a truing element) to true the wheel by (d1) Conjointly establishing the relative surface speed $S_r$ and infeed rate to make the truing ratio greater than 1.0 (and preferably much higher than 1.0).

In Example II, if the wheel face initially does not conform to the desired shape, a truing procedure (d) may of course be performed before grinding of the second workpiece begins. And, as indicated above, procedure (d) may be carried out by selecting a truing feed rate and controlling the STE ratio such that it is 0.5 or substantially less. It may be noted that in some specific applications, the truing procedure might be performed several times during the course of grinding each of the second and successive workpieces, or it might be performed once after each workpiece has been ground, or it might be performed once after each five to six workpieces have been ground. This all depends on how often the wheel face loses shape to the extent it is no longer acceptable and re-shaping by truing is desired.

As a variant of Example II, if the wheel to be used is known at the beginning to have precisely the desired face shape, then the creating of the first workpiece, according to procedure (a), may be accomplished by taking one of the workpiece blanks and grinding it with the wheel to create the proper shape on the operative surface of the workpiece which is subsequently used as a truing element.

Still further, if as a result of a considerable number of truing procedures, the operative surface of the first workpiece (that is, the truing element) tends to lose the desired shape, then one of the previously finished workpieces may be substituted as the truing element employed from that point forward. Such substitution may be made repeatedly; the method therefore perpetuates its own succession of truing elements as they wear out. Even if, in high quantity production of say, two thousand workpieces, fifty are pulled out and used as truing elements, the cost for the truing function becomes very low in relation to prior art methods.

In review, the methods and apparatus here disclosed permit the truing operation, which is vital in the grinding art, to be effected by the use of truing elements made of ordinary metals or steels and, indeed, of the same metals or steels which are in the workpieces to be ground. The economics of this, compared to special costly, wear resistant material truing elements which are difficult to produce with the desired shape (and especially in the case of form grinding) are self-evident.

This is not to say, however, that the present invention will not be without marked advantages even if one chooses to use truing elements of special wear-resistant materials. For example, in the truing of wheels having aluminum oxide grits, a truing element of the desired shape may be made of tungsten carbide or boron carbide. The time and cost of making such a truing element (especially for use in form grinding) may be high. But when employed in the fashion here taught, truing ratios of 2000 or 3000 are possibly to be obtained, and thus the cost of the element spread over its extremely long useful life becomes very reasonable.

In that sense, my invention may turn out to promote widespread use of diamond chip truing elements to an almost unbelievable advantage in the grinding industry. When operated at a relative surface speed $S_r$ below 3000 f.p.m. (a range not heretofore used or suggested, so far as I know) and preferably at about 300 or 400 f.p.m., a diamond chip truing roll will quickly reduce a wheel of almost any grit material (e.g., aluminum oxide or silicon carbide). The infeed rate may be as high as desired, subject only to the strength and stiffness of the grinding machine itself. Yet, the diamond truing roll will show almost no perceptible wear or loss of shape as it is used repeatedly to true wheels (even as successive wheels wear out) employed to grind thousands of workpieces. I have been unable to measure wear on a diamond truing roll which I have used at relative surface speeds of about 400 f.p.m. and with significantly high infeed rates (about 60 mils per minute); I estimate conservatively that the useful life of a diamond truing roll employed according to the present invention will be extended by a factor of at least twenty compared to prior art procedures. And therefore, in high volume industrial grinding of the future it seems likely that expensive diamond truing rolls may become extremely low in effective cost if employed in the manner here explained.

Determination of Sharpness

It is known in the art that a sharp wheel cuts fast in grinding of a workpiece; feed rates may be high, and power to produce the rubbing, abrading action is relatively low compared to a dull wheel. A sharp wheel generally has jagged corner grits exposed to bite through the workpiece. It is known that final surface finish when grinding ends with a sharp wheel is poor (microinches of roughness is high).

A dull wheel (where grits have been flattened) used for grinding cuts the workpiece material slowly. At a given, high wheel slide feed rate, the duller the wheel becomes, the greater the proportion of wheel-driving power which is converted to heat by friction (instead of creating workpiece removal). Thus, if a wheel is infed at a constant rate and relative surface speed at the work surface is kept approximately constant, as the wheel dulls due to attritious wear, the wheel driving motor WM takes more power, and heat at the interface may create "metalurgical burn" of the workpiece. If burn is avoided by a low feed rate, a dull wheel will, however, leave a smoother (less microinches or roughness) surface finish on the workpiece.

Generally stated, it is desirable to rough grind a part with a sharp wheel for faster removal of workpiece material, and to finish grind a part with a dull wheel for smoother final surface finish.

The grinding art has wrestled with the problems of truing (shaping) and sharpening (dressing) a wheel face without much attention to interrelations between the two. As an example, it is recognized in the literature that truing of a wheel with a diamond truing roll leaves the wheel face dull—and this is accepted as a burdensome fact of life, with those skilled in the art often truing (shaping) a wheel with a diamond roll and thereafter "dressing" it in a separate operation to sharpen the face. From the teachings in this application, however, it will now be understood that diamond roll truing (shaping) in the fashion set out above will leave the wheel face sharp. And the grinding art has tended to consider "dressing" of a wheel as "sharpening", recognizing that it may sometimes be desired purposely to produce dulling.

I have explained above methods for truing a wheel face which not only reduce the wheel radius fast, but also leave the wheel face sharp and produce little wear or shape deterioration of the operative surface on the truing element—even when the truing element is made of steel. In one aspect, that is accomplished by rubbing action at the interface such that the STE ratio is low (e.g., less than 0.5 HP/in.$^3$/min.). This results in the truing element producing very little attritious wear on the wheel grits, but the wheel is reduced in radius by grit fracture and bond fracture.

My work has resulted in a related and startling discovery. I am able to determine the degree of wheel sharpness which exists after or because of a "truing operation" by adjusting or setting the conditions under which the rubbing contact occurs. More particularly, I have discovered that there is an inverse, monotonic (but non-linear) relation between the STE ratio and the resulting condition or sharpness of the wheel.

Sharpness Degree Method A

In accordance with my invention in this aspect, a grinding wheel is restored to or maintained at a desired degree of sharpness by (a) rotating the wheel and relatively feeding its face into relative rubbing contact with the operative surface of a truing element, and (b) controlling such relative rubbing speed and feeding rate to make the STE ratio fall within a preselected range.

Implicit in the foregoing are the facts that in executing Method A (i) The STE ratio need not be precisely known, measured or computed so long as conditions are maintained which assure with reasonable confidence that, if measured, the STE ratio would fall within the preselected range, (ii) the STE ratio may be determined by single settings and open loop action so long as it is within the preselected range, or it may be held at a set point value (which is changeable) by closed loop action, (iii) the rubbing contact with the STE range may be created intermittently during time spaced intervals or continuously over a long time span, and with the preselected range changed or smoothly varied from one value to another at different points in time, (iv) the rubbing contact of the wheel and truing element (conditioning element) may take place while the wheel is or is not also in contact with a workpiece to be ground; and indeed it may be created in a machine separate and apart from the machine in which the wheel is used to grind workpieces, and (v) truing (shaping) of the wheel face may or may not be an objective or synergistic incidental benefit of the procedure which affects (increases, decreases or maintains) the desired degree of wheel sharpness.

Method A will generally be utilized by (1) making the preselected range for STE lower when a greater wheel sharpness is desired and (2) making the preselected range for STE higher when a duller wheel is desired. For example, if a wheel face has deteriorated in shape and needs truing, but the wheel is next to be employed in rough grinding a part, the preselected range for STE will be made low (e.g., 0.5 to 0.02 or even less). As explained above, the wheel will not only be "trued" but will also be made sharp—so that rough grinding of a workpiece may thereafter proceed at a high work removal rate M′ and without likelihood of metallurgical burn. But if a wheel is next to be employed for finish grinding of a workpiece to a smooth (low microinch) surface finish, the preselected range for STE will be made high (e.g., 3.0 to 7.0), the wheel thereby being left dull. Grinding of a workpiece thereafter will be carried out at a finishing feed rate and the workpiece surface finish will have low microinch roughness (a high degree of smoothness).

Sharpness Degree Method B

Method A embraces but may be re-expressed as a narrower Method B for rough grinding and finishing grinding a workpiece with a single grinding wheel by (a) establishing relative rubbing and infeeding of a wheel face and truing element operative surface such that the STE ratio falls within a first predetermined range, (b) subsequent to procedure (a), establishing a relative rubbing and infeeding such that the STE ratio falls within a second predetermined range, said second range being higher than the first, (c) feeding the wheel face relatively into rubbing contact with the workpiece to grind the latter, such grinding being carried out either during or after performance of said procedure (a) and during or after performance of said procedure (b).

The performance of the grinding procedure (c) subsequent to procedure (a) is best suited to rapid rough grinding. Performance of the grinding procedure (c) subsequent to procedure (b) is best suited to finish grinding to yield a good (smooth) surface finish. Indeed, it is preferable that the feed rate for grinding which follows procedure (a) be higher than the grinding feed rate which follows procedure (b). If truing contact is not created while grinding of the workpiece is taking place, the sequence of the three procedures, with respect to a single workpiece will ordinarily be (a), (c), (b), (c)—thereby to produce one rough grind and one finish grind stage. If the workpiece is one on which a great deal of rough grinding must be performed (during which the wheel for any reason loses shape or sharpness) then the sequence of procedures might preferably be (a), (c), (a), (c), (a)(c), (b)(c).

The same apparatus and truing element may be used to carry out procedures (a) and (b); to change from one to the other requires only resetting the value of $\omega_w$, $\omega_{te}$ or $F_{ts}$. As explained previously, with reference to FIG. 8, if $\omega_w$ is increased, STE will be increased; and if $F_{ts}$ or $\omega_{te}$ is increased, STE will be decreased.

For reasons and with added advantages to be explained more fully below, the procedure (c) may wholly or partly overlap in time the procedures (a) and (b). Thus

[i] Procedure (c) may be performed continuously over a span of time and procedures (a) and (b) performed during relatively earlier and later portions of that time span.

[ii] Procedure (c) may be performed continuously over a span of time, procedure (a) is performed substantially continuously over a first portion of the span, and procedure (b) is carried out substantially continuously during a later portion of the span which immediately follows the first portion.

[iii] The timing of [i] but with procedure (a) carried out intermittently during time spaced intervals within the earlier portion of the time span.

[iv] The timing of [i], [ii] or [iii] and wherein procedure (c) is carried out with first and second grinding feed rates during the earlier and later portions of the time span, the first feed rate being greater than the second.

Of course, in all of these methods for determining wheel sharpness, the truing element may be one falling in Class I, II or III with respect to the material of the grinding wheel. The truing element may be a substituted workpiece. And with respect to procedure (a), the first STE range of values may or may not be chosen to give TR ratios of greater than 1.0 for Class I, greater than 10.0 for Class II or a relative surface speed of less than 3000 f.p.m. for Class III. If so, then rapid truing and high wheel sharpness will be obtained, but it may not be desired in all situations to produce such a high degree of sharpness.

Typical Apparatus for Executing the Sharpness Degree Methods A or B

FIGS. 1, 8 and 13 depict exemplary apparatus which may be employed to carry out Method A in a broad sense and with STE controlled to fall within a preselected range. As noted earlier, FIG. 8 shows the wheel 20 and truing element 50 in rubbing contact, the relative surface speed $S_r$ being determined by the set points $\omega_{wd}$ and $\omega_{ted}$ chosen by setting or adjusting the potentiometers 151 and 159. The relative infeed rate is chosen by setting or adjusting potentiometer 158 to determine the feed set point $F_{tsd}$. Given the fact that the radii of the wheel 20 and element 50 have certain values, the truing action will occur with some STE value which is expressed by Equation (23) but which will not necessarily be accurately known by the operator. If the human operator makes several measurements and computes STE for different values of $\omega_w$, $\omega_{te}$ and $F_{ts1}$ he may by experience acquire a sufficient "feel" so that he can make set point adjustments to create an STE falling within a preselected range which he desires.

The optional meters M8, M9, M10 and associated components may assist the operator in making STE fall within a desired preselected range. To an approximation, as noted earlier, the meter M8 indicates truing power $PWR_t$ by displaying wheel power $PWR_w$ and neglecting the relatively smaller truing element power $PWR_{te}$ (compare Equations 23 and 24). To an approximation, the meter M9 indicates volumetric wheel removal rate W'. Thus, the reading on meter M10 indicates to an operator at least a reasonable approximation of the STE value.

In carrying out Method A, therefore, the operator need only manually adjust $\omega_{wd}$, $\omega_{ted}$ or $F_{tsd}$ until he obtains a reading on meter M10 in the mid-region of the preselected STE range which he desires. Increasing $\omega_{wd}$ will increase STE; decreasing $\omega_{te}$ or $F_{ts}$ will increase STE. If the operator desires to make the wheel sharp, he makes adjustments which result in a low STE initial reading; if he desires to make the wheel dull, he makes adjustments which result in a higher initial STE reading. Thereafter, changing conditions may cause the STE reading to vary from the initial value but this is tolerable so long as the reading stays within the preselected range. And if STE should depart from that range the operator may bring it back into the range by readjusting one or more of the potentiometers 151, 158, 159.

To carry out Method B in one specific form with the apparatus of FIGS. 1, 8 and 13, after an unground workpiece has been placed in the machine (FIG. 1) with clearance from the wheel 20, the truing element 50 may be brought into contact with the wheel (FIG. 8) and then adjustments made in FIG. 13 so that a low STE reading (on the order of 0.10) is obtained, and such that STE will vary over a preselected range of, say, 0.12 to 0.08. The wheel will be trued and left relatively sharp. Then the element 50 is backed away from the wheel 20 (FIG. 1) and the wheel moved into grinding contact with the workpiece 24 to rough grind the latter at a relatively high wheel slide feed rate $F_{ws}$ chosen by open or closed loop setting of the voltage $V_{wfm}$. After the part has been reduced to a certain radius (indicated by the voltage $P_{ps}$) the operator may manually control the motor WFM to back the wheel free of the part 24, and may manually control the motor TFM to move the element 50 again into rubbing contact with the wheel (as shown in FIG. 8). The operator might then adjust the potentiometers of FIG. 13 to obtain a low STE reading—solely to restore the wheel face shape by rapid truing—inasmuch as the wheel may have lost form during the rough grinding. Then, however, the operator will adjust the potentiometers of FIG. 13 to obtain a much higher STE reading on meter M8 (say, about 7.0) and such that the STE value will thereafter vary within a preselected range (say, 9.0 to 5.0). This will not rapidly reduce the wheel radius but it will dull the wheel face grits so that they are conditioned to create a fine (low microinch) surface finish on the part. Next, the operator backs the element 50 clear of the wheel 20 and advances the wheel slide until the wheel again makes grinding contact with the part 24 (FIG. 1). The voltage $V_{wfm}$ is manually adjusted to create a relatively low feed rate $F_{ws}$, so that finish grinding occurs. When the part has reached the desired final radius, the wheel slide is retracted and the finished part is removed from the machine. That finished part will have a fine surface finish due to final grinding with a dull wheel, the surface fineness being directly and monotonically related to the STE range preselected for the last truing or conditioning procedure.

Of course, many variations of the last-described example may be practiced within the scope of Methods A and B. A truing procedure may be carried out several times over the course of rough grinding, and the sharpness left at the wheel face after each procedure may be less if one chooses a higher STE range for each successive procedure. And, as will become apparent below, it is not necessary that the grinding action on the workpiece be interrupted each time the truing element is brought into contact with the wheel.

FIGS. 1, 8 and 14 may be utilized to carry out Methods A and B in a different specific fashion. When a fresh workpiece is placed in the machine, a truing procedure is conducted by locating the wheel and element as shown in FIG. 8; the potentiometers 158 and 159 in FIG. 14 are set to produce desired values of $F_{ts}$ and $\omega_{te}$; and the potentiometer 182 is set to call for a relatively low set point $STE_d$ (say, 0.07). Now, as already explained, wheel speed $\omega_w$ will automatically change to keep STE equal to the set point $STE_d$ (and therefore within a very narrow preselected range of values). The wheel will be trued and left sharp. Next, the truing element is backed away from the wheel and the wheel is advanced into contact with the part 24 (FIG. 1) so grinding at a rough grind feed rate occurs. Thereafter, the wheel is backed free of the part 24 and the element 50 moved into wheel contact (FIG. 8). Now, however, the potentiometer 182 is adjusted to call for a set point $STE_d$ which is higher (say, 8.0) than before. The wheel will now be "trued" in the sense that its face will be conditioned to dull (the greater the set point $STE_d$, the duller the wheel will be made). Then, the element will be backed away from the wheel and the latter brought into contact with the part 24 with a finish grind feed rate. When finish grinding is completed the part will have a surface finish which in fineness (smoothness) has been determined by the set point value of $STE_d$ chosen for the second conditioning procedure.

Again, the apparatus of FIGS. 1, 8 and 14 may be used to carry out methods having many variations of the last-described example, and all within the broad definition of Method A and/or B. Merely as an example, the control circuitry of FIG. 14 may be supplemented such that the first truing procedure is terminated automatically after a certain time duration or a certain reduction in wheel radius, with the rough grinding then initiated automatically. The rough grinding may be terminated when the part 24 is reduced to a predetermined first radius and the voltage $P_{ps}$ has fallen to a corresponding value, whereupon the second "truing" procedure is automatically initiated with automatic switching of the set point signal to a second higher value. The second "truing" procedure may then be terminated automatically after a certain time lapse, and finish grinding initiated automatically with switching of the motor WFM to produce a low wheel feed rate. And the finish grinding may be ended automatically when the signal $P_{ps}$ falls to a predetermined value generally related to final part radius. These sorts of automatic sequence controls are optional and within the skill of those working in the art.

Pre-Establishing After-Grind Workpiece Surface Smoothness

It may be noted here that Methods A and B permit direct selection of the surface finish which a given grinding wheel will produce on a workpiece if the latter is ground a small amount immediately after a "truing" operation. I have ascertained from test data that STE varies as a non-linear, inverse monotonic function of wheel removal rate W', as illustrated by curve 200 in FIG. 16. That curve represents in a general way, for a wheel and a truing element of given respective materials, the relationship of STE and W', assuming that relative surface speed $S_r$ is held constant at a given value $S_{r1}$ and $F_{ts}$ is varied to create changes in W'. The curve 200 represents a family of curves each one corresponding to a different constant relative surface speed $S_r$. For example, curve 200*a* corresponds to a surface speed $S_{r2}$ which is less than the $S_{r1}$ applicable to curve 200; and this confirms that as surface speed decreases but W' remains constant, STE decreases in a monotonic fashion.

With respect to curve 200, STE values are to be read as ordinates on the left scale 201.

Surface finish smoothness (here called SM) is here defined as the opposite of roughness because the higher the degree of smoothness (and the lower the microinches of roughness) the higher the quality of a ground part. One cannot predict the after-grind smoothness of a workpiece surface which will be produced by a given wheel on a given part ground with a wheel just after the wheel face has been trued or conditioned at a given removal rate W'. The reason is that the sharpness of the wheel grits left after contact with a truing element depends on both the removal rate W' and the relative rubbing speed $S_r$, the latter being unknown. If speed $S_r$ is known, but W' of the "truing" contact is not known, the wheel face sharpness, and thus part smoothness which will result from the next use of the wheel, cannot be predicted.

I have found that STE reflects both relative surface speed and wheel wear rate and that I can tie the after-grind surface finish, produced on a part by a given wheel, to the STE with which the wheel was "trued" (by a given truing element) just prior to the grinding. I am thus able to plot a curve 202 in FIG. 16 to indicate the value SM on a scale 204 at the right versus the value of STE (on the scale 20 at the left). The curve 202 is very nearly but not necessarily linear as shown; it indicates in any event that after-grind smoothness SM decreases monotonically with reduction of the STE ratio.

Figure 16:
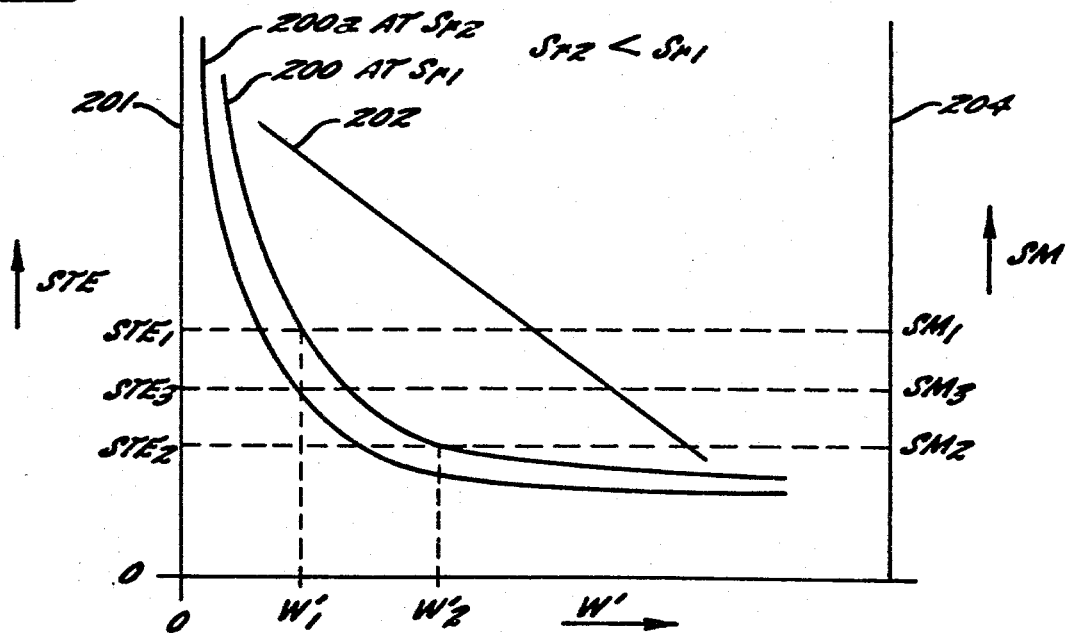
FIG. 16 is a generalized graphical representation of the relationships between grinding wheel material removal rate and the STE ratio, as well as the general relationship between STE and the resulting smoothness of workpiece surface finish obtained by grinding with the wheel after the wheel has been trued at various STE ratios.

Thus, in FIG. 16 if curve 200 is applicable because truing is carried out at a surface speed $S_r$ of $S_{r1}$, and if the rate W' is $W'_1$, the STE value will be $STE_1$ and the after-grind smoothness will have a corresponding value $SM_1$. If now the truing procedure is carried out at a higher removal rate $W'_2$, the STE value of that procedure will be lower at $STE_2$ and the smoothness SM will have a lower value $SM_2$. On the other hand, if the truing procedure is conducted with the original rate $W'_1$, but the surface speed and power is reduced to $S_{r2}$, curve 200*a* becomes applicable. The result is that STE falls from $STE_1$ to $STE_3$ and the after-grind smoothness SM falls from $SM_1$ to $SM_3$.

I am thus able to reveal a method of forecasting and actually establishing (within limits, of course, for a grinding wheel, workpiece and truing element of given materials) the after-grind surface smoothness created on a workpiece ground briefly and immediately after that wheel has been "conditioned" by truing. The method comprises "truing" the wheel with a selected STE value (by using the methods and apparatus of FIG. 14 or FIG. 15, for example) and thereafter finish grinding the workpiece; and in making the STE value so selected higher or lower when the smoothness SM is to be made higher or lower. The two values, STE and SM, will monotonically correlate and for any given wheel material, truing element material and workpiece material. There are some constraints to be observed if such correlation is relied upon to obtain reproduceable results. After a wheel has been conditioned at a given STE ratio (and the conditioning action is terminated), the very act of grinding a workpiece may change the wheel sharpness, usually making it duller. The degree of further dulling is dependent upon the finish grinding feed rate, relative surface speed and time duration of the finish grinding procedure—and the finish surface finish SM depends upon the wheel dullness just prior to the termination of finish grinding. Therefore, the correlation of after-grind work surface smoothness SM to the STE of a previous wheel conditioning procedure has best precision when the finish grinding is conducted for only a very short time interval and at grinding speeds and feeds which do not tend to change the wheel sharpness. Subject to such constraints, if data are taken with a wheel, workpiece and truing element of given materials by conditioning procedures at several STE values, each procedure being followed by finish grinding at a given grinding feed rate and relative speed for the same given time interval after which surface smoothness SM is measured and logged in a table of SM v. STE—then that table may be used in later predeterminations of SM to be obtained on subsequent workpieces of the same material. The finish grinding on such subsequent workpieces should be conducted at the same grinding feeds and speed, and for the same time intervals, as were used in logging the data.

The after-grind surface smoothness SM is more directly predeterminable, and not subject to the cautions or restraints here noted, if the wheel is conditioned by a truing element which acts simultaneously on the wheel during intervals when finish grinding takes place, as described later in the present specification.

Truing or Wheel Conditioning While Grinding With STE Control

As seen from the foregoing, by keeping the STE ratio within a predetermined range or at a predetermined value, I am able not only to keep the wheel face in a desired shape but also to establish its degree of sharpness, and, if desired, the smoothness of the work surface left after a workpiece is ground by the wheel. In accordance with another aspect of the present invention, I am able to obtain these results while the physical grinding of a workpiece is in progress and thereby to save time and increase economy and productivity. Truing or dressing of a grinding wheel simultaneously with grinding of a workpiece has been broadly practiced in the prior art, but it has not been suggested that this be carried out while controlling the STE ratio so as to determine, with quantitative predictability, the wheel face condition and the consequences of that condition on the workpiece.

For simultaneous truing (wheel conditioning) and grinding, the wheel 20 and workpiece 24 are in rubbing, grinding contact while the wheel 20 and element 50 are also in rubbing contact, as shown diagrammatically in FIG. 17. The latter figure is thus merely a specific repetition of FIG. 1 illustrating that the truing slide TS has been moved inwardly (left) to contact the wheel face while the wheel is grinding on the workpiece. The part 24, wheel 20 and element 50 are all rotating (the first two being driven and the latter being braked) by their respective motors PM, WM, TM; the wheel slide WS is being fed (left) toward the work at a rate $F_{ws}$ and the truing slide TS is being fed (left) toward the wheel at a rate $F_{te}$, so that both the grinding and truing involve relative rubbing contact and relative infeeding.

For the exemplary method embodiments next to be described, the apparatus does not require (in FIG. 17) the truing element probe 65 which appears in FIG. 1 and thus some economies are achieved, as in FIG. 8 where the work probe 40 is not required. This is not to say that a truing element probe may not be used in other specific forms of the apparatus.

From inspection of FIGS. 1 and 17, the following relations may be expressed:

$$R_p = P_{ps} \tag{25}$$

$$R'_p = F_{ps} \tag{26}$$

$$R_w = P_{ws} - R_p = P_{ws} - P_{ps} \tag{27}$$

$$R'_w = F_{ws} - R'_p = F_{ws} - F_{ps} \tag{28}$$

$$R_{te} = P_{ts} - R_w = P_{ts} - P_{ws} + P_{ps} \tag{29}$$

$$R'_{te} = F_{ts} - R'_w = F_{ts} - F_{ws} + F_{ps} \tag{30}$$

In the arrangement of FIGS. 1 and 17 it is possible to determine the total power $PWR_w$ applied to the wheel 20 by the motor WM according to Equation (18). In FIG. 17, unlike FIG. 8, a portion of the total wheel driving power $PWR_w$ is taken up at the grinding region between the wheel 20 and workpiece 24, and another portion is expended at the truing region between the wheel and the element 50. In FIG. 17, unlike FIG. 8, the signals $TOR_w$ and $\omega_w$ cannot be used to determine the power (here called $PWR_{wt}$) applied by the motor WM to the truing interface. But one may note that at the truing interface the tangential force $FOR_1$ which is transferred from the wheel face to the truing element operative surface is equal and opposite (absent acceleration effects) to the tangential force $FOR_2$ which, in effect, is applied to the truing element by the motor TM acting as a brake. Since the torque $TOR_{te}$ is signaled by the transducer 60 (FIG. 1) and the radii $R_w$ and $R_{te}$ are ascertainable from Equations (27) and (29), it is possible to express the torque $TOR_{wt}$ which is being applied by the motor WM via the wheel to the truing interface even though a portion of that motor's total torque is applied to the grinding interface. Thus, it may be written:

$$FOR_1 = FOR_2 \tag{31}$$

$$FOR_1 \cdot R_w = TOR_{wt} \tag{32}$$

$$FOR_2 \cdot R_{te} = TOR_{te} \tag{33}$$

Combining (31) to (33 ) yields $$TOR_{wt} = TOR_{te} \cdot \frac{R_w}{R_{te}} \tag{34}$$

Now, the total power $PWR_{wt}$ applied by the motor WM via the wheel into the truing interface may be written $$PWR_{wt} = 2\pi \cdot TOR_{wt} \cdot \omega_w \tag{35}$$

and by substitution from (34)

$$PWR_{wt} = 2\pi \cdot TOR_{te} \cdot \frac{R_w}{R_{te}} \cdot \omega_w \tag{36}$$

Further, the power expended as work and friction-generated heat due to the rubbing contact at the truing interface is the input power less that removed to the motor TM acting as a brake, as explained previously. Thus, by analogy to Equation (21), but as applicable to FIG. 17 taken with FIG. 1, one must write $$PWR_t = PWR_{wt} - PWR_{te} \tag{37}$$

Substituting from Equations (36) and (19), Equation (37) becomes $$PWR_t = 2\pi \cdot TOR_{te}\left[\omega_w \frac{R_w}{R_{te}} - \omega_{te}\right] \tag{38}$$

To determine the STE ratio produced under various circumstances, it is to be recalled:

$$STE = \frac{PWR_t}{W'} \tag{17}$$

And the removal rate W' may be determined in the FIG. 17 apparatus in a slightly different fashion from that of FIGS. 8 and 14. Recalling that $$W' = 2\pi L \cdot R_w \cdot R_w' \tag{8}$$

and putting (8) and (38) into (17) results in:

$$STE = \frac{PWR_t}{W'} = \frac{TOR_{te}\left[\omega_w \frac{R_w}{R_{te}} - \omega_{te}\right]}{L \cdot R_w \cdot R'_w} \tag{39}$$

If $R_w$, $R_{te}$ and $R'_w$ from (27), (29) and (28) are substituted, the expression, applicable to FIG. 17, becomes $$STE = \frac{PWR_t}{W'} = \frac{TOR_{te}\left[\frac{\omega_w (P_{ws} - P_{ps})}{(P_{ts} - P_{ws} + P_{ps})} - \omega_{te}\right]}{L (P_{ws} - P_{ps}) (F_{ws} - F_{ps})} \tag{40}$$

In carrying out the method of wheel conditioning while grinding, a control system 71H as shown in FIG. 18, taken with FIGS. 1 and 17, may be employed. It is assumed that the wheel is in rubbing contact with both the workpiece 24 and the element 50, with the slide WS feeding toward the left relative to the machine base and the slide TS feeding toward the left relative to the slide WS. To create these relative motions, three closed loop PID servo circuits 220, 221, 222 control the motors PM, WM and TFM in order to maintain the variables $\omega_p$, $\omega_w$ and $F_{ts}$ in close agreement with set point values $\omega_{pd}$, $\omega_{wd}$ and $F_{tsd}$ obtained, for example, by adjusting potentiometers 223, 224, 225.

In addition, the wheel slide feed rate $F_{ws}$ is controlled such that the radius reduction rate $R'_p$ of the part 24 (also here called the grind rate GR) is maintained at a desired value. It will be recalled that the probe slide servo causes the clearance CL to be kept constant as the radius $R_p$ reduces, so the feed rate $F_{ps}$ at which the probe slide moves to the right is equal to the grind rate or radius reduction rate $R'_p$ of the workpiece (and the signal $P_{ps}$ equals the radius $R_p$). Thus, in FIG. 18 a desired probe slide feed rate $F_{psd}$ is signaled by adjusting a potentiometer 230. That signal is bucked in a summing circuit 231 to create an error signal $ERR_{10}$ applied to a PID servo amplifier 232 which energizes the wheel feed motor WFM. In consequence if the actual part radius reduction reate $R'_p$ (which is equal to $F_{ps}$) increases or decreases above or below the desired value $F_{psd}$, the motor WFM decreases or increases the wheel slide feed rate $F_{ws}$. Therefore, despite any wheel radius wear rate $R'_w$ that may occur, the part radius reduction rate $R'_p$ is maintained at a desired value.

In review, FIG. 18 shows apparatus by which values of $\omega_p$, $\omega_{w1}$, $F_{ts}$ and $R'_p$ (that is, $F_{ps}$) are selected and then maintained, with $F_{ws}$ taking on whatever value is necessary.

Further in FIG. 18 (taken with FIGS. 1 and 17), provision is made to automatically vary the truing element speed 107 $_{te}$ so as to keep the actual STE ratio within a predetermined range or in agreement with a predetermined set point $STE_d$. The set point version is here shown only because it is the more rigorous; those skilled in the art will understand how to "degrade" the apparatus of FIG. 18 if only a loose control of STE within a certain range is deemed sufficient in particular circumstances. As illustrated, the signals $P_{ws}$ and $P_{ps}$ are applied to a summing circuit 235 whose output signal is $R_w$ (see Equation 27). The latter signal is sent to a summing circuit 236 and bucked with the signal $P_{ts}$ to produce a signal $R_{te}$ (see Equation 29). The signals $R_w$ and $R_{te}$ are divided in a circuit 238 whose output $R_w/R_{te}$ corresponds to the fraction in the numerator of Equation (39). That signal is, in turn, applied to a multiplier 239 along with the signal $\omega_w$ and the resultant signal is fed to a summing circuit 240 along with the signal $\omega_{te}$ taken subtractively. The output from 240 thus varies as the bracketed expression in Equation (39); and it is multiplied by $TOR_{te}$ a circuit 241 to produce a product signal varying as the numerator of Equation (39).

To produce a signal varying in proportion to W' and corresponding to the denominator of Equation (39), the signals $F_{ws}$ and $F_{ps}$ are bucked in a summing circuit 244, the difference signal $R'_w$ being applied with the signal $R_w$ (from 235) to a multiplier 245 whose output is further multiplied by an amplifier 246 adjusted (by a rheostat 247) to have a gain of L. The output from 246 is fed to a divider circuit 249 which receives the product signal from 241. The output from 249 is thus a signal which varies as the actual STE according to Equation (39), assuming that all wheel material is being removed from the wheel face by action of the element 50.

The desired value $STE_d$ is signaled by adjusting a potentiometer 250. That is bucked with the signal STE in a summing circuit 251 to send an error signal to the input of a PID amplifier 252 which energizes the motor TM. Thus, if the STE value rises above the set point $STE_d$, the motor voltage $V_{tm}$ is increased, the armature and braking torque of the motor TM decrease, the speed $\omega_{te}$ increases and the value of STE is reduced (see Equation 39) until STE restores to equality with $STE_d$. When this occurs, the relative surface speed $S_r$ at the truing interface decreases (see Equation 3) so that the wheel grits fracture more easily, the wheel becomes sharper, and the truing power $PWR_t$ decreases, thereby to restore the STE ratio to the set point value.

In the operation of the apparatus of FIGS. 17 and 18, the wheel radius $R_w$ will reduce at a rate $R'_w$ in part due to wheel wear at the grinding interface and in part due to wheel wear at the truing interface. It has been assumed above that the former effect is so small in relation to the latter effect that sufficient accuracy is achieved by treating all of the wheel material removal rate as occurring at the truing interface. This approximation is tolerable because wheel radius reduction rate due to grinding will almost always be much less than that due to truing. But if the former effect is greater than the latter effect—and because the truing infeed rate $F_{ts}$ in this embodiment maintained constant—then the wheel face might retreat from rubbing contact with the element 50. Thus, one should choose a truing slide rate $F_{tsd}$ (at potentiometer 225) comfortably greater than the wheel radius reduction rate which will occur due to grinding action, and then the servo action by amplifier 232 on the motor WFM will adjust the wheel slide feed rate $F_{ws}$ to maintain grinding contact and part radius reduction $R'_p$ at the desired grind rate GR. Alternatively, control components may be added to automatically adjust the truing infeed rate $F_{ts}$ if the error signal from circuit 251 becomes excessively negative indicating that STE has fallen to an extent that changes in $\omega_{te}$ will not restore STE to agreement with the set point $STE_d$. As still another alternative, the truing element speed $\omega_{te}$ may be maintained constant at a set point value (by a servo circuit similar to but replacing the circuit 222 in FIG. 18), and the STE error from the summing circuit 251 (FIG. 18) applied to correctively energize the motor TFM. In that way, and as an incident to keeping STE at the set point $STE_d$, the truing element will always be infed sufficiently fast to maintain rubbing contact with the wheel face regardless of the wheel radius reduction rate caused by the grinding action.

In the use of the method and apparatus shown by FIGS. 1, 17 and 18, once grinding and simultaneous truing have been started, if the set point signal $STE_d$ is made low (say, equivalent to 0.8 HP/in.$^3$/min. or less) then the wheel face will be maintained sharp and true in shape over a long interval of rough grinding at a relatively high grind rate GR. But the set point signal $STE_d$ may be readjusted, either manually or automatically, from time to time so as to change the sharpness of the wheel face. In accordance with the "sharpness degree" method described above, such set point changing may involve a smooth, gradual (or a step) change from an initially low $STE_d$ value or range to a higher one (accompanied preferably by a reduction in the grind rate GR on potentiometer 230) so that the wheel is dulled and finish grinding leaves the work surface with a desired smoothness. That is, for rough grinding, $STE_d$ is initially set to $STE_1$ and the grind rate $GR=R'_p$ is initially set to $R'_{p1}$; and for subsequent finish grinding, these settings are changed to $STE_2$ and $R'_{p2}$, where $STE_2>STE_1$ and $R'_{p2}<R'_{p1}$.

Of course, it is not essential to the method that the element 50 contact the wheel 20 during the entire span of time in which the wheel is grinding on a given workpiece. There may be some applications in which, as grinding of the workpiece is continued, the element 50 is, in effect, withdrawn from wheel contact and then restored to contact. This might be desirable if grinding is controlled according to the SGE method taught in my above-identified prior patents so that wheel sharpness is maintained automatically; but in such cases the wheel will lose shape, and the element 50 may be brought into contact to produce re-shaping according to the above-described STE approach (with low wear on the truing element) as spaced time intervals. In such cases it may be advantageous to make the truing element of a common hard steel as its material, or of the same material as that in the workpieces being ground, but the material chosen for the truing element is not critical to a realization of benefits from the method here described with reference to FIGS. 1, 17 and 18.

Certainly, it will now be understood that the "STE control" method, as set out above, may in part include truing or conditioning a wheel with controlled STE at least during some time intervals when the wheel is actively grinding a workpiece.

Finally, it is to be noted that specific control apparatus other than that exemplified in FIG. 18 may be utilized to keep STE in a predetermined range or at a set point value. Apparatus and steps by which $\omega_w$ or $F_{te}$ are correctively adjusted (rather than $\omega_{te}$) may be used; and approximations which ignore certain variables or assume them to be constant may be adopted without departing from the novel method. For example, as explained previously, the radii $R_w$ and $R_{te}$ may be initially measured manually and assumed to be constant over a long time span, since significant radius reduction rates $R'_w$ and $R'_{te}$ will still not produce great percentage changes in $R_w$ and $R_{te}$.

Intermittent Wheel Conditioning While Grinding

The generic method of controlling the STE ratio of truing (conditioning) action while grinding of a workpiece is on-going includes intermittently producing the truing action. But I have discovered that intermittent truing steps can lag behind those points in time when they are desired, unless some special provisions are made. Accordingly, I have conceived a method for intermittently truing a wheel, with control of STE, by which the truing element surface is caused to "follow with a gap" (and usually a small gap) the wheel face, but is moved into truing contact at spaced instants in time. The spacing of those instants in time may be determined (i) merely at equal time spacings, (ii) when wheel radius reduction of a certain amount has occurred, or (iii) when loss of wheel face shape is detected by appropriate sensors.

In general, FIGS. 1 and 17 will be helpful to an understanding of the "intermittent truing by following with a gap" method and apparatus, but FIGS. 19, 20 and 21 will be of further aid. In the exemplary embodiment to be described, the wheel 20 is first brought by manual control into kissing contact with the workpiece and the truing element 50 brought into kissing contact with the wheel (FIG. 19). The feeds $F_{ts}$ and $F_{ws}$ are at this instant zero, but it is possible now to determine the element radius $R_{te}$ and store it. Next, the apparatus may be initiated into automatic sequencing by which (i) the workpiece is continuously ground at a grind rate GR, and (ii) the slide TS is controlled in its feeding such that a predetermined small gap GAP (FIG. 20) is maintained between it and the workpiece—even as the wheel radius $R_w$ reduces due to wheel wear. When truing of the wheel is required or desired and a "start truing procedure" signal STP is generated (in any of several ways to be described), the truing slide is moved rapidly inward (left) to make the element "kiss" the wheel again (FIG. 19), and then is further fed inwardly to true off the wheel by a predetermined increment, i.e., to reduce the wheel radius by an amount INC (compare FIGS. 19 and 21)—and while the wheel continues grinding action at the workpiece. This truing occurs with the STE controlled to be within a predetermined range or at a desired set point value, so wheel sharpness as well as shape may be predetermined. But after the increment INC has been removed from the wheel radius, the truing slide is again controlled to make the element 50 follow the wheel face with a gap (FIG. 20), while grinding continues, until the next "start truing" signal STP is created, whereupon the sequence or cycle is started again. Several of these intermittent truing cycles may be executed automatically during the total span of time over which a workpiece is being continuously ground and during which the wheel face otherwise would seriously deteriorate from the desired shape.

Turning next to FIGS. 22A, 22B, a system 71I for carrying out this method includes servo circuits 220, 221 (identical to those in FIG. 18) for controlling the workpiece and wheel rotational speeds $\omega_p$ and $\omega_w$ at selected set point values. Also, the wheel slide feed rate $F_{ws}$ is controlled by components 230, 231, 232, WFM to produce a desired grind rate GR (as described above with reference to FIG. 18) when the arm $SS_a$ of a multiple pole, double-throw selector switch SS is in its lower "run" position.

If the switch arm $SS_a$ is in its upper or "set up" position, the wheel slide may be moved to different positions by motion in a direction and at a rate manually determined by adjusting a potentiometer 280. The potentiometer 280 is grounded at the center and connected between positive and negative voltage sources so that a set up voltage $F_{wss}$ can be either positive or negative to make the slide WS move left or right (FIG. 1 or 17). It is here assumed that motor WFM drives the wheel slide WS to the right when the voltage $V_{wfm}$ is positive, and vice versa. The signal $F_{wss}$ is applied to a summing circuit 281 with the feedback signal $F_{ws}$ so that with arm $SS_a$ in the position shown the slide moves in a selected direction at a selected rate.

For controlling STE during those intervals when truing action takes place, the components 235 through 252 (FIG. 22A) are identical to, and operate in the same way, as the correspondingly identified components appearing in FIG. 18, described above. There is added, in FIG. 22A, an analog gate 282 through which the STE error signal passes to the servo amplifier 252 whenever that gate is enabled by a signal Q2 (described below) at a logic high level. In that case, a second gate 283 controlled by the complement signal $\overline{Q2}$ produced by an inverter 284 is disabled and the STE control apparatus of FIG. 22A operates in the same fashion already described with reference to FIG. 18,—the motor TM acting as a brake to adjust $\omega_{te}$ as necessary to keep STE equal to $STE_d$. When the signal Q2 is low, however, the gates 282 and 283 are respectively disabled and enabled, and thus the motor TM is controlled to drive the truing element in a clockwise direction at a "standby" speed in agreement with a standby set point signal $\omega_{teds}$ which, to a rough approximation, will be close to that which will exist during truing contact. This avoids abrupt acceleration of the truing element 50.

As explained below, the automatic, intermittent truing with controlled STE (within the time span in which the workpiece is being continuously ground) involves three conditions or states; these states are signaled by a three-stage ring counter 290 (FIG. 22B) producing output signals Q0, Q1, Q2 which individually go to logic high in succession as it executes successive counting cycles. Resetting the counter makes signal Q0 high. The three states, as noted below, are Q0 high: The truing element follows the wheel face with a preselected gap or spacing (FIG. 20).

Q1 high: The truing element is moved rapidly in (left in FIG. 20) to close the gap and until the element just touches the wheel face (FIG. 19).

Q2 high: The truing action occurs at the wheel/element interface until the wheel radius has been reduced by a preselected increment INC (FIG. 21).

When the truing during state Q2 is completed, state Q0 is resumed and continued until a "start truing procedure" signal STP is received (for example, in response to detection that the grinding action has reduced the wheel radius by a further predetermined amount).

When a selector switch arm $SS_b$ (ganged to $SS_a$) is in its "set up" position (FIG. 22B), the motor TFM is controlled manually by adjusting a potentiometer 291 which produces a signal $F_{tss}$ for initial set up. This latter signal, which may be zero or positive or negative, is applied to a summing circuit 292 which receives the feedback signal $F_{ts}$ and feeds an error signal to a PID servo amplifier 294 controlling the motor TFM. Thus, the truing slide WS may be moved to different positions by manual control and will remain in any given position when the signal $F_{tss}$ is made zero.

The remainder of FIGS. 22A, B may best be described by a narrative of the sequential operations which are carried out.

Initial Set Up

With the motors PM and WM active and producing the desired rotational speeds $\omega_p$ and $\omega_w$ (by operation of servo circuits 220 and 221, FIG. 22A), it is desirable first to obtain a reading or signal indicative of the truing element radius $R_{te}$. The switch arms $SS_a$ and $SS_b$ are initially in their set up positions and the part 24 and element 50 are both free of contact with the wheel 50. First, a reset switch RE is momentarily closed so that a differentiating circuit 296 applies a resetting pulse to the counter 290, thereby assuring that the latter is initialized to state Q0. This means that gates 282 and 283 are respectively disabled and enabled, so motor TM is controlled to make $\omega_{te}$ equal to the standby set point speed $\omega_{teds}$. Now a human operator manipulates the potentiometer 280 to move the wheel slide left until the wheel face just contacts or kisses the workpiece 24; and then he manipulates the potentiometer 291 to move the truing slide WS left until the truing element just contacts or kisses the wheel face. The two slides are stopped in these positions (by centering potentiometers 280 and 291) so that no slide feeding is taking place, this positional relationship of the components being illustrated in FIGS. 17 and 19.

Thereupon, the human operator may momentarily close a switch INIT (FIG. 22B) so that an input pulse passes through an OR circuit 298 to actuate a one-shot multivibrator which produces a "store enable" pulse to a sample-and-hold amplifier. The latter thus accepts the signal $R_{te}$ at its input, and its output $R_{teh}$ thus becomes equal to $R_{te}$ and is "held" at that value. The storing or holding of $R_{te}$ as the signal $R_{teh}$ is desirable because Equation (29) is valid, and the output from summing circuit 236 is accurate, only when the workpiece 24 and element 50 are both in contact with the wheel 50, as illustrated in FIGS. 17 and 19. If the element's radius $R_{te}$ does not change (and it can change only while truing action is in progress), then the signal $R_{teh}$ remains accurate even after the components are positioned as shown in FIG. 20.

Following With a Gap

After such initialization, and with the components located in kissing contact (FIGS. 17 and 19), the operator shifts switch arms $SS_a$ and $SS_b$ to their run positions. This starts infeed of the wheel slide and grinding of the workpiece by action of the motor WFM to produce a grind rate GR selected on the potentiometer 230. Such grinding will continue during the remainder of the operational procedures to be described for FIGS. 22A and 22B.

Recalling that counter 290 was previously reset to the Q0 state, analog gates 300 and 301 (FIG. 22B) are now enabled. Thus, shifting switch arm $SS_b$ to its lower position results in the servo amplifier 294 receiving an input signal via the gate 300 and an amplifier 302 from the output of a position servo loop summing circuit 304. The latter receives a truing slide position set point signal $P_{tsd}$ and the actual position signal $P_{ts}$ to produce a position error signal $P_{ts}ERR$. Because a positive or negative polarity input at amplifier 294 is assumed to create truing slide motion toward the left or right respectively, and motion toward the left decreases the numerical value of the position $P_{ts}$ (FIG. 1), the signals $P_{tsd}$ and $P_{ts}$ are fed respectively to subtractive and additive inputs of the summing circuit 304. When the signal $P_{ts}ERR$ is finite and positive, the truing slide moves toward the left. The amplifier 302 establishes the position loop gain, and the motor TFM will thus drive the slide TS to keep the actual position $P_{ts}$ in agreement with the set point $P_{tsd}$. Some following error will develop while movement is occurring but those skilled in the art may add known expedients which reduce following error and which virtually eliminate overshoot and hunting about a desired end point, where stopping is to occur if the signal $P_{tsd}$ remains constant.

The signal $P_{tsd}$ during the Q0 state does not, however, remain constant because grinding action will be causing the wheel radius $R_w$ to decrease, and it is desired to keep the truing element constantly spaced from the wheel face by a small, predetermined distance or gap. That distance is represented by a signal GAP obtained from a manually preset potentiometer 305 and applied through the enabled gate 301 to the input of summing circuit 309. From inspection of FIG. 22B (and recognizing that another analog gate 308 is disabled so that its output is zero because signal Q2 is low), it will be seen that the signal $P_{tsd}$ produced by the summing circuit 309 varies according to the relation:

$$P_{tsdo}=R_w+GAP+R_{teh} \quad \text{[when Q0 is high]} \tag{41}$$

From FIG. 20, one sees that if $P_{ts}$ is kept equal to $P_{tsd}$, then the spacing GAP will be maintained, even as $R_w$ decreases. This is precisely the result of the summing circuits 309 and 304 acting through enabled gate 300 in FIG. 22B. Immediately after switch arm $SS_b$ is moved down and with counter 290 in state Q0, the truing slide TS will actually move right (FIG. 17) relative to the wheel 20 until the gap GAP is opened, and thereafter will feed left to keep the gap constant as the wheel radius $R_w$ decreases.

Thus, while grinding is taking place and the control system 71I is in state Q0, the operative surface of the truing element "follows with a gap" the wheel face.

Closing the Gap

When state Q0 exists, there will appear from time to time a "start truing procedure" signal STP (the generation of this signal being explained below). In response to that signal, the next procedure is to move the truing element into contact with the wheel face, i.e., to close the gap.

The signal STP passes through an OR circuit 310 (FIG. 22B) to advance the counter 290 to state Q1. This disables the gates 300 and 301; it enables an analog gate 312 so that the latter feeds (via switch $SS_b$) to the amplifier 294 the error signal from a summing circuit 314 whose inputs are the actual truing slide feed rate signal $F_{ts}$ and a set point signal $F_{tsd1}$ from a previously adjusted potentiometer 315. In consequence, motor TFM now moves the truing slide and element 50 toward the left (from the location shown in FIG. 20) at a rate agreeing with the set point $F_{tsd1}$ which is selected to be relatively large.

That motion is continued until the control components detect that the gap has been closed. With the gates 301 and 308 disabled because the Q0 and Q2 signals are both at logic low, the signal $P_{tsd}$ from circuit 309 varies as $$P_{tsd1}=R_w+R_{teh} \quad \text{[with Q1 high]} \tag{42}$$

Initially after the state Q1 begins, therefore, $P_{tsd1}$ (then equal to $R_w$ plus $R_{teh}$) will be less than $P_{ts}$ (then equal to $R_w+GAP+R_{teh}$), and the signal $P_{ts}ERR$ will be large and positive (equal to GAP). As the truing slide moves left and starts closing the gap, the signal $P_{ts}$ will decrease, and the signal $P_{ts}ERR$ will decrease. By the time the slide has traveled a distance equal to the original gap (from the position of FIG. 20 to that of FIG. 19), the element 50 will just touch the wheel 20 and the signal $P_{ts}ERR$ will have fallen to zero. This zero $P_{ts}ERR$ value is sensed by a zero detector 320 whose output swings high and passes through an AND gate 321 and the OR circuit 310 to step the counter 290. This action can only happen when the counter is in states Q1 (as it is here) or Q2 because the AND gate 321 is disabled when the signal Q0 is high.

Thus, after the gap has been closed by slide feeding at the fast rate $F_{tsd1}$, the counter 290 advances from state Q1 to state Q2.

Truing Off an Increment of the Wheel Radius

When the state advances from Q1 to Q2, the gate 312 is disabled, the gate 308 is enabled, and a further analog gate 322 is enabled. Moreover, the gates 282 and 283 are respectively enabled and disabled so the speed $\omega_{te}$ begins to be controlled in order to make STE equal to the set point $STE_d$.

With gate 322 enabled, the servo amplifier 294 receives the output of a summing circuit 324 whose inputs are the actual feed rate signal $F_{ts}$ and a second feed rate set point signal $F_{tsd2}$ obtained from a manually adjusted potentiometer 325. The truing element 50 in contact with the wheel is now fed to the left to produce truing action—in the same fashion as described for FIG. 18. That is, the set point signal $F_{tsd2}$ of FIG. 22B corresponds to the set point signal $F_{tsd}$ in the servo circuit 222 of FIG. 18. And with the gate 282 of FIG. 22B enabled, the STE value is controlled in the same fashion as set out above relative to FIG. 18.

The wheel is now grinding on the workpiece at a radius reduction rate of $GR=F_{psd}$ because the wheel slide WS is being fed left at a rate $F_{ws}$. The truing slide is being fed left at a rate $F_{ts}$ equal to $F_{tsd2}$, while the speed $\omega_{te}$ is being automatically adjusted to maintain the desired STE ratio. The desired ratio $STE_d$ may be set to any desired value. If it is chosen to be 0.5 HP/in.$^3$/min. or preferably much lower, then the radius reduction rate $R'_{te}$ will be quite low (as explained above) and the wheel reduction rate $R'_w$ will be quite high in relation to the selected feed rate $F_{tsd2}$—and the wheel face grits will be left quite sharp. This is the choice when the wheel is rough grinding a workpiece.

To terminate the truing action after a predetermined increment has been ground off, the summing circuits 309 and 304 are again active. With the gate 308 enabled, the signal $P_{tsd}$ will vary according to the expression $$P_{tsd2}=R_w+R_{teh}-INC \quad \text{[with Q2 high]} \tag{43}$$

where INC is a signal from a pre-adjusted potentitometer 328 representing the radius increment to be taken off the wheel (to restore wheel face shape) during each truing procedure. When the state Q2 initially begins, the actual position $P_{ts}$ (equal to $R_w+R_{teh}$; see FIG. 19) is greater than the set point position $P_{tsd}$ (equal to $R_w+R_{teh}-INC$) and the signal $P_{ts}ERR$ is therefore positive and equal to INC. As the truing slide moves to the left, the error signal $P_{ts}ERR$ becomes progressively smaller and reaches zero when the slide TS has moved the element 50 from the relative position of FIG. 19 to the relative position of FIG. 21. It is assumed as a reasonable approximation that the radius $R_{te}$ of the truing element does not change during one truing procedure, and even if it does reduce slightly, this only serves to make the incremental wheel radius reduction slightly less than the desired value INC set on the potentiometer 328.

When the signal $P_{ts}ERR$ reaches zero, the output of the zero detector 320 again swings high. This is transmitted through the AND and OR circuits 321, 310 to create a positive-going wave front at the count input of the counter 290—so the latter rolls over from count state Q2 to Q0. At this instant, the signal Q2 swings from high to low, so the complemental effect at OR circuit 298 is to produce a positive pulse edge at the input of one-shot 299, whereupon the current value of $R_{te}$ is stored in the sample-and-hold amplifier 299 as a new value for $R_{teh}$. In this way any wear which has occurred on the element 50 is taken into account for the next cycle. The freshly stored value of $R_{teh}$ is accurate because the components at this instant are relatively positioned as shown in FIGS. 17 and 19.

Repetitive Truing Cycles

With the state change from Q2 to Q0, conditions revert to the same as those described above under the heading "following with a gap" (i.e., just after initial set up). The wheel continues to be fed left and to grind the workpiece. The analog gates 300, 301 and 283 are again enabled and all other analog gates are disabled. Thus, element 50 is again caused to "follow with a gap" (FIG. 20)—and will do so until the next "start truing procedure" signal arrives to advance counter 290 from state Q0 to Q1.

In state Q1 for the counter, the system again closes the gap, as described above, and the counter advances from state Q1 and Q2. In state Q2, the truing action with controlled STE again takes place until another increment INC is trued off of the wheel face. This cycle repeats automatically for as many times as may be desired during the overall time span in which the workpiece is being continuously ground. The repetitive truing cycle sequence may be ended in any of a variety of ways; as one example, when the operator sees or notes from a meter (not shown) displaying $R_p$ that the workpiece has been ground to a desired radius, he may move the switch arms $SS_a$, $SS_b$ to their "set up" positions and manipulate potentiometers 291 and 281 to retract the element 50 back from the wheel and to retract the wheel back from the workpiece.

Thus, it will be understood that while a workpiece is being ground continuously over a span of time, the grinding wheel may be simultaneously trued during each of several spaced time intervals within that span, the truing action occurring with an STE ratio selected and controlled in the manner and with the advantages mentioned hereinabove. Therefore, despite the fact that the wheel may lose shape (or sharpness) as workpiece grinding proceeds, the grinding is not interrupted to true or dress the wheel. And this is greatly facilitated because the element 50 follows the wheel face with a small, predetermined gap (e.g., 3 mils) when inactive, and it can be advanced into truing contact with little delay each time one of the truing intervals is to begin.

Starting the Truing Procedure

The signal STP which starts one truing procedure may be created in a variety of ways.

As a first example, in rough grinding a workpiece over a span known to require about three minutes, it may be known from experience that the wheel will need re-shaping or sharpening every 15 seconds. In this simple case, a timer 340 may be used as shown in FIG. 23. The timer is started initially when a switch arm $SS_c$ (ganged to arms $SS_a$, b) is moved to its lower position so its start terminal ST receives a positive-going voltage transition from the high voltage at Q0. Thereafter the timer start terminal ST receives a rising voltage pulse edge each time the counter 290 (FIG. 22B) reverts from state Q2 to state Q0. This starts the timer (the time-out interval of which is adjustable) on a fifteen second timing interval, at the end of which an output pulse appears to reset the timer. That pulse may be fed as the signal STP to the counter 290 in FIG. 22B—thereby advancing the counter to state Q1 and initiating a truing procedure. If the timer 340 is set to measure off fifteen second intervals, the wheel will be trued after every fifteen seconds of "following with a gap".

The time duration of the truing action, i.e., how long the counter resides in state Q2 within each truing cycle is indeterminate; it continues for whatever time is required to reduce the wheel radius by the amount INC, as explained. Of course, it is within the scope of the invention to simply let the truing action, within each cycle, continue for a preselected time period, rather than detecting the movement of the slide TS through the distance INC as shown in FIG. 22B.

As an alternative to initiating a truing cycle each time the "following with a gap" has been carried out for a predetermined time interval (FIG. 23), it may be preferable to assume that when one interval of truing has been completed, the wheel will need truing or sharpening again when the grinding action has caused a certain amount of wheel wear, i.e., a certain reduction in $R_w$. Thus, the wheel radius reduction may be continuously sensed while the element is "following with a gap" and a start signal STP produced at that instant when $R_w$ has decreased a certain amount. Apparatus for this purpose is shown in FIG. 24 where the signal $R_w = P_{ws} - P_{ps}$ is fed both to a sample-and-hold amplifier 345 and a summing circuit 346. The signal Q0 is fed to a one-shot multivibrator 347 which thus applies an "enable store" signal to the amplifier 345 at each instant when the signal Q0 swings high. The value of $R_w$ at the start of the Q0 state, i.e., at the start of "following with a gap" is thus held in the amplifier 345 and signaled as its output $R_{wh}$ which is fed subtractively to the summing circuit 346. The output $\Delta R_w$ is the wheel radius reduction (due to grinding) which has occurred since the last truing procedure. This is compared with an incremental threshold signal $\Delta R_{wth}$, obtained from an adjusted potentiometer 348, in a high gain open loop operational amplifier 349. The output from that amplifier 349 will swing from low to high when wheel wear $\Delta R_w$ slightly exceeds the preselected threshold value $\Delta R_{wth}$, thereby to trigger a one-shot multivibrator 350. The short output pulse from the latter forms the signal STP to be fed to the counter 290 in FIG. 22B.

FIG. 24 thus illustrates an arrangement in which wheel truing is initiated at spaced time instants while a workpiece is being ground, but the start of each such truing interval is dependent upon the wheel wearing down by a predetermined amount after the preceding interval has ended.

As a further alternative, particularly when loss of wheel face shape is the primary problem, each truing interval may be initiated when loss of form is in one way or another detected. Consider FIGS. 25 and 26 where the wheel 20 is shown in plan view as having a "formed" face to grind a correspondingly shaped surface on the workpiece 24, the truing element 50 having an operative surface correspondingly shaped. The probe slide PS is shown (as in FIG. 1) carrying the probe 41 and the associated circuits which produce the probe signal PSIG. Since the desired wheel face shape, here chosen merely as one example, in plan view includes a concave central arcuate portion 360 bounded by two cylindrical but flat portions 361, it is likely that the wheel will most rapidly break down and lose form at the sharp corner regions or junctions 362 of those two portions. When this occurs, the desired sharp interior corners 363 at the corresponding locations on the workpiece will become undesirably rounded and will not be ground clean. Thus, to sense when this condition has arisen while grinding is in progress, an auxiliary work sensing probe **41*a* (like probe 41) is mounted on the slide PS with its associated circuits 40*a*. The probe 41*a* is "aimed" at the corner 363 and disposed with slight clearance. If during grinding, the interior corner 363 is cleanly ground, the signal PSI GA from the auxiliary probe circuits will remain essentially constant since (as explained relative to FIG. 1) the probe slide PS moves to keep the clearance CL essentially constant. If, however, the wheel's exterior corners 362 break or round off, the gap between the probe 41*a* and the interior corners 363** will decrease in effective length and the probe signal PSIGA will decrease—even though the signal PSIG remains essentially constant. If the signal PSIGA decreases by more than a threshold amount, it may be considered that the wheel face has lost its shape to an unacceptable degree and that one of the intermittent truing operations should be initiated.

For this purpose, the signal PSIGA is fed to the inverting input of a high gain operational amplifier 365 (FIG. 26) which acts as a comparator. A threshold signal TH is applied from an adjusted potentiometer 366 to the non-inverting input. Thus, while the wheel 20 is grinding the part 24 and the truing element 50 is "following with a gap" (FIGS. 20 and 25) the amplifier output will be at a logic low level because PSIGA will be greater than TH. But if and when the interior corner 363 becomes rounded and the signal PSIGA falls below TH, the output of the amplifier 365 will swing high, thereby producing a logic high output from an AND gate 368 which is enabled by the Q0 signal from FIG. 22B. The positive-going voltage edge from gate 368 triggers a one-shot 369 which then produces a short pulse forming the signal STP applied to the counter 290 in FIG. 22B.

In the FIG. 26 arrangement (cooperating with FIG. 22B), therefore, one of the time spaced truing procedures is initiated each time that the wheel loses form to some predetermined degree. This may occur three or four times, for example, over a long time span during which rough grinding proceeds continuously on the workpiece. Of course, instead of sensing the workpiece with an electromagnetic probe **40*a*, 41*a*** (FIG. 25) and using its siginal as an indicator that the wheel face has lost the desired shape, a pneumatic or other type of gage may be employed directly to sense the wheel face itself. Such a gage should be located to respond to that portion of the wheel face which will most quickly break away or lose shape as a consequence of the grinding action.

Control of SGE for Grinding by Varying the Parameters of Simultaneous Truing Action In my earlier-issued patents, identified above, it is explained that the degree of sharpness of a grinding wheel—over a long interval of grinding—may be maintained by self-correcting action if the grinding ratio SGE (defined above) is maintained within a predetermined range of values or at a desired set point value. Indeed, by adjusting the SGE ratio to be relatively low for rough grinding, the wheel may be kept very sharp (at the expense of a higher wheel wear rate W' which in most cases is more than offset by increased productivity). And by adjusting to SGE ratio to be relatively high, the wheel will be dulled for finish grinding to obtain a smoother final surface finish with the same wheel. The earlier patents teach that the relative surface speed $S_r$ of grinding or the relative feed rate of the wheel and part may be correctively adjusted to keep SGE at a desired value.

The control of SGE does not, however, avoid the problem of the wheel face losing form or shape; and thus grinding by the advantageous SGE method of my earlier patents still entails the need to periodically (or continuously) restore (or maintain) the desired shape of the wheel face. This need is especially critical just prior to the start of finish grinding and spark out because an out-of-shape wheel will leave the finished part out of shape.

According to one important aspect of my invention, I am able to control the SGE of grinding action at the wheel/work interface (such that SGE falls within a preselected range or is matched to a predetermined but changeable set point) by controlling the parameters or conditions by which truing or wheel conditioning action takes place simultaneously at a wheel/element interface.

To describe in specific detail one example of the many possible embodiments of this method and apparatus, reference is made to FIG. 17 taken with FIG. 27. As noted earlier, FIG. 17 is to be taken in conjunction with FIG. 1. The former is a diagrammatic view of grinding machine components when (i) the wheel 20 is being fed left into rubbing contact with the workpiece 24 to produce grinding action at the wheel/work interface, and (ii) simultaneously the truing or conditioning element 50 is being fed left into rubbing contact with the wheel to produce truing or conditioning action at the wheel/element interface.

It is to be noted first that no truing element gage (like that of 65, 66 in FIG. 1) is required in FIG. 17. Equations (25) through (30) are applicable and the workpiece sensing gage 50, 41 is employed.

Now, the SGE ratio for grinding action at the workpiece interface is the ratio of (i) power $PWR_g$ applied to such action, to (ii) the volumetric rate M' of material removal from the workpiece 24. This is expressed:

$$SGE = \frac{PWR_g}{M'} \tag{44}$$

The power $PWR_g$ devoted to the grinding action (for the reasons explained above) is the sum of (i) the $PWR_p$ applied to rotationally drive the workpiece 24 and (ii) some portion $PWR_{wg}$ of the $PWR_w$ applied to the rotational drive of the wheel. That is, the aggregate wheel power $PWR_w$ may be determined according to Equation (18) from the signals $TOR_w$ and $\omega_w$ from the transducer 35 and the tachometer 36 (FIG. 1); but the proportion of that aggregate power which goes into the grinding interface is not directly computable from the torque transducer signals. One may note, however, that at the grinding interface the tangential force $FOR_3$ (FIG. 17) which is applied from the wheel face to the part 24 is equal and opposite to the tangential force $FOR_4$ which, in effect, is applied to the wheel by the part 24 (absent acceleration effects). Since the torque $TOR_p$ is signaled by the transducer 38 (FIG. 1), and the radii $R_w$ and $R_p$ are ascertainable from Equations (27) and (29), it is possible to express the torque $TOR_{wg}$ which is applied by the wheel motor WM at the grinding interface (and which is only a part of the torque $TOR_w$). Thus, it may be written $$FOR_3 = FOR_4 \tag{45}$$

$$FOR_3 \cdot R_w = TOR_{wg} \tag{46}$$

$$FOR_4 \cdot R_p = TOR_p \tag{47}$$

Combining (45) to (47) yields $$TOR_{wg} = TOR_p \cdot (R_w/R_p) \tag{48}$$

Now, the grinding power $PWR_{wg}$ applied via the wheel 50 into the grinding interface may be written $$PWR_{wg} = 2\pi \cdot TOR_{wg} \cdot \omega_w \tag{49}$$

and by substitution from (48) this becomes $$PWR_{wg} = 2\pi \cdot TOR_p \cdot \frac{R_w}{R_p} \cdot \omega_w \tag{50}$$

Because the motor PM drives the part 24, the total power $PWR_g$ consumed at the grinding interface (to produce work which removes workpiece and wheel material and to create heat due to friction) is $$PWR_g = PWR_{wg} + PWR_p \tag{51}$$

But since $$PWR_p = 2\pi \cdot TOR_p \cdot \omega_p \tag{52}$$

then by substitution of (49) and (52) into (51), the latter becomes $$PWR_g = 2\pi \cdot TOR_p \left[ \omega_w \cdot \frac{R_w}{R_p} + \omega_p \right] \tag{53}$$

To determine the SGE ratio, therefore, according to Equation (44), one may first note the analogy to Equation (8) for wheel removal rate W' and write an equation for workpiece material removal rate $$M' = 2\pi \cdot L \cdot R_p \cdot R'_p \tag{54}$$

And by substitution of (53) and (54) into (44), SGE is expressed $$SGE = \frac{PWR_g}{M'} = \frac{TOR_p \left[ \omega_w \cdot \frac{R_w}{R_p} + \omega_p \right]}{L \cdot R_p \cdot R'_p} \tag{55}$$

If $R_w$, $R_p$ and $R'_p$ are replaced in (55) by substitution from (27), (25) and (26), this becomes $$SGE = \frac{PWR_g}{M'} = \frac{TOR_p \left[ \frac{\omega_w (P_{ws} - P_{ps})}{P_{ps}} + \omega_p \right]}{L \cdot P_{ps} \cdot F_{ps}} \tag{56}$$

In carrying out the method of controlling SGE by adjustment of parameters at the truing interface, a control system 71J shown in FIG. 27 (taken with FIGS. 1 and 17) may be employed. As noted before, the wheel is being fed left to create grinding action on the workpiece 24 and the element 50 is being fed left to create simultaneously truing or conditioning action on the wheel. For producing these motions and the relative rubbing contacts at the grinding and truing interfaces, three closed loop servo circuits 220, 221, 222 control the motors PM, WM and TFM in order to maintain the variables $\omega_p$, $\omega_w$, $F_{ts}$ in close agreement with preselected but adjustable set point values. The servo circuits 220, 221, 222 are identical to those which appear in FIG. 18 and this need not be described again. Moreover, the components 230–232 in FIG. 27 are identical to those correspondingly identified and described with reference to FIG. 18 and they serve to keep the wheel feed rate $F_{ws}$ automatically adjusted such that the grind rate GR (work radius reduction rate $R'_p = F_{ps}$) is maintained at a selected but adjusted value.

Provision is made automatically to vary the element speed $\omega_{te}$ so as to keep the actual SGE ratio within a predetermined range or in agreement with a predetermined set point $SGE_d$. The set point version is here shown only because it is the more rigorous. As illustrated in FIG. 27, the signals $P_{ws}$ and $P_{ps}$ are applied to a summing circuit 400 to create a signal representing the radius $R_w$; that latter signal is divided in an approprirate circuit 401 by the signal $R_p$; the quotient signal $R_w/R_p$ is then multiplied at 402 by the signal $\omega_w$ to create a product corresponding to the first term within the bracket of Equation (55). To this a summing circuit 404 adds the signal $\omega_p$ and the sum is multiplied in a multiplier circuit 405 whose output signal therefore varies as the numerator of Equation (55). The signals $R'_p$ and $R_p$ are multiplied at 406 and fed to an amplifier 408 having a gain (adjusted by a rheostat 409) corresponding to the axial length L of the grinding interface. The output of amplifier 408 thus varies as the denominator in Equation (55) and is fed to a divider 410 which also receives the output from multiplier 405. The quotient is a signal SGE which varies in accordance with the specific grinding energy ratio for the grinding action which is occurring.

The desired or set point value $SGE_d$ is represented by a signal preselected but adjustable and obtained from a potentiometer 411. The signal $SGE_d$ applied in bucking relation with the signal SGE to a summing circuit 412 results in an error signal SGERR forming the input to a PID servo amplifier 414 which variably energizes the motor TM (acting in this example as a brake) to control the element speed $\omega_{te}$. As the voltage $V_{tm}$ from the amplifier increases, the regenerative braking torque of motor TM decreases so the speed $\omega_{te}$ increases. It will be recalled from Equation (3) that this decreases the relative rubbing surface speed $S_r$ at the truing interface.

If now the wheel tends to become more dull, the power $PWR_g$ will increase because the wheel grits do not act as efficiently in abrading material from the workpiece 24. Since in this example $\omega_p$ and $\omega_w$ are kept constant, a duller wheel requires greater torque from the motors PM and WM—so consumed grinding power $PWR_g$ rises. This, in turn, makes SGE as signaled at 410 (FIG. 27) increase (see Equation 44) and the error signal SGERR thus increases (becomes more positive). The voltage $V_{tm}$ therefore increases, the braking torque applied to the element 50 decreases, and the speed $\omega_{te}$ increases. From Equation (3) it is seen that this reduces the truing interface relative speed $S_r$. A reduction in the truing $S_r$, for reasons given above, increases grit and bond fracturing at the wheel/element interface so the wheel re-sharpens automatically—and this reverses the changes described above until SGE is restored to substantial equality with the set point $SGE_d$. The self-correcting action will be almost imperceptible to the human eye after SGE and $SGE_d$ have initially become equal (and the amplifier 414 due to its integrating action is holding $V_{tm}$ at an almost constant value with the error SGERR being essentially zero). But if now the set point $SGE_d$ is changed from its first to a second value, corrective adjustment of $\omega_{te}$ will take place to make the actual SGE agree.

In the exemplary embodiment of FIGS. 17 and 27, the STE ratio for the truing action is not known—and its value is of no direct concern. But it may be noted that when SGE falls below the set point and $\omega_{te}$ increases (as explained above), this reduces the truing relative surface speed $S_r$ at the truing interface—and thereby decreases the STE ratio with which the truing action transpires. I have found that for a workpiece, wheel and truing element of given materials there is a general correlation between the STE and the SGE ratios—that is, as STE increases or decreases, the SGE of grinding action (simultaneously with truing or immediately after truing) will increase or decrease—even though that relation may not be linear. But in the practice of my invention a correlation table may be prepared and SGE may therefore be controlled to keep it at a desired value by adjusting the $STE_d$ set point value in an apparatus embodiment such as exemplified by FIG. 18.

In the organization and operation of FIGS. 17 and 27, the actual value of SGE is signaled at the output of the divider 410. This is not, strictly speaking, necesssary; the control apparatus may be organized to adjust the feed rate $F_{ws}$ such that the workpiece removal rate M' is kept constant (making the denominator in Equation 55 constant) so that the signal from the multiplier 405 varies according to changes in $PWR_g$ and is proportional to SGE. That latter signal may thus be employed to vary the voltage $V_{tm}$ and the speed $\omega_{te}$ in order to maintain SGE at a desired but adjustable set point.

For effective operation of the apparatus shown in FIGS. 17 and 27, the truing slide feed rate $F_{ts}$ (selected at potentiometer 225) should be chosen such that it is comfortably greater than the wheel radius reduction rate $R'_w$ due to grinding action. This (as mentioned with respect to FIGS. 17 and 18) will prevent the truing element from losing contact with the wheel face. Of course, the other procedures for such prevention, as set out relative to FIGS. 17 and 18, may also be employed in the apparatus of FIGS. 17 and 27.

In the use of the method and apparatus shown by FIGS. 1, 17 and 27, once grinding and simultaneous truing have been initiated, if the set point signal $SGE_d$ is made low for rough grinding (say, about 7.0 to 4.0 HP/in.$^3$/min.) the wheel face will be maintained both sharp and true in shape over a long interval of rough grinding at a relatively high grind rate GR. But the set point signal $SGE_d$ may be readjusted, either manually or automatically, from time to time so as to change the sharpness of the wheel face. As noted, an increase or decrease in $SGE_d$ will result in an increase or decrease of STE. Therefore, changing $SGE_d$ will practice the "sharpness degree" method described above. If one changes $SGE_d$, either smoothly or by a step change, from an initial low value or range to a subsequent higher value or range, the wheel face may be converted from a sharp condition during initial rough grinding to a duller condition for subsequent finish grinding—to produce a final work surface having a desired smoothness.

Of course, it is not essential to the method illustrated by FIG. 27 that the element 50 contact the wheel 20 during the entire span of time over which the wheel is grinding on a given workpiece. There may be some applications in which, as grinding of the workpiece continues, the element 50 is, in effect, withdrawn from contact and then restored to contact so that there is intermittent truing action which is, nevertheless, simultaneous with grinding but with SGE being controlled during each of the intermittent intervals. The material chosen for the truing element may fall in any of Classes I, II or III for the application of the FIGS. 17 and 27 embodiment and thus the element may even be a previously completed workpiece identical to the one being ground.

Finally, it is to be noted that specific control apparatus other than that exemplified in FIG. 27 may be utilized to keep SGE in a predetermined range or at a set point value by varying the parameters of the action at the truing interface. Apparatus and steps by which $\omega_w$ or $F_{ts}$ are correctively adjusted (rather than $\omega_{te}$) may be used and indeed two or more of such variables may be adjusted to keep SGE equal to $SGE_d$. In other words, FIGS. 17 and 27 represent but one example of the broader method which is to be practiced by conjointly establishing the relative surface speed and feed rate of the rubbing contact at the truing element in order to maintain the SGE ratio of grinding action within a predetermined range of values. That conjoint control is effected by either or both of a group of two corrective actions when the SGE (i) rises above or (ii) falls below said range: The first action involves (i) decreasing or (ii) increasing the relative surface speed of the rubbing contact between the wheel 20 and element 50; and the second action involves (i) increasing or decreasing the relative feed rate of such rubbing contact. Approximations which ignore certain changeable quantities (for example $R_w$, $R_{te}$ or $PWR_p$—as explained above) may be adopted when strictly accurate control of SGE is not required, and when SGE may be permitted to fall anywhere within some range to yield the desired results.

Advantages of Grinding of "Thin" Workpieces

Consider for purposes of discussion that the workpiece 24 in FIGS. 1 and 17 is a tubular or hollow cylinder part having a wall of small thickness, or that it is rod-like in shape with a small diameter and relatively great length. Such workpieces are here called "thin" as a shorthand designation that they lack sufficient structural rigidity to withstand substantial forces, normal to the surface being ground, without bending and permanently deforming or fracturing. At the least, deformation of a thin workpiece renders size gaging inaccurate and may cause chatter at the grinding interface. The grinding industry has been plagued by the costs and tediousness of grinding such thin workpieces because the feeding forces must be kept very low in order to obtain finished pieces of desired final size and free of metalurgical damage. This means that grind rate GR must be kept low and the wheel slide feed rate must be kept low. In consequence, the industry has resorted to "soft wheels", low grinding rates and low surface speeds for grinding such thin workpieces. This reduces productivity. If higher surface speeds are attempted, the wheel face dulls rapidly, and the energy poured into the grinding interface turns mainly to friction and heat—thereby causing metalurgical burn. A high scrap percentage is common in factories which grind these types of workpieces.

To a great extent, the SGE control method disclosed in my above-identified patents has enabled the grinding wheel to automatically self-sharpen—so that rough grinding at high grind rates GR may be continued without the wheel dulling, without grinding power increasing, and without so much energy going into friction and heat that metalurgical damage (burn) occurs. But in implementing the earlier patented method for grinding thin workpieces, the ranges of grinding power and metal removal rates required for self-sharpening of the wheel without excessive forces on the workpiece are sometimes not obtainable with the standard equipment available on a given grinding machine. And since truing of the wheel face must be accomplished by a truing element even when the method of my prior patents is used, the presently disclosed method permits high infeed forces at the truing interface as an expeditious way of maintaining SGE low (and the wheel sharp) even though the infeed forces at the grinding interface are kept within the bounds tolerable by a thin workpiece.

The invention disclosed and claimed in this application opens the way to grinding of thin workpieces with lower cost, higher productivity and reduced scrappage. For employing the apparatus exemplified in FIGS. 17 and 18, or FIGS. 17 and 27 according to the methods described, I am able to rapidly rough grind large amounts of stock from thin workpieces, control and obtain a final surface finish of desired smoothness, and avoid metalurgical burn—all by the use of a single wheel for both rough and finish grinding.

These startling results flow from the fact that in FIGS. 17 and 27, the SGE of grinding at the wheel/work interface is maintainable at a relatively low value. SGE cannot be maintained low due to grit and bond fracture at the grinding interface because the thin workpiece will not withstand wheel feeding forces sufficient to create such grit and bond fracture. But in FIG. 27, the relative surface speed and the relative infeed of the truing contact can be established (and with sufficient infeed force) such that grit and bond fracture are created at the truing interface—so a low set point $SGE_d$ creates a low SGE and rough grinding of the work can proceed at a relatively high grind rate GR even with low forces on the work, due to the sharpness of the wheel. Specifically, in FIGS. 17 and 27, the truing feed rate $F_{ts}$ is made constant and the speed $\omega_{te}$ is automatically adjusted to change relative surface velocity $S_r$—but of course the truing feed rate $F_{ts}$ could be the automatically adjusted variable.

The synergistic beauty of rapidly rough grinding thin workpieces in this fashion lies in the fact that heat and metalurgical burn at the workpiece is avoided—and high forces which would deform or break the workpiece are avoided—while the conjoint control of relative surface speed and feed rate at the truing interface (to produce low SGE) may involve a low STE created by a relatively high truing feed rate $F_{ts}$—so that the volumetric and radial wear rate (TE' and $R'_{te}$) on the truing element 50 are low. Thus, a single truing element 50 (even if made of steel such as M2 or 1050) may have a long life and may serve during the grinding of a large number of thin workpieces before it becomes worn out and thus needs to be replaced. For the reasons given earlier, if in the operation of FIGS. 17 and 27 in grinding a thin workpiece, the truing element 50 is a diamond chip truing roll, the life of the latter will be virtually infinite.

Of course, in grinding thin workpieces with the method and apparatus of FIGS. 17 and 27, the set point $SGE_d$ may be increased at the start of a final, short finish grinding interval—whereupon the wheel will be dulled and will serve the objective of producing a work surface finish whose smoothness is generally proportional to the higher value of $SGE_d$ which is selected.

The method and apparatus described with reference to FIGS. 17 and 18 may also be employed with the same advantages, for grinding thin workpieces. For rough grinding at a relatively high grind rate GR, the set point $STE_d$ will be made low, for example, in the range of 0.1 to 0.05 HP/in.$^3$/min. Regardless of what the grinding SGE at the workpiece surface may actually be, the resulting low STE value (obtained by conjoint control of truing surface speed $S_r$ and feed rate $F_{ts}$) will make the wheel sharp. Grinding proceeds therefore without burn damage at the work surface—and with a low volumetric and radial wear rate on the element 50—but without high infeed forces on the workpiece and consequent deformation or fracture. The same synergistic result is obtained.

And for finish grinding with the same wheel, the set point $STE_d$ may be increased so that the wheel dulls and the desired final surface smoothness is obtained.

It is to be understood that the automatic adjustment of $\omega_{te}$ as shown in FIGS. 17 and 18 is not the only way in which STE may be controlled. Wheel speed $\omega_w$ or truing feed rate $F_{ts}$—or any combination of these three variables—may be varied to keep STE equal to $STE_d$.

Indeed, for the reasons explained above, STE need not be known or actually controlled in order to rough grind a thin workpiece with the advantages here stated. While grinding is on-going at the workpiece, the truing element may be brought into rubbing contact with the wheel (FIG. 17), the relative wheel/element surface speed $S_r$ and the truing feed rate being conjointly controlled to make the ratio W'/TE' greater than 1.0 (for Classes I or II), or to make the speed $S_r$ less than 3000 f.p.m. (Class III). The wheel will not only be trued but kept sharp—and fast grinding without destructive forces on the workpiece may be obtained.

Method and Apparatus for Determining Wheel Radius and Part Radius, Despite Wear, With a Simple Probe System In FIGS. 1 and 17 (taken with FIG. 18 or 27) there has been shown an arrangement for truing or conditioning a wheel while grinding is simultaneously occurring—and with automatic controlling of either the STE or SGE. As indicated earlier, such procedures may also be practiced, in the light of the teachings here disclosed, by controlling the TR ratio while grinding and truing are taking place simultaneously. In FIG. 17 taken with FIG. 18 or 27, it has been assumed that an in-process workpiece gage 40, including an electromagnetic probe 41 (of known organization) is employed; and as noted with respect to FIG. 1, this probe 41 is mounted on a slide PS which is slaved by a servo loop including the motor PFM to keep the clearance CL constant as the part radius $R_p$ changes. This is done because the sensing "range" of the electromagnetic probe 41 and its associated circuits is quite limited (e.g., 0.001" to 0.030"). If the workpiece is to be ground down a considerable amount in radius, the probe 41 would be unable to accurately signal the part radius $R_p$ unless it "follows" the part surface.

The methods and apparatus here disclosed for simultaneous grinding and truing lead to a further surprising and advantageous discovery. It is: The radius $R_w$ of the wheel (depite wheel wear) and the radius $R_p$ of the part can be continuously known and determined—even though the part is ground down by a considerable amount such as one-half inch or more—without the need for an elaborate "following" servo associated with an in-process work-sensing gage; and this is possible with a simple, limited range truing element-sensing gage not requiring any following servo. This discovery is founded in the fact that, with certain ones of the truing procedures here disclosed, the wear or radius reduction of the truing element is quite small over an extended period of truing action, and so a limited range element-sensing gage can provide the necessary signal information, without servo following, even though the workpiece radius is reduced by an amount much greater than such limited range.

To make this more understandable, FIG. 28 illustrates a simplified version of FIG. 1 and characterized by the omission of the probe 41, gage circuits 40, the probe slide PS and the probe servo loop components 47, 45, 44, PFM, etc. Unlike FIG. 17, the arrangement of FIG. 28 uses the truing element gage 65 with its probe 66 fixed to the truing slide TS. That probe does not have to "follow" the surface of the truing element 50 by a servo slide action because the radius $R_{te}$ will not reduce appreciably as one or more workpieces are ground to remove a considerable amount of stock therefrom. For example, if the probe 66 can accurately sense and represent by the signal $\Delta R$ the gap $\Delta RG$ as the latter varies from 0.001" to 0.030", then the signals $R_{te}$ and $R'_{te}$ (produced in the way previously described with respect to FIG. 1) remain valid even though the workpiece is ground extensively to reduce its radius and even though the wheel reduces considerably in its radius. If, for example, after installation of a "fresh" truing element (and perhaps mechanical setting of the probe 66) the gap $\Delta RG$ is 0.002", the element 50 is measured and found to have an initial radius $R_i$, the potentiometer 68 is then set to make the voltage $R_{iv}$ represent $R_i+0.002$". Then the signal $R_{te}=R_i-\Delta R$ initially represents $R_i$, and falls as the element radius decreases (and $\Delta R$ increases) by as much as 0.028". This means that if the truing ratio TR is viewed as a ratio of radius reductions and assumed, for example, to be 50, the wheel may have up to 1.4" removed from its radius before mechanical resetting and initialization need to be repeated.

FIGS. 1, 28 and 29

The gage 65, 66 together with the position signaling sensor 29 and the signal $P_{ts}$ permit the wheel radius $R_w$ (FIG. 28) to be determined indirectly at any instant, despite the fact that wheel wear $R_w$ occurs. From the dimensional labels in FIG. 28, it may be seen that $$R_w=P_{ts}-R_{te} \tag{57}$$

Further, the workpiece radius $R_p$ may be found indirectly at any instant from the relation $$R_p=P_{ws}-R_w=P_{ws}-P_{ts}+R_{te} \tag{58}$$

Thus, the present invention makes it possible always to find the values of the radii $R_w$ and $R_p$ despite the fact that these radii change, possibly over a wide range, and are not directly sensed.

In the simultaneous truing and grinding action illustrated in FIG. 28, it is possible always to determine indirectly the rates of radius reduction $R'_w$ and $R'_p$. For this purpose, the truing slide feed rate $F_{ts}$ is chosen such that it falls above the range of wheel radius reduction rates which are likely to occur due to wheel wear at the grinding interface; or stated another way, the rate $F_{ts}$ is made sufficiently high that it is truing action, rather than grinding action, which establishes the rate $R'_w$ of wheel radius reduction. Then, the wheel slide infeed rate is slaved to be equal to the desired grind rate $GR=R'_{pd}$ plus the wheel wear rate $R'_w$ which is caused at the truing interface. That is, the wheel slide feed rate $F_{ws}$ is automatically varied and controlled such that $$F_{ws}=GR+R'_w \tag{59}$$

But if the truing slide is moving left at a feed rate $F_{ts}$ and the element 50 is reducing in radius at a rate $R'_{te}$ (the latter being directly signaled in FIG. 28), then $$R'_w = F_{ts} - R'_{te} \tag{60}$$

Putting (60) into (59), one obtains $$F_{ws} = GR + F_{ts} - R'_{te} \tag{61}$$

Now, it may be further observed that if the wheel slide is moving left at a rate $F_{ws}$ and the wheel radius is reducing at a rate $R'_w$, then the radius $R_p$ must be reducing. The rate $R'_p$ of that latter reduction is expressible $$R'_p = F_{ws} - R'_w \tag{62}$$

and from (60) this becomes $$R'_p = F_{ws} - F_{ts} + R'_{te} \tag{63}$$

If (61) is substituted into (63), an identity is obtained, namely, $$R'_p = GR + F_{ts} - R'_{te} - F_{ts} + R'_{te} = GR \tag{64}$$

thereby confirming that grind rate GR and part radius reduction rate are identical.

To utilize these relationships during simultaneous truing and grinding (as shown in FIG. 28), a control system 71K may be organized as shown in FIG. 29. Servo circuits 220, 221, 222 (identical to those of FIG. 18) are employed to make the speeds $\omega_p$ and $\omega_w$, and the feed rate $F_{ts}$, agree with set point values signaled from potentiometers 223, 224, 225.

Further, however, the wheel slide feed rate $F_{ws}$ is automatically controlled to make the part radius reduction rate $R'_p$ stay equal to a desired or set point value GR (the latter thus representing $R'_{pd}$) obtained from an adjustable potentiometer 450. A summing circuit 451 receives the signals $F_{ts}$ and $R'_{te}$ to produce an output representing $R'_w$ (see Equation 60) which is added to the signal GR in a summing circuit 452. The latter produces an output signal $F_{wsd}$ which may be viewed as a variable "set point" for the wheel feed rate $F_{ws}$. A further summing circuit 454 accepts that "set point" signal and the feedback signal $F_{ws}$ to produce an error signal $ERR_{12}$ applied to a PID servo amplifier 455 which energizes the motor WFM. Thus, the feed rate $F_{ws}$ is automatically controlled so as to force the grind rate $R'_p$ to agree with the selected set point value GR—and thus the part is ground at a desired radius reduction rate $R'_p$ because the wheel wear rate $R'_w$ has been determined by the truing action and the wheel feed rate is made equal to $R'_w$ plus the desired grind rate.

The three summing circuits 451, 452, 454 in FIG. 29 may, of course, be replaced by a single summing circuit having four inputs for the signals such that $$ERR_{12} = GR + F_{ts} - R'_{te} - F_{ws} \tag{65}$$

Because wheel slide feed rate $F_{ws}$ is forced to take on a value which makes $ERR_{12}$ zero when the servo loop is in equilibrium, that feed rate is kept and maintained as set out above, i.e., such that $$F_{ws} = GR + F_{ts} - R'_{te} \tag{61}$$

This use of a simple low-range gage 65, 66 as explained thus far may be accompanied by additional control apparatus which maintains the ratio STE at least approximately at a selected but changeable set point value. Such control of STE has the effects and the advantages already described with reference to FIG. 18, but is obtained in FIG. 29 by size representing signals originating from the simple gage 65, 66 (rather than from the part gage 40, 41 and its associated probe slide servo, FIGS. 1 and 17).

It will be recalled from the discussion leading up to Equation (39) that the power fed into the truing interface, when grinding and truing are both taking place, cannot be determined directly from the signals $TOR_w$ and $\omega_w$. It will be useful to repeat Equation (39), which is applicable to FIG. 17 and likewise to the circumstances of FIG. 28:

$$STE = \frac{PWR_t}{W'} = \frac{TOR_{te}\left[\omega_w \frac{R_w}{R_{te}} - \omega_{te}\right]}{L \cdot R_w \cdot R'_w} \tag{39}$$

This relationship is based upon the reasonable assumption that the radius reduction rate $R'_w$ occurs wholly due to truing action. In fact, a small portion of such reduction rate, for volumetric considerations, occurs due to grinding action, but the assumption nevertheless gives sufficient accuracy in most all practical applications. By substituting $R_w$ and $R'_w$ from Equation (57) and (60) and recalling that $R_{te}$ is directly signaled in FIG. 28, the Equation (39) applied to FIG. 28 becomes $$STE = \frac{PWR_t}{W'} = \frac{TOR_{te}\left[\frac{\omega_w (P_{ts} - R_{te})}{R_{te}} - \omega_{te}\right]}{L\,(P_{ts} - R_{te})\,(F_{ts} - R'_{te})} \tag{66}$$

To control STE in FIG. 29 (taken with FIGS. 1 and 28), therefore, a summing circuit 460 receives the signals $P_{ts}$ and $R_{te}$ to produce a signal $R_w$ into which a divider circuit 461 divides the signal $R_{te}$. The quotient signal from 461 is multiplied by the signal $\omega_w$ in a multiplier 462; the resulting product signal is fed to a summing circuit 464 where the signal $\omega_{te}$ is subtracted. The difference output is then multiplied at 465 to produce a signal corresponding to the numerator of Equations (39) and (66), and which is proportional to $PWR_t$.

Also, in FIG. 29, the signal $R'_w$ (from 451) is multiplied at 468 by the signal $R_w$ (from 460). The product output from 468 is further multiplied in an amplifier 469 adjusted to have a gain of L so that its output is $L \cdot R_w \cdot R'_w$, corresponding to the denominator in Equations (39) and (66) and proportional to the material removal rate W'. A division circuit 470 receives the outputs from 465 and 469 to produce a signal STE which thus represents the STE ratio due to truing action taking place at the truing interface in FIG. 28. The remaining components 250, 251, 252, TM in FIG. 28 are the same and function in the same way as previously described with reference to FIG. 18.

Thus, by using only a limited range element-sensing probe 65, 66 the apparatus of FIGS. 28 and 29 enables not only the determination of the part radius $R_p$ and grinding at a desired, essentially constant rate GR because wheel radius $R_w$ and wear rate $R'_w$ are indirectly determined and used; but it also enables truing to take place at a desired STE ratio (which may from time to time be changed). By choosing a low STE set point, the wheel will be kept sharp and the wear rate $R'_{te}$ will be sufficiently low that a given truing element (even if made of a hard steel or of the same metal as that of the workpiece) will not fall out of the range of the gage 65, 66 during the course of grinding several workpieces.

FIGS. 1, 28 and 30

The control of SGE at the grinding interface may also be effected by conjointly establishing and correctively varying the relative surface speed $S_r$ and the infeed rate at the truing interface, when the simple probe 65, 66 of FIG. 28 is employed. The results will be essentially those obtained by the apparatus of FIGS. 17 and 27—but the probe implementation and the control devices are much less complex and costly.

FIG. 30, taken with FIGS. 1 and 28, illustrates a system 71L for controlling SGE in that way. The servo circuits 220, 221, 222 for establishing selected values of $\omega_p$, $\omega_w$ and $F_{ts}$ are the same as described relative to FIG. 18; and the control of $F_{ws}$ to maintain a desired work grind rate GR is the same as described with reference to FIG. 29 and Equations (57) to (64).

For controlling SGE, Equation (55) is validly applicable not only to FIG. 17 but also to the circumstances of FIGS. 28 and 30, and for ready reference it is reproduced here:

$$SGE = \frac{PWR_g}{M'} = \frac{TOR_p\left[\omega_w \cdot \frac{R_w}{R_p} + \omega_p\right]}{L \cdot R_p \cdot R'_p} \tag{55}$$

Substituting for $R_w$, $R_p$ and $R'_p$ from Equations (57), (58) and (63), this becomes $$SGE = \frac{PWR_g}{M'} = \frac{TOR_p\left[\frac{\omega_w (P_{ts} - R_{te})}{(P_{ws} - P_{ts} + R_{te})} + \omega_p\right]}{L\,(P_{ws} - P_{ts} + R_{te})\,(F_{ws} - F_{ts} + R'_{te})} \tag{67}$$

As indicated in FIG. 30, SGE is controlled to agree with a set point $SGE_d$ by varying the element speed $\omega_{te}$. This is similar to the operation of the apparatus of FIGS. 17 and 27 except that different gage signals are utilized. As shown in FIG. 30, a summing circuit 480 produces a signal $R_w$ (see Eq. 57). This is subtracted at 481 from the signal $P_{ws}$ to produce a signal $R_p$ fed as a divisor to a divider circuit 482 to produce a signal $R_w/R_p$ which is then multiplied at 484 by the signal $\omega_w$. To that product signal, a summing circuit 485 adds the signal $\omega_p$ and the result is multiplied at 486 by the signal $TOR_p$. The output from multiplier circuit 486 thus varies as the numerator of Equations (55) and (67) and is proportional to $PWR_g$.

Also, in FIG. 30, a summing circuit 488 subtracts the signal $R'_w$ (output of circuit 451) from the signal $F_{ws}$ to produce a signal (per Eq. 62) representing $R'_p$. This is multiplied at 489 by the signal $R_p$ (produced at 481) and fed through an amplifier 490 adjusted to have a gain of L. The amplifier output therefore varies as the denominator of Equations (55) and (67) and is proportional to the work removal rate M'. That signal is divided at 491 into the signal from 486 to produce the actual SGE signal. The remaining components 411, 412, 414 and TM in FIG. 30 are the same and function in the same way as previously described with reference to FIG. 27.

Thus, by using only a limited-range element-sensing probe 65, 66 the apparatus of FIGS. 28 and 30 enables not only the determination of the part radius $R_p$ and grinding at a desired, essentially constant grind rate GR because wheel radius $R_w$ and wear rate $R'_w$ are indirectly determined and used; it also enables truing to take place with automatic adjustments at the truing interface which cause grinding to proceed at a desired SGE ratio (and which may from time to time be changed). By choosing a low SGE set point, the truing STE ratio will be low even though not necessarily known; and in consequence the wheel will be kept sharp and the wear rate $R'_{te}$ will be sufficiently low that a given truing element will not fall out of the range of the gage 65, 66 during the course of grinding several workpieces. The apparatus and the method of FIGS. 28 and 30 (like those in FIGS. 17, 18 or 17, 27) may be used to great advantage in the grinding of thin workpieces and without the need for a work-sensing gage.

In summary, FIG. 28, taken with FIG. 29 or 30, illustrate two of many possible method and apparatus embodiments which involve simultaneous grinding and truing action carried out by means to sense the surface or size of the truing element—and without the need to sense the workpiece surface or size. The truing element 50 may be a homogeneous body of metal or metal alloy; and even though it wears down somewhat, its radius reduction will be relatively slight over a given period of truing action so the limited range gage 65, 66 provides the needed intelligence.

A first surprising advantage comes from this. Even though the wheel radius $R_w$ reduces unpredictably and by a large amount (say 0.5") the element sensing probe 65, 66 enables the wheel radius to be determined at all times. By sensing the operative surface of the element 50, a radius signal $R_w$ is obtained as equal to the distance $P_{ts}-R_{te}$. Then, the difference $P_{ws}-R_w=P_{ws}-P_{ts}+R_{te}$ can be signaled to represent the part dimension $R_p$, where $P_{ws}$ is the distance (signaled by position transducer 29) between a reference point 24a on the workpiece and the wheel axis 20a. The difference $P_{ws}-R_w$ thus represents the dimension the workpiece from the reference point 24a to the work surface being ground (i.e., $R_p$ in FIG. 28).

It will be apparent that to produce the radius signal $R_w$, the distance between a reference mark 50a on the element 50 and the wheel axis 20a (measured along or parallel to a line perpendicular to the element's surface at the point of truing contact) is sensed and signaled by the position transducer 58 which produces the signal $P_{ts}$. The gage 65, 66 produces a signal $R_{te}$ representing the distance (measured along or parallel to a line perpendicular to the element's operative surface) from that reference mark 50a and the element's operative surface. And the difference $P_{ts}-R_{te}$ is utilized as a representation of the wheel radius $R_w$.

A second surprising advantage comes from the arrangement of FIG. 28 taken with FIG. 29 or 30. With only the conditioning element gage 65, 66, the dimension $R_p$ is available as an algebraic sum of other signals (and is used for controlling SGE in FIG. 30). Thus, it is possible to terminate the grinding action simply by backing the wheel and the truing element to the right when the sum $P_{ws}-R_w=P_{ws}-P_{ts}+R_{te}$ reaches a particular value reflecting final part size. The position sensor 29 produces the signal $P_{ws}$ which represents the distance (measured along or parallel to a line perpendicular to the ground surface of the workpiece at the point of grinding contact) from a reference point 24a on the part to the center 50a of the wheel.

Still another advantage comes from the arrangement of FIG. 28 taken with FIG. 29 or 30. With only the conditioning element gage 65, 66, the grind rate GR (rate of reduction of the workpiece radius, $R'_p$) may be controlled to be substantially equal to a desired set point. The gage 65, 66 and associated circuits signal the linear wear rate ($R'_{te}$) of the conditioning element in a direction parallel to the relative infeeding of the wheel and the element, while the tachometer 59 serves to sense and signal the relative infeeding rate $F_{ts}$. The relative infeeding of the wheel and the workpiece are then controlled to have a rate $GR+F_{ts}-R'_{te}$ so that the workpiece is abraded away in the direction of such infeeding at the desired linear rate GR. This results despite changes in the wheel radius $R_w$ because the terms $F_{ts}-R'_{te}$ represent and compensate for the wheel wear rate $R'_w$.

A Special System for Controlling Size and Rates

FIG. 17, taken with FIG. 18 or 27, relates to methods and apparatus in which an in-process workpiece sensing gage is employed.

FIG. 28 taken with FIG. 29 or 30 relates to methods and apparatus in which an in-process truing element-sensing gage is utilized instead. This reduces considerably the complexity of the apparatus.

In the light of my Class III truing method disclosed above, however, I am able to bring to the art a method and apparatus by which grinding size and grinding rate are accurately controlled—despite wheel wear and changes in wheel radius—with no in-process gage at all. As startling as it may seem, one may simply first manually measure the radius $R_{te}$, then proceed with confidence to perform simultaneous grinding and truing, with the grinding at a rate and to final workpiece size he may desire, while nevertheless automatically keeping the wheel sharp and avoiding metallurgical burn at the workpiece.

For this aspect of my invention, reference will be made to FIG. 28 with the assumption that the components 65, 66, 68, 69, 70 are totally omitted. In other words, all gages of FIG. 1 and FIG. 28 are omitted. Further, FIG. 28 is to be taken with the assumption that the wheel 20 and truing element 50 fall in Class III as defined above. Merely as an example consider that the workpiece 24 is 1020 steel, the wheel 20 is made of aluminum oxide grits and the truing element 50 is a roll composed of diamond chips set in a supporting matrix of tungsten carbide. FIG. 28 taken with these assumptions will hereafter be called "special FIG. 28" since it seems totally unnecessary to repeat that figure with the gaging components omitted.

As indicated previously, FIG. 28 involves grinding action at the workpiece/wheel interface with the slide WS being fed to the left, and simultaneous truing action at the wheel/element interface with the slide TS being fed to the left.

So long as the relative surface speed $S_r$ of the rubbing contact is kept below 3000 s.f.m., the diamond truing roll will not perceptibly change in radius—at least it will not change over a long aggregate time of truing action. Therefore, I am able validly to assume that the radius $R_{te}$ (which may be initially measured) is constant and that the radius reduction rate $R'_{te}$ of the element 50 is zero.

A very simple and reliable control method and apparatus may be employed to advantage with the special FIG. 28, and one suitable control system 71M for this purpose is depicted in FIG. 31. As there shown, servo circuits 220, 221, 222 operate to maintain the speeds $\omega_p$ and $\omega_w$ at selected set point values and to maintain the truing infeed rate $F_{ts}$ at a selected value—all as described previously in relation to FIG. 18. The truing infeed rate may be set, for example, at about 0.040"/min.

In FIG. 31 (unlike FIG. 29 or 30), the signal $F_{ts}$ represents the wheel radius reduction rate $R'_w$ because the truing roll wear rate $R'_{te}$ is zero (see special FIG. 28). Somewhat surprisingly, the following simple expression applies:

$$R'_w=F_{ts} \tag{68}$$

Thus, it is possible to make the part reduction rate $R'_p$ equal a desired grind rate GR simply by causing the wheel slide WS to feed to the left at a rate $F_{ws}$ which is equal to the truing slide rate $F_{ts}$ plus the desired grind rate GR. This is expressed:

$$R'_p=F_{ws}-R'_w \tag{69}$$

And from (68):

$$R'_p=F_{ws}-F_{ts}=GR \tag{70}$$

Therefore, a summing circuit 500 in FIG. 31 adds the signals $F_{ts}$ and GR (the latter being a set point selected by adjusting a potentiometer 501) to produce a variable "set point" signal $F_{wsd}$. The latter is compared with the actual feed rate signal $F_{ws}$ in a summing circuit 502 which sends an error signal $ERR_{12}$ to a PID servo amplifier 504 to variably energize the motor WFM. In this fashion, the actual slide feed rate $F_{ws}$ is made to take on whatever value is required to maintain the grind rate $R'_p$ of the workpiece equal to the set point signal GR. That is, since $ERR_{12}=F_{ts}+GR-F_{ws}$ but that error is kept at zero, then $$F_{ws}=F_{ts}+GR \tag{71}$$

To control the truing action and to assure that the diamond chip roll does not wear or reduce in radius, the relative surface speed $S_r$ at the truing interface is held at a desired value $S_{rd}$ (obtained by setting a potentiometer 506) which is less than 3000 s.f.m. (and preferably on the order of about 600 to 300 s.f.m.) when rough grinding of the workpiece is taking place. Because $R_{te}$ is constant, its measured value is represented by a signal $R_{te}$ obtained simply by adjusting a potentiometer 508. That signal is subtracted from $P_{ts}$ in a summing circuit 509 to produce a signal representing the wheel radius $R_w$ even as it changes due to wheel wear. The latter signal is multiplied by $\omega_w$ in a multiplier circuit 510. The signals $R_{te}$ and $\omega_{te}$ are likewise multiplied in a circuit 511. The products $R_w \cdot \omega_w$ and $R_{te} \cdot \omega_{te}$ are subtracted in a summing circuit 512 and the difference is fed to an operational amplifier 514 adjusted to have a gain of $2\pi$. From Equations (1), (2) and (3), it is apparent that the relative surface speed $S_r$ at the truing interface is $$S_r=2\pi(R_w \cdot \omega_w-R_{te} \cdot \omega_{te}) \tag{72}$$

and thus the output of amplifier 514 varies as the relative surface speed at the truing interface. That signal $S_r$ is bucked against the set point $S_{rd}$ in a summing circuit 515, and the resulting error signal $ERR_{13}$ is fed to a PID servo amplifier which energizes the motor TM (in this case acting as a brake). If the signal $S_r$ exceeds $S_{rd}$, the signal $ERR_{13}$ becomes more positive, the voltage $V_{tm}$ increases, the current and braking torque of motor TM decrease, and the speed $\omega_{te}$ increases—until the signal $S_r$ is reduced to equality with $S_{rd}$.

The magic of this arrangement is that since $R'_{te}$ is zero, no gage is required to sense and signal its value, and yet grind rate can easily be made to agree with the set point GR despite wheel wear. Equally important is the fact that with no gage at all, and because $R_{te}$ is constant and signaled from a simple adjusted source (such as potentiometer 508), the changing wheel radius is continuously ascertainable from the difference $$R_w = P_{ts} - R_{te} \tag{57}$$

via the summing circuit 509. And this makes it possible, via another summing circuit 518 to continuously known the workpiece size or radius $R_p$ from the algebraic relationship $$R_p = P_{ws} - R_w = P_{ws} - P_{ts} - R_{te} \tag{58}$$

With the apparatus of the special FIG. 28 and FIG. 31, the part may be rough ground at a desired grind rate (while the wheel is kept true and sharp) until the actual part size $R_p$ reaches a desired final value simply by comparing the signal $R_p$ with that final value and then backing the wheel out. All of this with no in-process gage at all, and with virtually infinite life for the diamond truing roll 50.

Of course, it is not essential that a diamond chip truing element or Class III materials be employed. In those cases, especially Class II, where the truing ratio TR is established in excess of 100 (for example), a very low STE is maintained (e.g., less than about 0.04), the radius reduction of the truing element, during grinding of two or three workpieces, may be less than the final size tolerance acceptable for those pieces. Thus, it is within the purview of the method to employ a truing element which has some perceptible wear but to compensate for this (say, after one or more pieces have been ground) by re-measuring the element and readjusting the potentiometer 508.

This brings to light that the "special FIG. 28" apparatus may be used to advantage in the grinding methods which involve control of STE or SGE, as described with reference to FIGS. 29 and 30, respectively. No element-sensing in-process gage is required. The variable $R_{te}$ in Equations (66) and (67) is fixed and obtained from an adjustable source (such as potentiometer 508 in FIG. 31). And the variable $R'_{te}$ in Equations (66) and (67) is zero, thereby simplifying the apparatus of FIG. 29 or FIG. 30. In such cases, the STE ratio will preferably be set and maintained at less than about 0.04 HP/in.$^3$/min., or the SGE ratio would preferably be set and maintained at less than about 4.0—except that these set points may be increased (for the reasons explained above) during the short time periods where finish grinding is performed on a workpiece.

In a general sense, "special FIG. 28" taken with FIG. 31 (or taken with FIG. 29 or 30, modified as noted above) makes it plain how simultaneous (i) grinding of a part by a wheel and (ii) truing by an element acting on the wheel may be carried out with zero or negligible wearing and dimensional change of the operative surface of the truing element. With this, the wheel dimension $R_w$, although it changes, is continuously determinable, and the part dimension $R_p$, although it changes, is continuously determinable.

The dimension $R_{te}$ (measured from a reference mark 50a to the operative surface of the element 50, along a line perpendicular to that surface) is known and constant. The dimension $P_{ts}$ (measured from the axis 20a to the reference mark 50a along a line perpendicular to the wheel face at its point of truing contact) is signaled by the position feedback device 58—and thus the changing radius $R_w$ is always equal to the difference $P_{ts} - R_{te}$. The dimension $P_{ws}$ (measured from the axis 20a to the reference point 24a along a line perpendicular to the work surface at the point of grinding contact) is signaled by the position transducer 29—and thus the changing part dimension $R_p$ (measured from the reference point 24a to the ground work surface along a line perpendicular to that surface) is always equal to the difference $P_{ws} - R_w$ which is equal to $P_{ws} - F_{ts} + R_{te}$.

And further, since $R'_{te}$ is essentially zero, the wheel radius reduction rate $R'_w$ is known to equal the relative infeeding rate $F_{ts}$ of the truing element, such rate being signaled easily by means such as the tachometer 59. This permits the workpiece reduction rate $R'_p$ (in a direction parallel to that of the relative infeeding of the workpiece and wheel) to be kept at a desired grind rate GR simply by causing the relative infeeding rate $F_{ws}$ to equal the desired grind rate GR plus the truing infeed rate $F_{ts}$.

RESUMÉ

In the various figures herein showing exemplary embodiments of control apparatus for practicing specific examples of grinding or truing methods, analog signals created and processed by analog circuit have been described. It is well known to those skilled in the control art that digital signals (with appropriate ADC or DAC converters, as needed) may be employed to signal different variables, with a programmed digital computer performing various arithmetic, gain, derivative or integral functions with such signals. The computer iterates its operations at such short intervals that each signaled quantity, in practical effect, varies continuously. Because those working in the art can with routine skill embody the control apparatus here disclosed in various forms employing digital signals and digital computers, it is to be understood that the claims which follow embrace such digital embodiments. To illustrate and describe specific digital embodiments would unnecessarily lengthen the present specification, and the analog apparatus here shown and described provides to those of ordinary skill in the art all of the necessary teachings required to construct digital apparatus for practicing and embodying the methods and apparatus here disclosed and claimed. On the other hand and by contrast, the methods here disclosed may in many instances be practiced by manual adjustment or control of the different variables, and the method claims which follow are to be read with a scope which includes purely manual set ups or adjustments.

In may specific cases, approximations and ranges of variables may be utilized, as contrasted with rigorous control, in practicing the invention here disclosed to obtain to a significant degree some or all of the advantages described. For example, those skilled in the art will realize that in computing volumetric material removal rates W' or M', or powers $PWR_t$ or $PWR_g$ from instant to instant, the radii $R_p$, $R_w$ and $R_{te}$ do not change by large percentages; therefore, these radii may often be assumed constant over extended intervals. The rates of radius changes may be taken as reflecting material removal rates. And, in certain cases, the power involved in driving a workpiece (or driving or braking a truing element) may be such a small percentage of grinding (or truing) power applied by the wheel that the terms $PWR_p$ and $PWR_{te}$ mentioned above can be ignored while still obtaining sufficient accuracy.

The truing methods and apparatus here disclosed permit a grinding wheel to be restored to a desired shape by the action of truing elements made of any of a wide variety of materials. Truing elements may be made of relatively low cost materials, such as metal or metal alloy steels, heretofore deemed by the art to be unsuitable.

Yet, the truing elements may have an unexpectedly long life—and in the case of a diamond chip truing element, the useful life lies beyond any rational prediction.

The truing procedure, where wheel shape restoration is the main objective, leaves the wheel sharp, and the faster the wheel is trued down to a desired shape the sharper it will be left and the less the wearing down on the truing element. Yet, by conjointly establishing the relative infeed and relative surface speed of the rubbing contact which produces truing action, the degree of sharpness may be determined—and in turn the smoothness of the ground final surface on the workpiece.

The truing action may be periodic or continuous and, if desired, with control of STE or SGE. With essentially continuous truing action while a part is being ground, both wheel sharpness and shape may be maintained. Thin workpieces may be ground down by considerable amounts and at high rates with neither workpiece deformation nor surface burn. Yet, by simple charges of certain set points, the wheel may be conditioned for finish grinding and in a way which determines the smoothness of the final workpiece surface.

While the invention in its various aspects has been shown and described in some detail with reference to different specific method and apparatus embodiments, there is no intention thereby to limit the invention to such detail. On the contrary, it is intended here to cover all alternatives, variations and equivalents which fall within the spirit and scope of the following claims.

I claim:

1. The method of restoring the face of a grinding wheel which has deteriorated from the desired shape, said method comprising rotating the wheel and feeding the wheel face into relative rubbing contact with the operative surface of a truing element, said surface conforming to the desired shape for the wheel face, the hardness of the truing element material being less than the hardness of the grit material of the wheel, and said method being characterized by and including conjointly establishing the relative surface speed of said rubbing contact and relative infeed rate of said element and wheel to make the ratio W'/TE' greater than 1.0, where W' and TE' are the volume per unit time rates of removal of materials from the wheel and element, respectively.

2. The method set out of claim 1 further characterized in that said grinding wheel is employed in the successive grinding of a plurality of substantially identical workpieces, and said truing element is made of the same material as such workpieces and with an operative surface which is the same shape as the finished surface of one of the workpieces.

3. The method set out in claim 1 further characterized in that said grinding wheel is employed in the grinding of successive ones of a plurality of workpieces, and said truing element is identical to one of such workpieces.

4. The method of restoring the face of a grinding wheel which has deteriorated from the desired shape, said method comprising rotating the wheel and feeding the wheel face into relative rubbing contact with the operative surface of a truing element, said surface conforming to the desired shape for the wheel face, the hardness of the truing element material being equal to or greater than the hardness of the grit material of the wheel but not so hard that attritious type wear of the truing element does not perceptibly occur, and said method being characterized by and including conjointly establishing the relative surface speed of said rubbing contact and relative infeed rate of said element and wheel to make the ratio W'/TE' greater than 1.0 where W' and TE' are the volume per unit time rates of removal of materials from the wheel and element.

5. The method set out in claim 1 or claim 4 further characterized in that said truing element is a body of an homogeneous material.

6. The method set out in claim 1 or claim 4 further characterized in that said truing element is an homogeneous body of a metal alloy exemplified in its crystaline, structural homogeneity by the carbon steels, M series steels and the T series steels.

7. The method set out in claim 1 or claim 4 further characterized in that said truing element is made of hard steel.

8. The method of restoring the face of a grinding wheel which has deteriorated from the desired shape, said method comprising rotating the wheel and feeding the wheel face into relative rubbing contact with the operative surface of a truing element, said surface conforming to the desired shape for the wheel face, the truing element material being so vastly harder than the grit material of the wheel that attritious type wear of the truing element does not perceptibly occur, said method being characterized by and including conjointly establishing the relative surface speed of said rubbing contact and relative infeed rate of said element and wheel to promote grit and bond fracturing of the abrasive grits in the wheel as contrasted with attrition wearing and flatting of the points and corners of those grits, said relative surface speed for this purpose being made less than 3000 feed per minute but greater than zero.

9. The method set out in claim 8 wherein said truing element is a body having a plurality of diamond chips set in a supporting matrix of hard material.

10. The method of lengthening the service life of a truing element made of diamond chips bonded into a supporting matrix body, said method comprising relatively feeding the face of a rotating grinding wheel into relatively rubbing contact with an operative surface of said truing element, such surface having exposed edges and corners of the diamond chips, and said method being characterized by and including conjointly establishing the relative surface speed of said rubbing contact and the relative infeed rate of said wheel and element to promote grit fracturing and bond fracturing in the wheel and minimize attrition flatting of the wheel grits, said relative surface speed for this purpose being made less than 3000 feet per minute but greater than zero, whereby the wheel is not only trued but also sharpened and with negligible wear of the truing element.

11. The method set out in claims 1 or 4 or 8 further including varying the conjointly established relative surface speed and relative infeed during the course of the shape restoration by either (i) increasing or decreasing said relative surface speed to decrease or increase the grit-fracturing action and thereby make the wheel duller or sharper, or (ii) increasing or decreasing said relative infeed rate to increase or decrease the grit-fracturing action and thereby make the wheel sharper or duller.

12. The method set out in claim 1 or 4 or 8 wherein said relative surface speed is established within a range of values substantially lower than the range of relative surface speeds of rubbing contact, between the wheel face and a workpiece, with which said wheel is employed in the grinding of workpieces.

13. The method set out in claim 1 or 4 or 8 wherein said relative infeed rate is established within a range of values which is substantially higher than the range of relative infeed rates with which said wheel is employed in the grinding of workpieces.

14. The method set out in claim 1 or 4 or 8 further including inducing vibrations between the wheel and element at their region of rubbing contact, thereby to promote grit fracturing and bond fracturing on the wheel.

15. The method set out in claim 1 or 4 or 8 further including inducing rotational vibrations of the wheel relative to the truing element.

16. The method set out in claim 1 or 4 or 8 further including inducing translational vibrations of the wheel relative to the truing element in a direction lying normal to the axis of the wheel and passing through the region of rubbing contact.

17. The method set out in claim 1 or 4 or 8 further characterized in that said truing element is a roll journaled for rotation about an axis and having an operative surface which is a surface of revolution in rubbing contact with said wheel face, said method including braking the rotation of said roll to make the relative surface speed of said rubbing contact equal to the difference between the surface speed of the wheel and the surface speed of the roll.

18. The method set out in claim 1 or 4 or 8 further characterized in that said rubbing contact of the wheel face and operative surface of the truing element is created while said wheel face is also in grinding rubbing contact with a workpiece.

19. The method set out in claim 1 or 4 or 8 further characterized in that said rubbing contact of said wheel face and said operative surface is created during time spaced intervals over a span of time during which the wheel face is continuously in grinding rubbing contact with a workpiece.

20. In a grinding machine, the combination comprising (a) a grinding wheel mounted for rotation about its axis and means for rotationally driving the wheel at a controllable speed, said wheel having a face engageable with a workpiece for producing grinding action, (b) a truing element having an operative surface conforming to the desired shape of the wheel face, the hardness of the truing element material being less than the hardness of the grit material of the wheel, (c) means for relatively infeeding said wheel and element to bring said face and operative surface into relative rubbing contact, and (d) means for conjointly establishing the relative surface speed of said rubbing contact and the rate of said infeeding to make the ratio W'/TE' greater than 1.0, where W' and TE' are the volume per unit time rates of removal of materials from the wheel and element, respectively.

21. In a grinding machine, the combination comprising (a) a grinding wheel mounted for rotation about its axis and means for rotationally driving the wheel at a controllable speed, said wheel having a face engageable with a workpiece for producing grinding action, (b) a truing element having an operative surface conforming to the desired shape of the wheel face, the hardness of the truing element material being equal to or greater than the hardness of the grit material of the wheel but not so hard that attritious type wear of the truing element does not perceptibly occur, (c) means for relatively infeeding said wheel and element to bring said face and operative surface into relative rubbing contact, and (d) means for conjointly establishing the relative surface speed of said rubbing contact and the rate of said infeeding to make the ratio W'/TE' greater than 10.0, where W' and TE' are the volume per unit time rates of removal of materials from the wheel and element, respectively.

22. In a grinding machine, the combination comprising (a) a grinding wheel mounted for rotation about its axis and means for rotationally driving the wheel at a controllable speed, said wheel having a face engageable with a workpiece for producing grinding action, (b) a truing element having an operative surface conforming to the desired shape of the wheel face, the truing element material being so vastly harder than the grit material of the wheel that attritious type wear of the truing element does not perceptibly occur, (c) means for relatively infeeding said wheel and element to bring said face and operative surface into relative rubbing contact, and (d) means for conjointly establishing the relative surface speed of said rubbing contact and the relative infeed rate to promote grit and bond fracturing of the abrasive grits in the wheel face, said relative surface speed being less than 3000 feet per minute.

23. Apparatus as set out in claim 20 or 21 wherein said means (d) includes (d1) means for controlling said relative surface speed and said infeeding rate to maintain said ratio W'/TE' within a predetermined range which lies above the specified lower limit.

24. Apparatus as set out in claim 20 or 21 wherein said means (d) includes (d1) means for controlling said relative surface speed and said infeeding rate to maintain said ratio substantially equal to a predetermined but adjustable set point value which is greater than the specified lower limit.

25. Apparatus as set out in claim 20 or 21 further characterized in that said truing element is a homogeneous material.

26. Apparatus as set out in claim 20 or 21 further characterized in that said truing element is a metal or metal alloy material exemplified by steel.

27. The method set out in claim 1 or 4 or 8 further characterized in that the specific truing energy ratio of the truing action is maintained within a predetermined range of values.

28. The method set out in claim 1 or 4 or 8 further characterized in that the specific truing energy ratio of the truing action is maintained substantially equal to a predetermined value.

29. The method set out in claim 1 or 4 further characterized in that said rubbing contact of said wheel face and said operative surface is created, prior to or during rough grinding of a workpiece, with said ratio W'/TE' maintained generally within a first predetermined range; and said rubbing contact of said wheel face and said operative surface is subsequently created, prior to or during finish grinding of said workpiece, with said ratio W'/TE' maintained generally within a second predetermined range which has a span lower than the span of said first predetermined range.

30. The method set out in claim 8 further characterized in that said rubbing contact of said wheel face and said operative surface is created, prior to or during the rough grinding of a workpiece with said relative surface speed maintained within a first predetermined range; and said rubbing contact of said wheel face and said operative surface is subsequently created, prior to or during finish grinding of said workpiece, with said relative surface speed maintained within a second predetermined range which has a span higher than the span of said first predetermined range.

31. The method set out in claim 1 or 4 or 8 further characterized in that said rubbing contact of said wheel face and said operative surface is created during spaced time intervals within a time span over which said wheel is in rubbing contact with a workpiece to create grinding action, and during time periods intermediate said intervals said truing element is bodily moved to generally maintain a predetermined spacing gap between the wheel face and the operative surface despite wear reduction of the wheel radius.

32. The method of grinding a workpiece which lacks structural rigidity sufficient to withstand, without deleterious deflection, substantial forces imposed thereon by a grinding wheel, said method comprising (a) relatively feeding the workpiece and a rotationally driven grinding wheel into relative rubbing contact to create grinding action, and said method being characterized by (b) while said procedure (a) is in progress, relatively feeding the operative surface of a truing element, made of material less hard than the grit material of said wheel, into relative rubbing contact with the face of the wheel, and (c) conjointly establishing the relative surface speed and relative feed rate of said last-named rubbing contact to make the ratio W'/TE' greater than 1.0, where W' and TE' are the volume per unit time rates of removal of materials from said wheel and element, respectively.

33. The method of grinding a workpiece which lacks structural rigidity sufficient to withstand, without deleterious deflection, substantial forces imposed thereon by a grinding wheel, said method comprising (a) relatively feeding the workpiece and a rotationally driven grinding wheel into relative rubbing contact to create grinding action, and said method being characterized by (b) while said procedure (a) is in progress, relatively feeding the operative surface of a truing element, made of a material having a hardness equal to or greater than the hardness of the grit material of said wheel but not so hard that attritious type wear of the truing element does not perceptibly occur, into relative rubbing contact with the face of the wheel, and (c) conjointly establishing the relative surface speed and relative feed rate of said last-named rubbing contact to make the ratio W'/TE' greater than 10.0, where W' and TE' are the volume per unit time rates of removal of materials from said wheel and element, respectively.

34. The method of grinding a workpiece which lacks structural rigidity sufficient to withstand, without deleterious deflection, substantial forces imposed thereon by a grinding wheel, said method comprising (a) relatively feeding the workpiece and a rotationally driven grinding wheel into relative rubbing contact to create grinding action, and said method being characterized by (b) while said procedure (a) is in progress, relatively feeding the operative surface of a truing element, made of a meterial so vastly harder than the grit material of said wheel that attritious type wear of the truing element does not perceptibly occur, into relative rubbing contact with the face of the wheel, and (c) controlling the relative surface speed $S_r$ of said last-named rubbing contact such that it is below 3000 surface feet per minute.

* * * * *